US012037151B2

(12) United States Patent
Tanaka et al.

(10) Patent No.: US 12,037,151 B2
(45) Date of Patent: Jul. 16, 2024

(54) CARTONING APPARATUS

(71) Applicant: KYOTO SEISAKUSHO CO., LTD., Kyoto (JP)

(72) Inventors: Hiroaki Tanaka, Kyoto (JP); Yoshiyuki Okazaki, Kyoto (JP)

(73) Assignee: Kyoto Seisakusho Co., Ltd., Kyoto (JP)

( * ) Notice: Subject to any disclaimer, the term of this patent is extended or adjusted under 35 U.S.C. 154(b) by 79 days.

(21) Appl. No.: 18/001,788

(22) PCT Filed: Jun. 10, 2021

(86) PCT No.: PCT/JP2021/022121

§ 371 (c)(1),
(2) Date: Dec. 14, 2022

(87) PCT Pub. No.: WO2021/261274

PCT Pub. Date: Dec. 30, 2021

(65) Prior Publication Data

US 2023/0227190 A1 Jul. 20, 2023

(30) Foreign Application Priority Data

Jun. 22, 2020 (JP) ..... 2020-107282

(51) Int. Cl.
*B65B 43/10* (2006.01)
*B65B 5/02* (2006.01)
*B65B 43/18* (2006.01)

(52) U.S. Cl.
CPC ..... *B65B 43/10* (2013.01); *B65B 5/02* (2013.01); *B65B 43/18* (2013.01)

(58) Field of Classification Search
CPC ..... B65B 43/10; B65B 5/024; B65B 35/36; B65B 35/405; B65B 43/18; B65B 43/285;
(Continued)

(56) References Cited

U.S. PATENT DOCUMENTS 4,894,104 A * 1/1990 Hemus ..... B65B 51/023 156/499
5,024,640 A * 6/1991 Saitoh ..... B31B 50/00 493/317

(Continued)

FOREIGN PATENT DOCUMENTS

EP 2865602 A1 * 4/2015 ..... B65B 43/52
JP 2005-145558 A 6/2005

OTHER PUBLICATIONS

International Search Report (with partial translation) dated Jul. 13, 2021, issued in corresponding International Patent Application No. PCT/JP2021/022121.

*Primary Examiner* — Dariush Seif
(74) *Attorney, Agent, or Firm* — Morgan, Lewis & Bockius LLP

(57) ABSTRACT

A box transport rail 70 extending in the box transport direction Tb and a plurality of box transport shuttles 76 movably arranged on the box transport rail 70 to be movable in the box transport direction Tb, which is the movement direction of a packing box Bx, are provided. When located in the sheet feeder 81, the box transport shuttles 76 receive the sheet 9 while being apart from each other across an interval greater than the bottom sheet portion 91 of the sheet 9. During movement from the pushing unit 82 to the sealer 84, the box transport shuttle 76 arranged frontward in the box transport direction Tb is brought close to the bottom sheet portion 91 to reduce the angle of a part 93 frontward of the bottom sheet portion 91 in the box transport direction Tb relative to the bottom sheet portion 91.

6 Claims, 35 Drawing Sheets

(58) Field of Classification Search
CPC ..... B65B 43/54; B65B 5/02; B65B 5/106; B65B 7/26; B65B 7/20; B31B 50/42
See application file for complete search history.

(56) References Cited

U.S. PATENT DOCUMENTS 5,027,586 A * 7/1991 Ramaker ..... B65B 43/285 53/566
5,067,937 A * 11/1991 Aschaber ..... B31B 50/80 493/310
5,070,681 A * 12/1991 Romagnoli ..... B65B 59/04 53/566
5,154,041 A * 10/1992 Schneider ..... B65B 7/26 53/376.5
5,782,732 A * 7/1998 Herrin ..... B31B 50/36 493/131
5,782,734 A * 7/1998 Reuteler ..... B65B 43/305 493/123
5,831,352 A * 11/1998 Takei ..... H02K 41/03 310/12.24
5,863,380 A * 1/1999 Gambetti ..... B65B 51/023 493/131
5,971,906 A * 10/1999 Tharpe, Jr. ..... B65D 71/0096 493/131
6,073,423 A * 6/2000 House ..... B65B 43/305 493/317
6,285,918 B1 * 9/2001 Kono ..... G01G 19/393 700/240
6,383,123 B1 * 5/2002 Ehring ..... B65G 47/848 493/52
6,699,165 B1 * 3/2004 Krieger ..... B65B 43/185 493/122
6,876,896 B1 * 4/2005 Ortiz ..... B29C 65/7867 318/135
9,821,526 B2 * 11/2017 Cavazza ..... B65B 43/185
9,969,565 B1 * 5/2018 Simm ..... B65B 35/38
10,946,988 B2 * 3/2021 Richter ..... B65B 61/24
2003/0049371 A1 * 3/2003 Fort ..... B65B 51/023 427/207.1
2004/0261368 A1 * 12/2004 Focke ..... B65B 19/18 53/449
2005/0079965 A1 * 4/2005 Moshier ..... B65D 5/02 493/52
2007/0072756 A1 * 3/2007 Monti ..... B65B 59/003 493/309
2008/0196360 A1 * 8/2008 Monti ..... B65B 5/024 53/381.1
2008/0227612 A1 * 9/2008 Harston ..... B65B 43/185 53/309
2012/0096808 A1 * 4/2012 Poutot ..... B65B 5/024 53/235
2013/0227914 A1 * 9/2013 Allgaier ..... B65B 43/52 53/285
2016/0207658 A1 * 7/2016 Bellante ..... B65B 35/10
2016/0244273 A1 * 8/2016 Schaeuble ..... B65G 47/763
2016/0257089 A1 * 9/2016 Deering ..... B31B 50/062
2017/0001740 A1 * 1/2017 Richard ..... B65B 43/325
2017/0259947 A1 * 9/2017 Cerf ..... B65B 5/028
2018/0222608 A1 * 8/2018 Hutter ..... B65B 5/024
2020/0198823 A1 * 6/2020 Bauer ..... B65B 43/145
2020/0207491 A1 * 7/2020 Koet ..... B31B 50/741
2020/0307140 A1 * 10/2020 De Boer ..... B31B 50/0044
2020/0385221 A1 * 12/2020 Tanaka ..... B65G 21/2054
2021/0138756 A1 * 5/2021 Langen ..... B31B 50/262
2021/0237385 A1 * 8/2021 Fridolfsson ..... B65B 43/325
2022/0306331 A1 * 9/2022 Myllykangas ..... B65B 57/04
2022/0315356 A1 * 10/2022 Solà Gil ..... B65B 43/12
2023/0227190 A1 * 7/2023 Tanaka ..... B65B 43/10 53/285
2023/0234789 A1 * 7/2023 Hayashi ..... B65G 47/68 198/436

* cited by examiner

Fig. 27
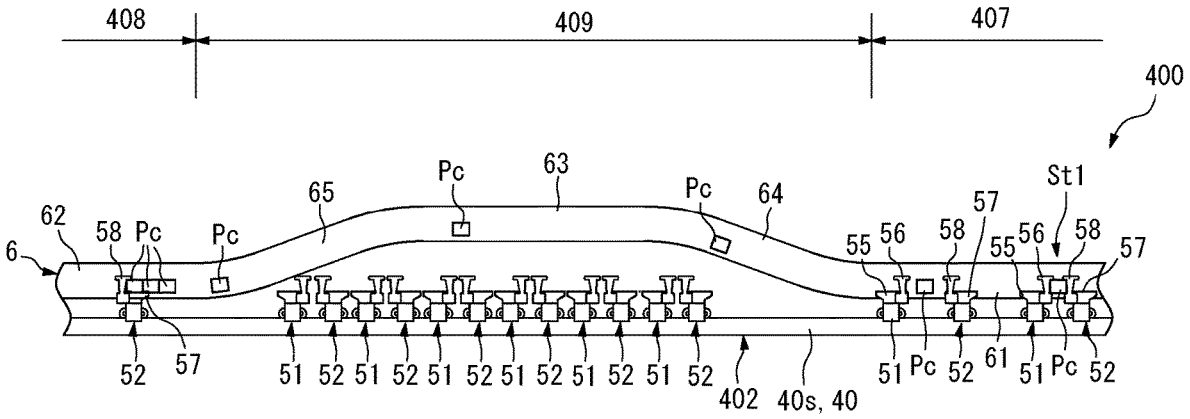
Fig, 28
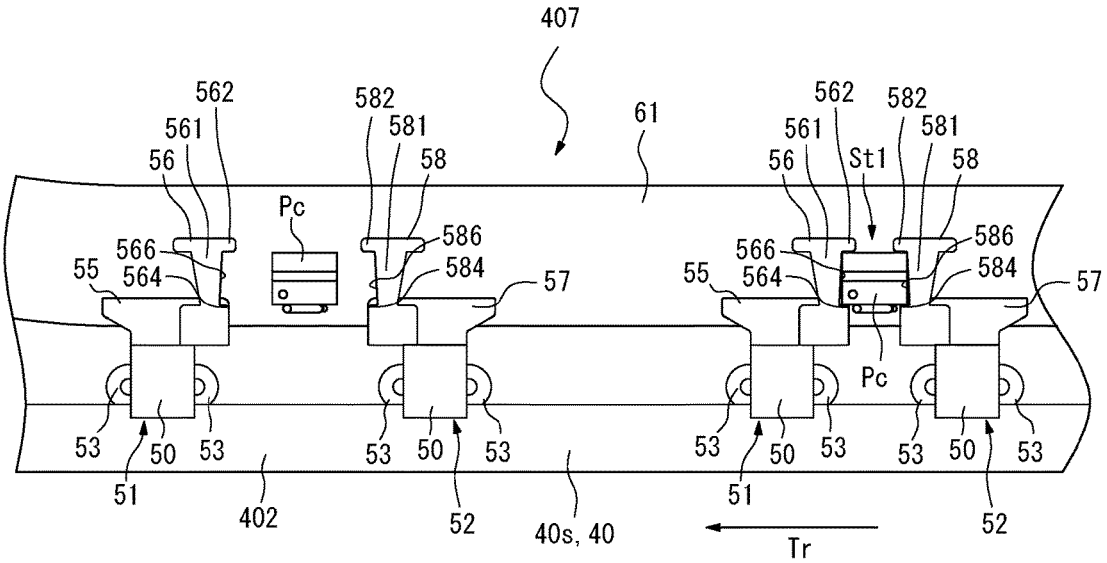

CARTONING APPARATUS

TECHNICAL FIELD

The present invention relates to a cartoning apparatus for packing articles (hereinafter also referred to as pieces to be transported, abbreviated to transported pieces) in boxes.

BACKGROUND ART

JP-A-2005-145558 discloses a cartoning apparatus that forms a sheet into a box, then transports the box with an opening pointing to the side, and then puts articles into the box sideways through the opening. This design permits the forming of the box and the cartoning of articles in one sequence of operation, and thus helps reduce the installation area of the apparatus.

CITATION LIST

Patent Literature

Patent Document 1: JP-A-2005-145558

SUMMARY OF INVENTION

Technical Problem

Inconveniently, with the invention disclosed in JP-A-2005-145558, articles are put into the box, which is constructed to have one opening, turned sideways; thus, if the articles are heavy, when the box is turned back upright, it may deform or break. Or, if the articles do not tolerate being turned sideways, it may be impossible to put them into the box.

Against the background discussed above, an object of the present invention is to provide a cartoning apparatus with which it is possible to pack articles in a box easily and speedily.

Solution to Problem

To achieve the above object, according to one aspect of the present invention, a cartoning device packs articles, such as transported pieces in the shape of a rectangular parallelepiped, in a packing box formed by folding a sheet, and then transports the packing box in the box transport direction. The cartoning device includes: a box transport rail extending along the box transport direction; a plurality of box transport shuttles movably arranged on the box transport rail so as to be movable in the box transport direction; a box transport linear motor mechanism configured to control the plurality of box transport shuttles independently of each other; a sheet feeder configured to absorb by suction the sheet from a sheet placement stage, then bring a front and a rear part of the sheet in its transport direction into contact with the box transport shuttles located in a row frontward and rearward of the sheet in the transport direction to fold the sheet, and then feed the sheet onto the box transport rail; a pushing unit configured to push, in a direction intersecting the box transport direction, the articles into the folded sheet having moved rearward of the sheet feeder in the box transport direction by the box transport shuttles; and a sealer configured to seal the sheet by pressing, from above and from frontward and rearward in the transport direction of the sheet and from a direction intersecting the transport direction, the sheet having a to-be-packed number of articles pushed thereinto and having been moved rearward of the pushing unit in the transport direction by the box transport shuttles. When located in the sheet feeder, the box transport shuttles receive the sheet while being apart from each other across an interval greater than the bottom sheet portion of the sheet. During movement from the pushing unit to the sealer, the box transport shuttle arranged frontward in the box transport direction is brought close to the bottom sheet portion so as to reduce the angle of a part frontward of the bottom sheet portion in the box transport direction relative to the bottom sheet portion.

With this configuration, when the sheet is folded by being brought into contact with the box transport shuttles, the ample interval between them permits easy feeding of the sheet. Owing to articles being pushed in in the box transport direction with only a front and a rear part of the sheet in the box transport direction folded, the sheet does not need to be reoriented after it is fed until it is carried out. This permits easy and speedy cartoning.

In the configuration described above, the box transport shuttles may include a sheet holding arm extending vertically upward. Contact with the sheet holding arm permits reliable folding of the sheet. Moreover, when the folded sheet is pushed in the box transport direction, a large contact area reduces strain on the sheet.

In the configuration described above, the box transport rail may include: straight box transport rails arranged one above another; and curved box transport rails coupling the straight box transport rails together into the shape of a loop. The sheet feeder, the pushing unit, and the sealer may be arranged along the upper straight box transport rail.

In the configuration described above, there may be further provided a guide rail arranged along the upper straight box transport rail and supporting the sheet from below. The guide rail helps restrain the weight of the sheet and the articles pushed into it from acting on the box transport rail.

In the configuration described above, the pushing unit may comprise a plurality of pushing units. This permits the cartoning of articles to be performed as a batch process, and helps reduce the time required for cartoning.

In the configuration described above, the box transport shuttles may transport the packing box, which is formed by sealing with the sealer the sheet having the articles packed therein, to a carry-out unit provided rearward of the sealer in the box transport direction while holding the packing box from frontward and rearward of it.

Advantageous Effects of Invention

With a cartoning apparatus according to the present invention, it is possible to pack articles in a box easily and speedily.

BRIEF DESCRIPTION OF DRAWINGS

FIG. 27 is a plan view of a principal part of a re-holding device.

FIG. 28 is an enlarged plan view of the first and second delivery shuttles passing over a transported piece to a re-holding conveyor.

DESCRIPTION OF EMBODIMENTS

An embodiment of the present invention will be described below with reference to the accompanying drawings.

<Transport and Cartoning Apparatus 100>

Figure 1:
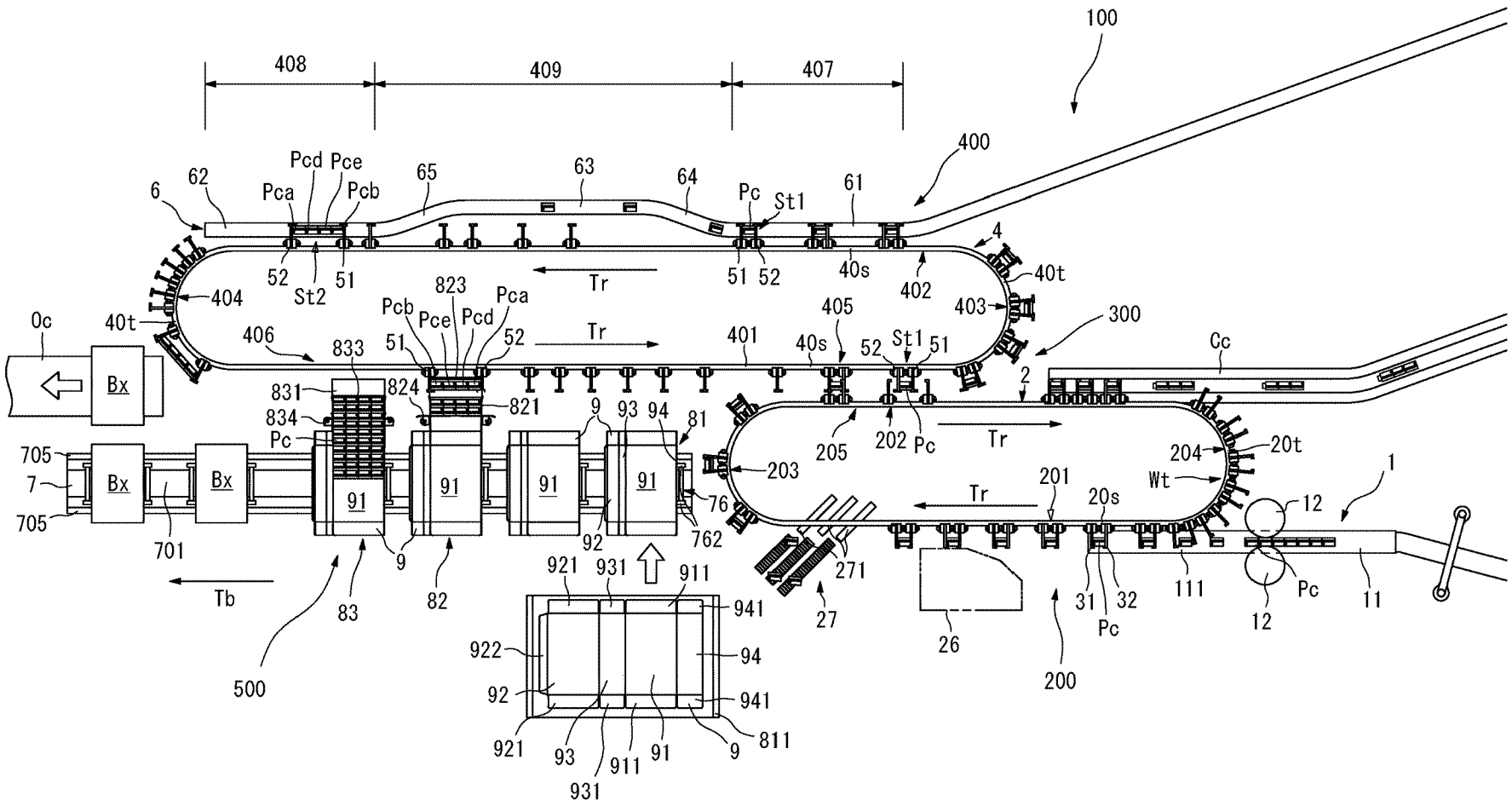
FIG. 1 is a schematic layout diagram of a transport and cartoning apparatus.

FIG. 1 is a schematic layout diagram of a transport and cartoning apparatus 100. The transport and cartoning apparatus 100 is arranged for a process following an unillustrated filling process in which articles are filled with their contents. As shown in FIG. 1, the transport and cartoning apparatus 100 transports articles (also called transported pieces) Pc in a substantially rectangular parallelepiped shape that are filled with liquid contents, and packs them in a packing box Bx suitable to be carried out. The transport and cartoning apparatus 100 then seals the box Bx having a predetermined number of transported pieces Pc packed in it, and then carries it out.

Figure 2:
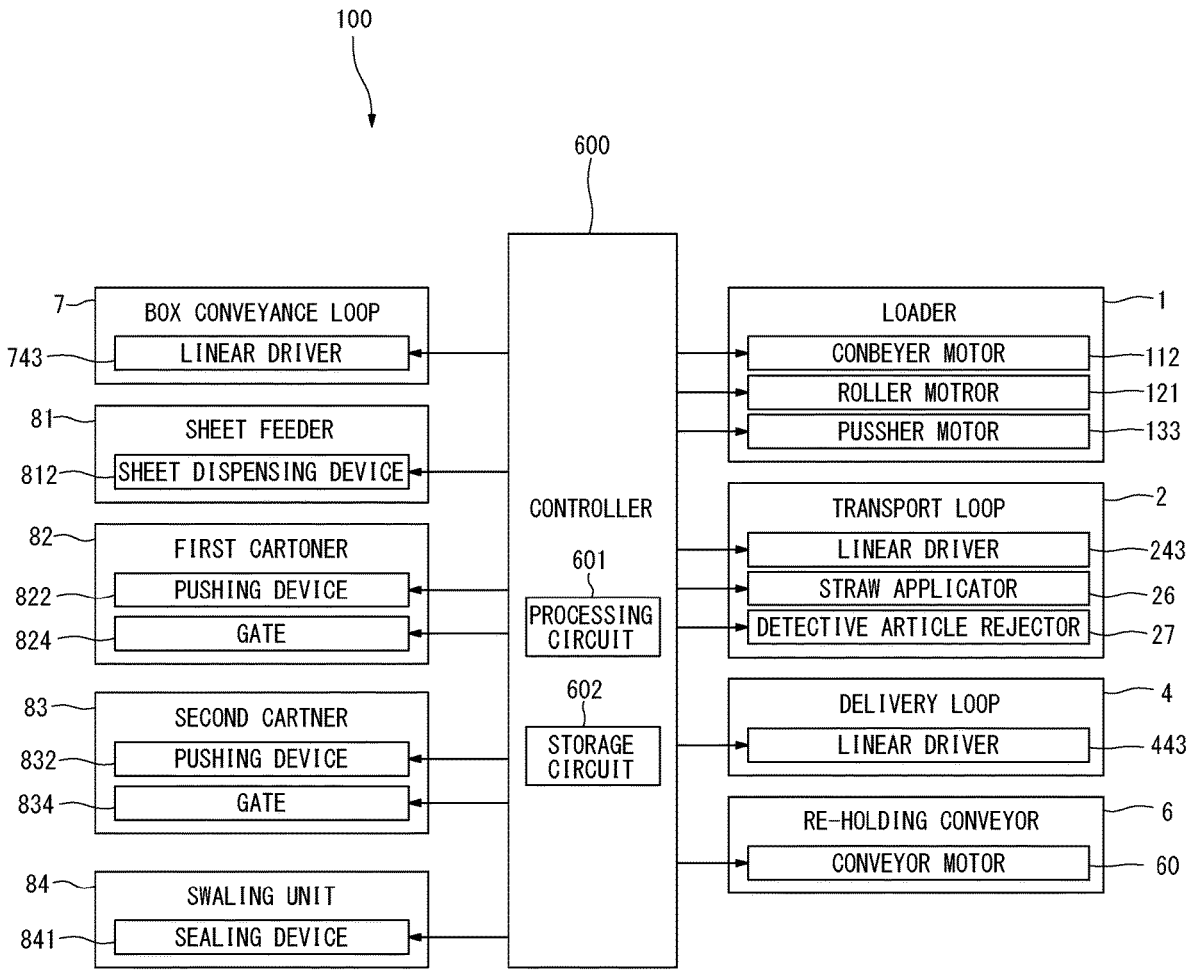
FIG. 2 is a functional block diagram of the transport and cartoning apparatus.

The transport and cartoning apparatus 100 includes a transfer device 200, a delivery device 300, a re-holding device 400, a cartoning device 500, and a controller 600 (see FIG. 2). The transfer device 200 transfers transported pieces Pc carried out of an unillustrated filling device to the transport and cartoning apparatus 100.

<Controller 600>

The controller 600 will now be described in detail. FIG. 2 is a functional block diagram of the transport and cartoning apparatus 100. As shown in FIG. 2, the controller 600 includes a processing circuit 601 and a storage circuit 602. The processing circuit 601 is a circuit that processes various kinds of information, and includes a data processing circuit such as a CPU or MPU. Based on the results of data processing, the processing circuit 601 also controls control targets included in the transfer device 200, the delivery device 300, the re-holding device 400, and the cartoning device 500.

The storage circuit 602 is a circuit that includes, or is connected to, a semiconductor memory such as a ROM and a RAM, a portable memory such as a flash memory, and a storage medium such as a hard disk. Various programs such as control programs and processing programs are stored in the storage circuit 602 so that, as necessary, programs corresponding to desired processes are called and run on the processing circuit 601 to perform those processes. The elements connected to the controller 600 and their control will be described in the course of the description of each element.

<Transfer Device 200>

Figure 3:
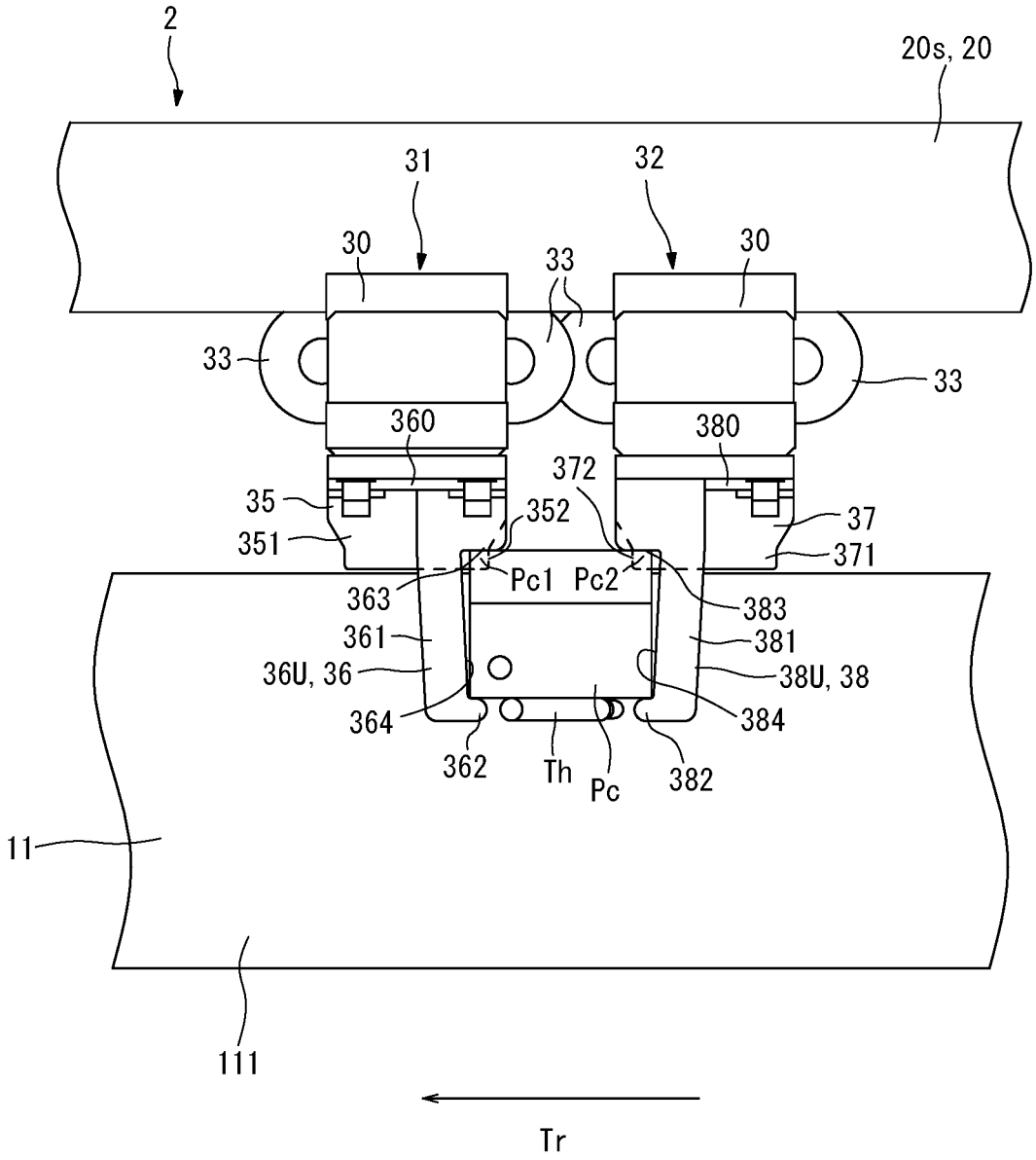
FIG. 3 is a plan view of a first and a second transport shuttle moving along a straight transport rail while holding a transported piece.
Figure 4:
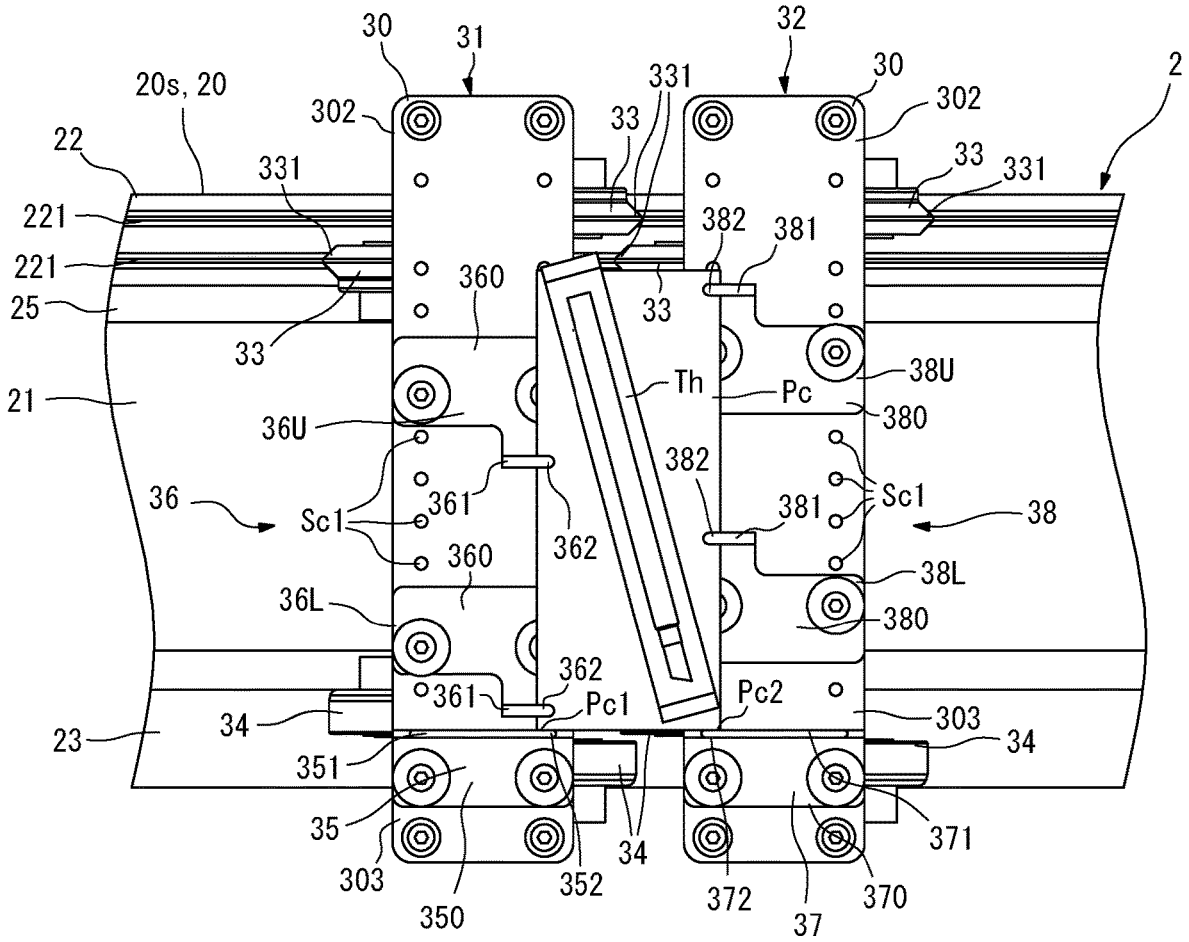
FIG. 4 is a diagram showing the first and second transport shuttles shown in FIG. 3 as seen from outward.
Figure 5:
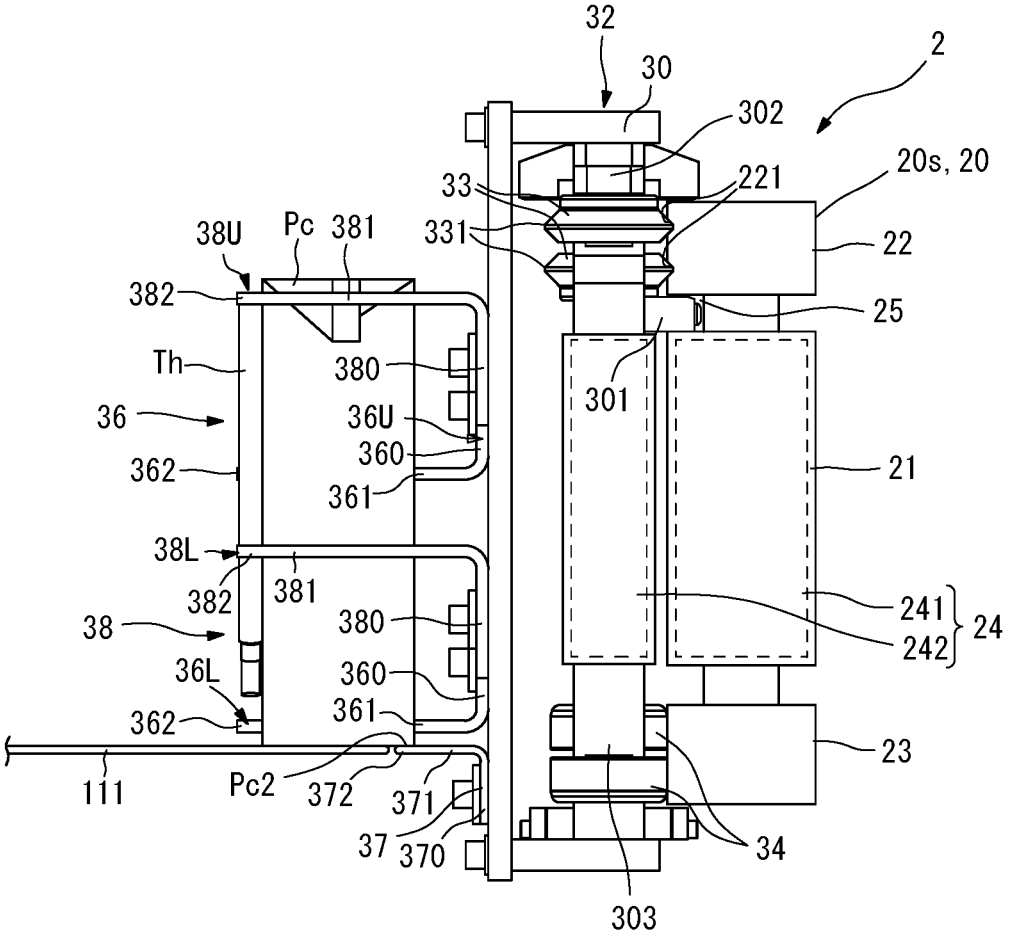
FIG. 5 is a diagram showing the first and second transport shuttles as seen from rearward in the transport direction.

Next, the different parts of the transfer device 200 will be described in detail with reference to the relevant diagrams. FIG. 3 is a plan view of a first transport shuttle 31 and a second transport shuttle 32 moving along a straight transport rail 20*s* while holding a transported piece Pc. FIG. 4 is a diagram showing the first and second transport shuttles 31 and 32 shown in FIG. 3 as seen from outward. FIG. 5 is a diagram showing the first and second transport shuttles 31 and 32 as seen from rearward in the transport direction Tr.

As shown in FIGS. 1, 3, 4, and 5, the transfer device 200 includes an article loader 1, a transport loop 2, first transport shuttles 31, and second transport shuttles 32. In the following description, for any unit formed in the shape of a loop, a direction pointing away from the region enclosed by the loop will be referred to simply as "outward".

<Article Loader 1>

Figure 7:
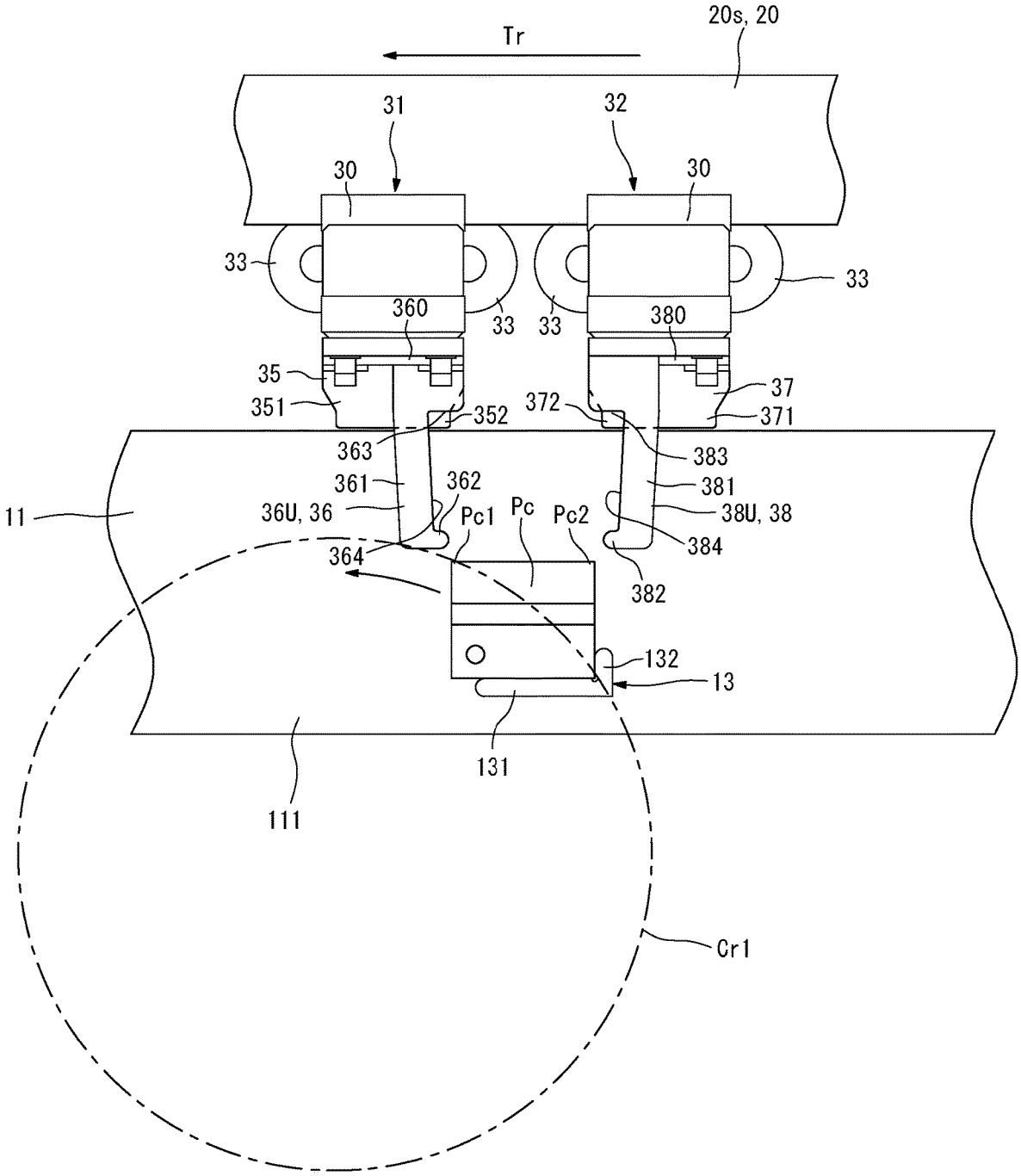
FIG. 7 is a plan view showing the operation of a pusher before transfer.

As shown in FIG. 1, the article loader 1 includes a loading conveyor 11, a pair of nip rollers 12, and a pusher 13 (see FIG. 7). The loading conveyor 11 is a conveyor that transports transported pieces Pc in a substantially rectangular parallelepiped shape that have been filled with their contents by an unillustrated filling device. With a transported piece Pc placed on the top surface of the loading conveyor 11, moving its top surface permits the transported piece Pc to move along the loading conveyor 11.

Here, the loading conveyor 11 can be a common transport conveyor such as a belt conveyor or a top chain conveyor. In the transfer device 200 of the embodiment, it is generally required that, when a transported piece Pc is transported on the loading conveyor 11, it be hardly slippery on the top surface of the loading conveyor 11 during steady transport and adequately slippery on it during passing-over or the like. To meet the requirement, there have to be adequate static and dynamic friction coefficients between the transported piece Pc and (the top surface of) the loading conveyor 11.

Through intensive studies, the inventors of the present invention have found out that, to obtain optimal friction coefficients as mentioned above, it is preferable to use a top chain conveyor as the loading conveyor 11. Accordingly, in the transfer device 200 according to the embodiment, a top chain conveyor is used as the loading conveyor 11. In the following description, the movement of a transported piece Pc is referred to as its transport, and the movement direction of a transported piece Pc is referred to as its transport direction Tr.

A front part of the loading conveyor 11 in the transport direction Tr is located close to a first straight section 201, which will be described later, of the transport loop 2, and has a transfer conveying part 111, which extends parallel to the first straight section 201. A transported piece transported by the loading conveyor 11 is, in the transfer conveying part 111, held by a first and a second transport shuttle 31 and 32 moving along the transport loop 2. Thus the transported piece Pc is transferred from the article loader 1 to the transport loop 2. The transfer of a transported piece Pc will be described in detail later.

The loading conveyor 11 has a conveyer motor 112 (see FIG. 2). The conveyer motor 112 is connected to the controller 600, and serves as a power source that drives the loading conveyor 11 according to instructions from the controller 600.

The pair of nip rollers 12 is arranged above the loading conveyor 11. The transfer conveying part 111 of the loading conveyor 11 is arranged frontward of the pair of nip rollers 12 in the transport direction Tr. The pair of nip rollers 12 are rotatable about center axes that extend vertically, and those center axes of the nip rollers 12 are arranged parallel to each other. The pair of nip rollers 12 makes contact with those faces of the transported piece Pc which intersect the transport direction Tr, and thereby holds the transported piece Pc to restrict its movement.

That is, the nip rollers 12 adjust the intervals between the transported pieces Pc that are transported by the loading conveyor 11.

The pair of nip rollers 12 are rotated by a roller motor 121 (see FIG. 2). The nip rollers 12 may each be provided with a roller motor 121, or a mechanism for transmitting a driving force may be used to transmit the driving force of a single roller motor 121 is transmitted to each of the nip rollers 12. As shown in FIG. 2, the roller motor 121 is connected to the controller 600. The roller motor 121 is driven according to instructions from the controller 600.

The nip rollers 12 have a surface formed of a material with high friction against the surface of the transported piece Pc. Thus, as the controller 600 controls the operation of the pair of nip rollers 12, the transported pieces Pc transported on the loading conveyor 11 can be fed one by one toward the transfer conveying part 111.

The pusher 13 (see FIG. 7) is arranged above the transfer conveying part 111 of the loading conveyor 11. The pusher 13 is a moving unit that moves a transported piece Pc moving on the loading conveyor 11 toward a transport rail 20. The pusher 13 will be described in detail later.

<Transport Loop 2>

The transport loop 2 includes a transport rail 20, a transport linear motor mechanism 24 (see FIGS. 5 and 21), a straw applicator 26, and a defective article rejector 27. The transport loop 2 has its opposite ends coupled together to be formed in the shape of a loop. The transport loop 2 includes a first straight section 201 and a second straight section 202 each formed with a straight transport rail 20*s*, and a first curved section 203 and a second curved section 204 each formed with a curved transport rail 20*t*. A straight transport rail 20*s* and a curved transport rail 20*t* have the same structure except whether they are curved or not. In the following description, a transport rail is referred to simply as a transport rail 20 unless distinction is necessary, in which case it is identified accordingly.

<Transport Rail 20>

As shown in FIGS. 4 and 5, the transport rail 20 has a main rail 21, a grooved rail 22, and a flat rail 23. The main rail 21 is a member in the shape of a prism with a rectangular cross-section on a plane orthogonal to the transport direction Tr. The cross-sectional shape of the main rail 21 has its longer-side direction aligned with the up-down direction. Inside the main rail 21, coils 241, which will be described later, of the transport linear motor mechanism 24 are arranged. The main rail 21 is formed of a material through which the magnetic force from the coils 241 permeates when they are magnetically excited. Examples of such materials include, but are not limited to, some types of stainless steel, aluminum, and alloys of aluminum.

The grooved rail 22 is fixed to a top part of the main rail 21. As shown in FIGS. 4 and 5, between the main rail 21 and the grooved rail 22, a gap 25 is formed. The gap 25 is so shaped that protrusions 301, which will be described later, of the first and second transport shuttles 31 and 32 fit in it. Thus the first and second transport shuttles 31 and 32 are guided so as to be movable in a direction along the transport rail 20.

The main rail 21 and the grooved rail 22 can be fixed together by welding, screw-fastening, or the like, without limitation to those means. The main rail 21 and the grooved rail 22 may be formed unitarily. The grooved rail 22 has grooves 221 each with a recessed shape recessed from the rail's outer face in a direction intersecting the transport direction Tr. The grooves 221 are formed all around the transport loop 2. The grooved rail 22 has two grooves 221. The two grooves 221 are arranged one above the other. The two 221 are engaged with upper rollers 33, which will be described later, of the first and second transport shuttles 31 and 32. The upper rollers 33 of the first and second transport shuttles 31 and 32 move along the grooves 221.

The flat rail 23 is fixed to a bottom part of the main rail 21. The main rail 21 and the flat rail 23 can be fixed together by welding, screw-fastening, or the like, without limitation to those means. The main rail 21 and the flat rail 23 may be formed unitarily. The flat rail 23 is so shaped that the outer side of its cross-section on a plane intersecting the transport direction Tr extends along a vertical line (see FIG. 4 etc.). With the outer face of the flat rail 23, lower rollers 34, which will be described later, of the first and second transport shuttles 31 and 32 lie in contact. The lower rollers 34 rotate while in contact with the outer face of the flat rail 23.

The first and second straight sections 201 and 202 include straight transport rails 20*s* that are of the same length and that are arranged parallel as seen in a plan view. The first and second straight sections 201 and 202 are both arranged with the groove 221 in the grooved rail 22 facing outward.

Figure 6:
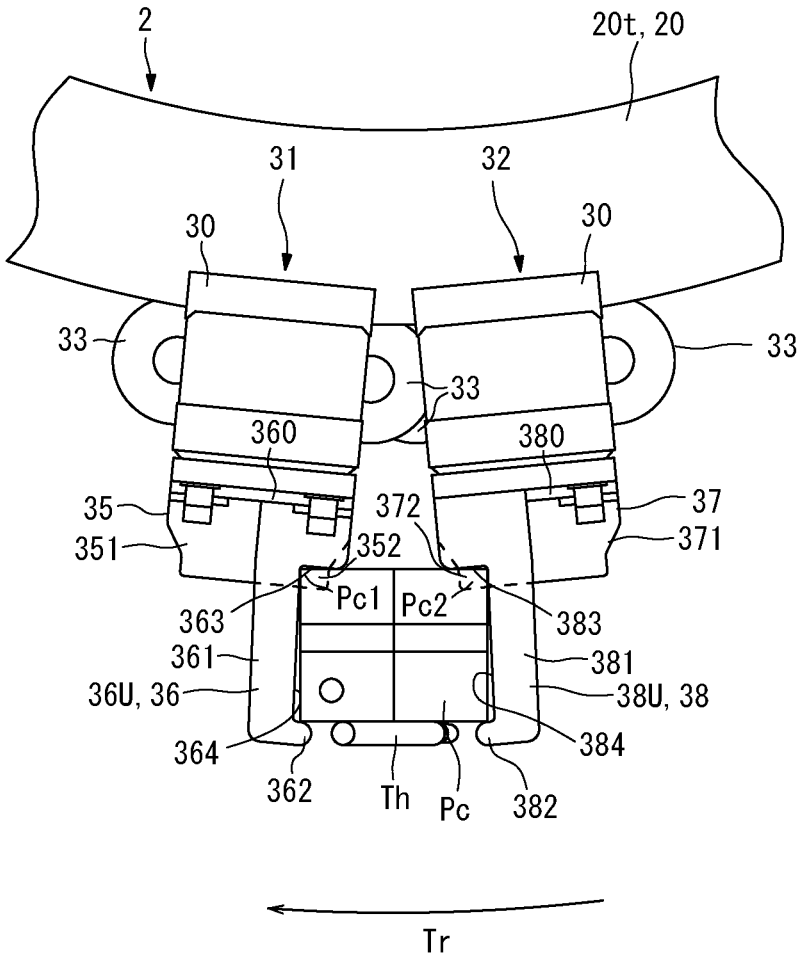
FIG. 6 is a plan view of the first and second transport shuttles moving along a curved transport rail while holding a transported piece.

The first and second curved sections 203 and 204 include curved transport rails 20*t* (see FIGS. 1 and 6). The first curved section 203 connects together a front end part of the first straight section 201 in the transport direction Tr and a rear end part of the second straight section 202 in the transport direction Tr. The second curved section 204 connects together a front end part of the second straight section 202 in the transport direction Tr and a rear end part of the first straight section 201 in the transport direction Tr. Thus the transport loop 2 is formed in the shape of a loop as a result of the first straight section 201, the first curved section 203, the second straight section 202, and the second curved section 204 coupled one to the next in the order named.

In the transport loop 2 according to the embodiment, the first and second curved sections 203 and 204 are in the shape of arcs with equal radii of curvature. The first and second curved sections 203 and 204 may be partly curved or partly straight. Their curved sections may be in the shape of, instead of arcs, clothoid or any other curves.

As shown in FIG. 1, the first and second transport shuttles 31 and 32 move clockwise along the transport rail 20 as seen in a plan view. A rear part of the first straight section 201 in the transport direction Tr is arranged parallel to, and close to, the transfer conveyer part 111 of the loading conveyor 11. A transported piece Pc transported on the transfer conveying part 111 is moved by the pusher 13 toward the first straight section 201, and is held by the first and second transport shuttles 31 and 32. Thus the transported piece Pc can be transferred from transport by the loading conveyor 11 to transport by the first and second transport shuttles 31 and 32. The transfer of a transported piece Pc will be described in detail later.

In the transfer device 200, the first and second transport shuttles 31 and 32 first move along the second curved section 204, and then moves to rearward of the first straight section 201 in the transport direction Tr. In the transport loop 2, the second curved section 204 serves as a standby area where the first and second transport shuttles 31 and 32 stay on standby before the transfer of the next transported piece Pc takes place. In the standby area, the first and second transport shuttles 31 and 32 may be at rest, or may be moving at a lower speed than during transport.

<Transport Linear Motor Mechanism 24>

In the transport loop 2, a plurality of first transport shuttles 31 and the same number of second transport shuttles 32 as the first transport shuttles 31 are arranged alternately along the transport direction Tr. The transport linear motor mechanism 24 can drive the first and second transport shuttles 31 and 32 independently.

As shown in FIGS. 2 and 5, the transport linear motor mechanism 24 includes a plurality of coils 241, magnets 242, and a linear driver 243. The plurality of coils 241 are arrayed, inside the transport rail 20 arranged in the shape of a loop, along the shape of a loop.

The magnets 242 are permanent magnets and are arranged in the main bodies 30 of the first and second transport shuttles 31 and 32. As shown in FIG. 5, a magnet 242 is arranged inside a main body 30. The magnet 242 is arranged such that it and a coil 241 can exert a magnetic force to each other. The magnet 242 arranged in the main body 30 and the plurality of coils 241 arranged inside the transport rail 20 together form a linear motor.

The linear driver 243 is connected to the coils 241. The linear driver 243 is connected to an unillustrated power supply circuit. The linear driver 243 is a circuit that supplies the coils 241 with electric power, and includes circuits such as a data processing circuit and a power supply circuit for adjusting the voltage and current supplied to the coils 241. The linear driver 243 supplies the coils with adequate currents according to instructions from the controller 600.

The controller 600 controls the linear driver 243 to change the coils 241 to which electric power is supplied and the electric power supplied to them. Thus the controller 600 controls the movement of the first and second transport shuttles 31 and 32 independently. The controller 600 can control the first and second transport shuttles 31 and 32 synchronously.

The transport linear motor mechanism 24 moves the first and second transport shuttles 31 and 32 along the transport rail 20. For example, the first and second transport shuttles 31 and 32 can move while holding a transported piece Pc.

<Straw Applicator 26>

The straw applicator 26 attaches a straw Th (see FIGS. 3 to 5) to the transported piece Pc held by the first and second transport shuttles 31 and 32, on the face of the transported piece Pc opposite from the transport rail 20. A straw Th wrapped in a resin bag is attached to the transported piece Pc.

The straw applicator 26 attaches the straw Th to such a part of the face of the transported piece Pc opposite from the transport rail 20 as is not concealed by a first transport engaging portion 36, which will be described later, of the first transport shuttle 31 and a second transport engaging portion 38, which will be described later, of the second transport shuttle 32. The straw Th can be attached, for example, with hot melt, with adhesive, or by any other means.

Some transported pieces Pc do not need to be fitted with a straw Th. In that case, the straw applicator 26 may be omitted. Any elongate object other than a straw Th may be attached to transported pieces Pc by use of the straw applicator 26.

<Defective Article Rejector 27>

With the straw Th attached to it, the transported piece Pc is complete. In the transfer device 200, the appearance of the transported piece Pc moving along the transport loop 2, for example the bonding condition on its bottom and top faces, is inspected by an unillustrated inspector. The results of the inspection by the inspector are fed to the controller 600. Based on the inspection results, the processing circuit 601 in the controller 600 distinguishes good and defective articles.

The defective article rejector 27 rejects a transported piece Pc judged to be defective out of the transport route.

The defective article rejector 27 is arranged frontward, in the transport direction Tr, of the first straight section 201 in the transport loop 2. The defective article rejector 27 includes a rejection conveyor 271 arranged below the transport rail 20. The rejection conveyor 271 is arranged to be able to transport the target out of the transport route. The defective article held by the first and second transport shuttles 31 and 32 is placed on the rejection conveyor 271 below, and the rejection conveyor 271 is driven, so that the defective transported piece is rejected out of the transport route.

As will be described in detail later, when the first and second transport shuttles 31 and 32 hold a transported piece Pc, a first transport support portion 35 and a second transport support portion 37 support the bottom face of the transported piece Pc. Thus, expanding the distance between the first and second transport shuttles 31 and 32 in the transport direction Tr permits the transported piece Pc held by them to be dropped downward. In the embodiment, the defective article rejector 27 uses a rejection conveyor 271 arranged below the transport rail 20; this, however, is not meant as any limitation. It is possible to use instead a mechanism like the pusher 13 that pushes a defective transported piece out of the transport route. Also in that case, a configuration is possible where the distance between the first and second transport shuttles 31 and 32 is expanded to release their holding and then the transported piece is pushed off.

When a transported piece judged to be defective is transported to above the defective article rejector 27, the processing circuit 601 in the controller 600 controls the first and second transport shuttles 31 and 32 to place the transported piece on the rejection conveyor 271. At the same time the processing circuit 601 drives the rejection conveyor 271 to reject the defective transported piece out of the transport route.

<First and Second Shuttles 31 and 32>

Next, the first and second transport shuttles 31 and 32, which move along the transport rail 20 in the transport loop 2, will be described. The first and second transport shuttles 31 and 32 are arranged on the outer face of the transport rail 20, and are movable along the transport rail 20. The first transport shuttle 31 holds a front part of the transported piece Pc in the transport direction Tr. The second transport shuttle 32 holds a rear part of the transported piece Pc in the transport direction Tr. Thus the first and second transport shuttles 31 and 32 hold the transported piece Pc at its front and rear in the transport direction Tr. While holding the transported piece Pc, the first and second transport shuttles 31 and 32 transport it around the transport loop 2, along the transport rail 20.

In the transfer device 200, the first and second transport shuttles 31 and 32 each have a main body 30, an upper roller 33, and a lower roller 34 that are structured similarly between them. So long as the first and second transport shuttles 31 and 32 are movable along the transport rail 20, they may have differently structured main bodies 30, upper rollers 33, and lower rollers 34 respectively.

First, the features common to the first and second transport shuttles 31 and 32 will be described. In the main body 30, a magnet 242 of the transport linear motor mechanism 24 is arranged. The main body 30 is arranged outward of the transport rail 20, so as to face the transport rail 20. The magnet 242 is housed inside the main body 30, and faces a coil 241 arranged in the main rail 21 in a direction intersecting the transport direction Tr.

The main body 30 has a protrusion 301 that protrudes toward the transport rail 20.

The protrusion 301 fits in the gap 25 formed between the main rail 21 and the grooved rail 22 of the transport rail 20 (see FIG. 5). With the protrusion 301 fitted in the gap 25, the main body 30 is prevented from deviating from the transport rail 20.

The main body 30 has two upper rollers 33. The two upper rollers 33 are rotatably supported on an upper roller support 302 in the main body 30. More specifically, the upper rollers 33 are arranged so as to be rotatable about a rotation axis orthogonal to the transport direction Tr and parallel to the outer face of the transport rail 20. The two upper rollers 33 are arranged at positions away from each other in the transport direction Tr and displaced in the up-down direction. In the main body 30 according to the embodiment, they are arranged such that the front-side upper roller 33 (see FIG. 4) in the transport direction Tr takes the lower position.

The outer circumferential face of the upper roller 33 has a roller ridge 331 that protrudes outward in the radial direction toward the middle in the axial direction. The roller ridge 331 fits in the groove 221 in the grooved rail 22. The upper roller 33 rotates while staying fitted in the groove 221. Thus, as the main body 30 moves along the transport rail 20, it is prevented from deviating in the up-down direction.

The main body 30 has two lower rollers 34. The two lower rollers 34 are rotatably supported on a lower roller support 303 in the main body 30. More specifically, the lower roller 34 is arranged so as to be rotatable about a rotation axis orthogonal to the transport direction Tr and parallel to the outer face of the transport rail 20. The lower roller 34 is in the shape of a cylinder, and the outer circumferential face of the lower roller 34 makes contact with the outer face of the flat rail 23. The two lower rollers 34 are arranged at positions away from each other in the transport direction Tr and displaced in the up-down direction. In the main body 30 according to the embodiment, they are arranged such that the front-side lower roller 34 (see FIG. 4) in the transport direction Tr takes the upper position.

The main body 30 is attracted, by the magnetic force of the magnet 242 arranged inside it, onto the outer face of the transport rail 20. The transport rail 20 may include an attracting portion formed of a metal, such as iron, that attracts a magnet, or attraction may be achieved with the magnetic force between an iron core provided in a coil 241 and the magnet 242. The main body 30 may be fitted to the transport rail 20 such that the main body 30 is movable along the transport rail 20 but, by use of a hook or the like, does not easily come off the transport rail 20.

With the upper rollers 33 and the lower rollers 34 in contact with the transport rail 20, the main body 30 is arranged at a predetermined interval from the outer face of the main body 30. As the main body 30 moves along the transport rail 20, the upper rollers 33 and the lower rollers 34 rotate while in contact with the transport rail 20. Thus the main body 30 is supported at its top and bottom by the upper rollers 33 and the lower rollers 34. Consequently the main body 30 moves along the transport rail 20 while keeping a predetermined angle to the transport rail 20.

The first and second transport shuttles 31 and 32 have the main bodies 30, the upper rollers 33, and the lower rollers 34 structured similarly between them. The upper rollers 33, and also the lower rollers 34, that are arrayed in the transport direction Tr are displaced one above the other. Thus, even if the first and second transport shuttles 31 and 32 come close to each other in the transport direction Tr, the upper rollers 33, or the upper rollers 33, are less likely to interfere with each other. Thus the first and second transport shuttles 31 and 32 can be arranged close to each other, and can be moved while being close to each other.

Next, the features unique to the first transport shuttle 31 will be described. As shown in FIGS. 3 to 5, the first transport shuttle 31 has a first transport support portion 35 and a first transport engaging portion 36 that are fitted to the main body 30. The first transport support portion 35 and the first transport engaging portion 36 extend outward from the main body 30. They are screw-fastened to a plurality of screw holes Sc1 (see FIG. 4) arranged in a vertical row in the outer face of the main body 30.

The first transport support portion 35 is arranged below the first transport engaging portion 36. The first transport support portion 35 has a support mount 350 and a support plate 351. The support mount 350 is a plate-form member, and is fixed by being screw-fastened to screw holes Sc1 in the main body 30. The support plate 351 is in the shape of a flat plate orthogonal to the support mount 350. Fixing the support mount 350 to the main body 30 leaves the support plate 351 protruding outward from the main body 30. The top face of the support plate 351 is a horizontal surface.

As seen in a plan view, a corner part 352, rearward in the transport direction Tr, of an outer end part of the support plate 351 extends rearward in the transport direction Tr beyond an arm body 361, which will be described later, of the first transport support portion 35. The corner part 352 extends outward beyond a presser 363, which will be described later, of the first transport engaging portion 36. The length from the rear edge of the arm body 361 in the transport direction Tr to a rear end part of the corner part 352 in the transport direction Tr is smaller than one-half of the length of the transported piece Pc in the transport direction Tr. The length from an outer end part of the presser 363 to an outer end part of the corner part 352 is smaller that one-half of the length of the transported piece Pc in the direction orthogonal to the transport direction Tr.

Thus, on the top face of the corner part 352 rests a transport rail 20-side corner part Pc1 of the transported piece Pc at its front in the transport direction Tr. That is, the rear corner part 352, in the transport direction Tr, of the outer end of the support plate 351 supports, from below, the transport rail 20-side corner part Pc1 at the front end, in the transport direction Tr, of the bottom face of the transported piece Pc.

The first transport engaging portion 36 has a first transport upper arm 36U and a first transport lower arm 36L. The first transport upper and lower arms 36U and 36L have the same shape while being arranged at different positions in the up-down direction in the main body 30. Here, substantially the same parts of the first transport upper and lower arms 36U and 36L will be identified by the same reference signs. The following description deals with the first transport lower arm 36L as their representative.

As shown in FIGS. 3 to 5, the first transport upper arm 36U has an arm mount 360, an arm body 361, a claw 362, a presser 363, and a contact face 364. The arm mount 360 is a plate-form member, and is fixed by being screw-fastened to screw holes Sc1 in the main body 30. The arm body 361 is in the shape of a flat plate orthogonal to the arm mount 360. As seen in a plan view, the arm body 361 extends rearward in the transport direction Tr as it extends outward.

The claw 362 extends from an outer end part of the arm body 361 rearward in the transport direction Tr. The presser 363 extends from an end part of the arm body 361 at the side close to the transport rail 20 rearward in the transport direction Tr. A rear end part of the presser 363 in the transport direction Tr is located rearward of a rear end part of the claw 362 in the transport direction Tr. The contact face 364 is the rear face, in the transport direction Tr, of a part of the arm body 361 between the claw 362 and the presser 363. The contact face 364 extends rearward in the transport direction Tr as it extends outward.

Next, the features unique to the second transport shuttle 32 will be described. The second transport shuttle 32 has a second transport support portion 37 and a second transport engaging portion 38. The second transport support portion 37 has a similar structure to the first transport support portion 35; accordingly, while the correspondence between the reference signs identifying the parts of the second transport support portion 37 and the reference signs identifying the corresponding parts of the first transport support portion 35 will be clarified, no detailed description of the same parts will be repeated. Likewise, the second transport engaging portion 38 has a similar structure to the first transport engaging portion 36; accordingly, while the correspondence between the reference signs identifying the parts of the second transport engaging portion 38 and the reference signs identifying the corresponding parts of the first transport engaging portion 36 will be clarified, no detailed description of the same parts will be repeated The second transport support portion 37 is arranged below the second transport engaging portion 38. The second transport support portion 37 has a support mount 370 and a support plate 371. The support mount 370 has a similar structure to the support mount 350. The support plate 371 has a similar structure to the support plate 351. The top face of the support plate 371 is a horizontal surface.

As seen in plan view, a front corner part 372, in the transport direction Tr, of an outer end part of the support plate 371 extends frontward in the transport direction Tr beyond an arm body 381, which will be described later, of the second transport engaging portion 38. The corner part 372 extends outward beyond a presser 383, which will be described later, of the second transport engaging portion 38. The length from the front edge of the arm body 381 in the transport direction Tr to a front end part of the 372 in the transport direction Tr is smaller than one-half of the length of the transported piece Pc in the transport direction Tr. The length from an outer end part of the presser 383 to an outer end part of the corner part 372 is smaller than one-half of the length of the transported piece Pc in the direction orthogonal to the transport direction Tr.

Thus, on the top face of the corner part 372 rests a transport rail 20-side corner part Pc2 of the transported piece Pc at its rear end in the transport direction Tr. That is, the front corner part 372, in the transport direction Tr, of the outer end of the support plate 371 supports, from below, the transport rail 20-side corner part Pc2 at the rear end, in the transport direction Tr, of the bottom face of the transported piece Pc.

The second transport engaging portion 38 has a second transport upper arm 38U and a second transport lower arm 38L. The second transport upper arm 38U corresponds to the first transport upper arm 36U, and the second transport lower arm 38L corresponds to the first transport lower arm 36L.

As shown in FIGS. 3 to 5, the second transport upper and lower arms 38U and 38L each have an arm mount 380 corresponding to the arm mount 360, an arm body 381 corresponding to the arm body 361, a claw 382 corresponding to the claw 362, a presser 383 corresponding to the presser 363, and a contact face 384 corresponding to contact face 364. As seen in a plan view, the arm body 381 extends frontward in the transport direction Tr as it extends outward.

The claw 382 extends from an outer end part of the arm body 381 frontward in the transport direction Tr. The presser 383 extends from an end part of the arm body 381 at the side close to the transport rail 20 frontward in the transport direction Tr. A front end part of the presser 383 in the transport direction Tr is located frontward of a front end part of the claw 382 in the transport direction Tr. The contact face 384 is the front face, in the transport direction Tr, of a part of the arm body 381 between the claw 382 and the presser 383. The contact face 384 extends frontward in the transport direction Tr as it extends outward.

Next, a description will be given of the holding of a transported piece Pc by the first and second transport shuttles 31 and 32. The controller 600 can change the positions of the first and second transport shuttles 31 and 32 relative to each other while keeping them fitted to the transport rail 20.

First, a description will be given of the holding of a transported piece Pc by the first and second transport shuttles 31 and 32 with these arranged on a straight transport rail 20*s*. As shown in FIG. 3, the first transport shuttle 31 holds a front part of the transported piece Pc in the transport direction Tr, and the second transport shuttle 32 holds a rear part of the transported piece Pc in the transport direction Tr.

The contact faces 364 and 384 face each other in the transport direction Tr. The contact faces 364 and 384 are so inclined as to be increasingly close to each other as they extend outward.

The claw 362 of the first transport engaging portion 36 engages with a part of the front end of the face of the transported piece Pc at the side opposite from the transport rail 20. Simultaneously the presser 363 engages with a part of the front end of the face of the transported piece Pc at the side facing the transport rail 20. More specifically, the outer edge of the contact face 364 makes contact with the outer edge of the front face of the transported piece Pc in the transport direction Tr. The contact face 364, as it approaches the presser 363, is increasingly far from the front face of the transported piece Pc in the transport direction Tr. At the side of the contact face 364 close to the presser 363, a gap is formed.

Similarly, the claw 382 of the second transport engaging portion 38 engages with a part of the front end of the face of the transported piece Pc at the side opposite from the transport rail 20. Simultaneously the presser 383 engages with a part of the rear end of the face of the transported piece Pc at the side facing the transport rail 20. The contact face 384 makes contact with a part of the rear face of the transported piece Pc in the transport direction Tr. More specifically, the outer edge of the contact face 384 makes contact with the outer edge of the rear face of the transported piece Pc in the transport direction Tr. The contact face 364, as it approaches the presser 383, is increasingly far from the rear face of transported piece Pc in the transport direction Tr. At the side of the contact face 384 close to the presser 383, a gap is formed.

As shown in FIG. 4, in the first and second transport shuttles 31 and 32 fitted to the transport rail 20, the position of the first transport upper arm 36U in the up-down direction is between those of the second transport upper arm 38U and the second transport lower arm 38L. The position of the first transport lower arm 36L in the up-down direction is below that of the second transport lower arm 38L.

As shown in FIG. 4, arranging the arms of the first transport engaging portion 36 below the arms of the second transport engaging portion 38 forms, at the face of the transported piece Pc at the side opposite from the transport rail 20, a space extending from the front top to the rear bottom in the transport direction Tr. Thus, even if the claw 362 of the first transport engaging portion 36 and the claw 382 of the second transport engaging portion 38 engage at the face of the transported piece Pc at the side opposite from the transport rail 20, the straw applicator 26 can easily attach the straw Th to the face of the transported piece Pc at the side opposite from the transport rail 20.

With the first and second transport shuttles 31 and 32 holding the transported piece Pc, the transport rail 20-side corner part Pc1 of the front end, in the transport direction Tr, of the bottom face of the transported piece Pc is supported on the rear corner part 352, in the transport direction Tr, of the outer end of the support plate 351. Likewise, the transport rail 20-side corner part Pc2 of the rear end, in the transport direction Tr, of the bottom face of the transported piece Pc is supported on the front corner part 372, in the transport direction Tr, of the outer end of the support plate 371.

It is preferable that the top faces of the support plates 351 and 371 be flush with each other, with no limitation intended. They may be vertically displaced so that the transported piece Pc is tilted with respect to the transport direction Tr.

Here, the bottom face of the transported piece Pc is supported at a front and a rear corner part Pc1 and Pc2 located close to the transport rail 20. Thus, a top part of the transported piece Pc may be acted on by a force that tends to turn it over outward. Even then, owing to the claw 362 of the first transport engaging portion 36 engaging with a part of the front end of the face of the transported piece Pc at the side opposite from the transport rail 20 and the claw 382 of the second transport engaging portion 38 engaging with a part of the rear end of the face of the transported piece Pc at the side opposite from the transport rail 20, the transported piece Pc is prevented from turning over.

Moreover, a part of the front face of the transported piece Pc in the transport direction Tr makes contact with the contact face 364 and a part of the rear face of the transported piece Pc in the transport direction Tr makes contact with the contact face 384. Thus, when the first and second transport shuttles 31 and 32 start to move or stop moving, the transported piece Pc can be prevented from moving in the transport direction Tr.

As mentioned above, with the first and second transport shuttles 31 and 32 holding the transported piece Pc, downward movement of the transported piece Pc is blocked by the first transport support portion 35 (the corner part 352 of its support plate 351) and the second transport support portion 37 (the corner part 372 of its support plate 371). Thus the first and second transport engaging portions 36 and 38 only need to make contact with, that is, engage with, a side face of the transported piece Pc; the first and second transport engaging portions 36 and 38 do not need to press the transported piece Pc hard.

As described above, by use of the first and second transport shuttles 31 and 32, even with a transported piece Pc that is soft or fragile such as a carton package containing liquid, it is possible to reliably and safely hold a front and a rear part of the transported piece Pc in the transport direction Tr.

When a transported piece Pc is transported in the transport loop 2, the first and second transport shuttles 31 and 32 holding the transported piece Pc pass across the first curved section 203. A description will now be given of how the first and second transport shuttles 31 and 32 holding the transported piece Pc move along a curved section. FIG. 6 is a plan view showing the first and second transport shuttles 31 and 32 moving along a curved transport rail 20*t* while holding the transported piece Pc.

In the first transport shuttle 31, the angle of the arm body 361 with respect to the transport direction Tr is fixed. Likewise, in the second transport shuttle 32, the angle of the arm body 381 with respect to the transport direction Tr is fixed. Accordingly, when the first and second transport shuttles 31 and 32 are on a curved transport rail 20*t*, the controller 600 so controls as to make the distance between the first and second transport shuttles 31 and 32 along the curved transport rail 20*t* shorter than when they are moving along a straight section.

Through such control, the distance, in the transport direction Tr, between outer end parts of the arm bodies 361 and 381 is shortened so that the claws 362 and 382 can engage with a part of the front end and a part of the rear end of the face of the transported piece Pc at the side opposite from the transport rail 20*s*. Thus, while moving along the curved transport rail 20*t*, the first and second transport shuttles 31 and 32 can hold the transported piece Pc firmly.

Moreover, owing to the claws 362 and 382 engaging with parts of the face of the transported piece Pc at the side opposite from the curved transport rail 20*t*, the centrifugal force resulting from movement along the curved transport rail 20*t* can be counteracted by the claws 362 and 382. Thus, while the first and second transport shuttles 31 and 32 are moving along the curved transport rail 20*t*, the transported piece Pc can be prevented from flying or falling out.

<Transfer of a Transported Piece Pc>

Figure 8:
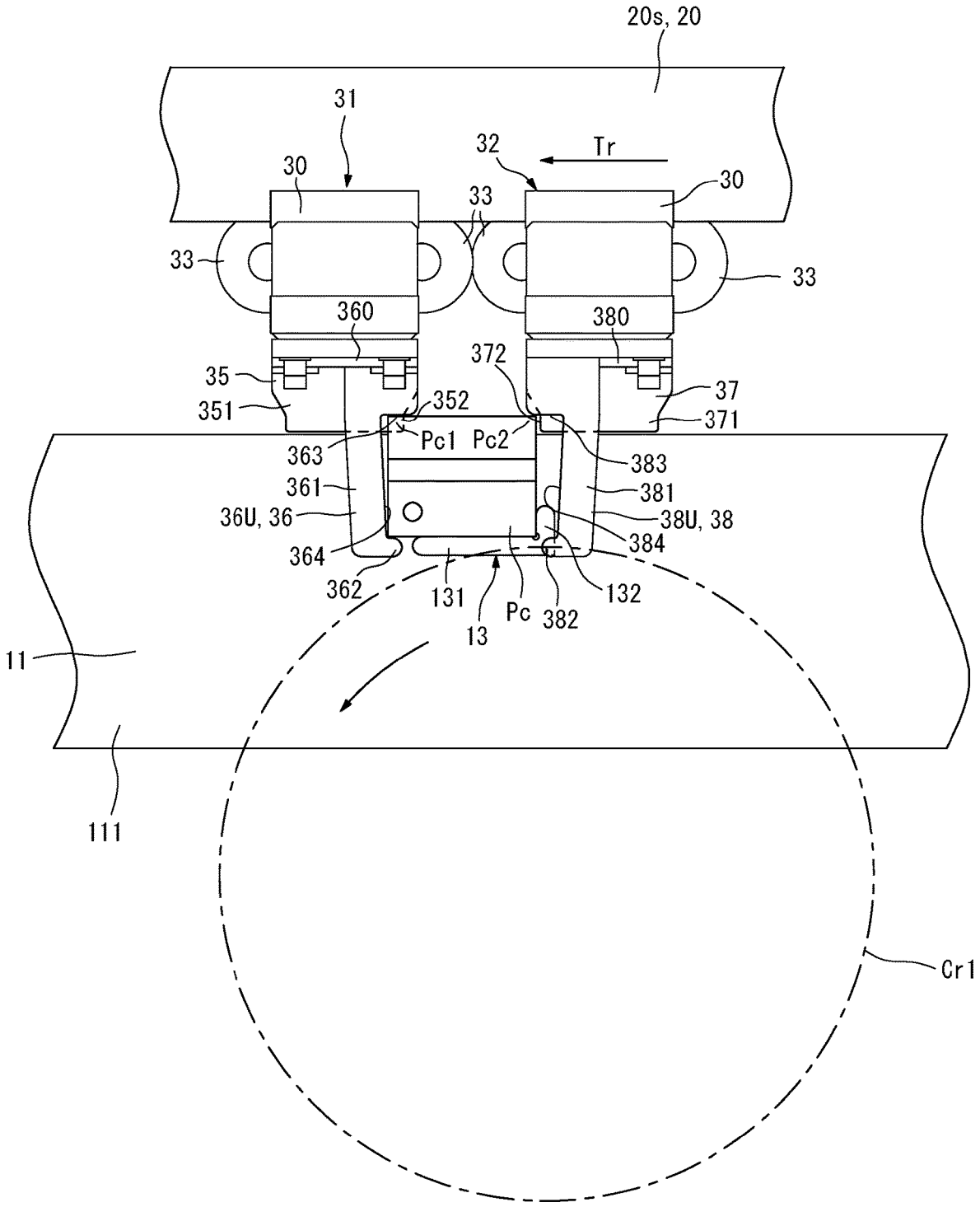
FIG. 8 is a plan view of a transported piece moved to between the first and second transport shuttles.
Figure 9:
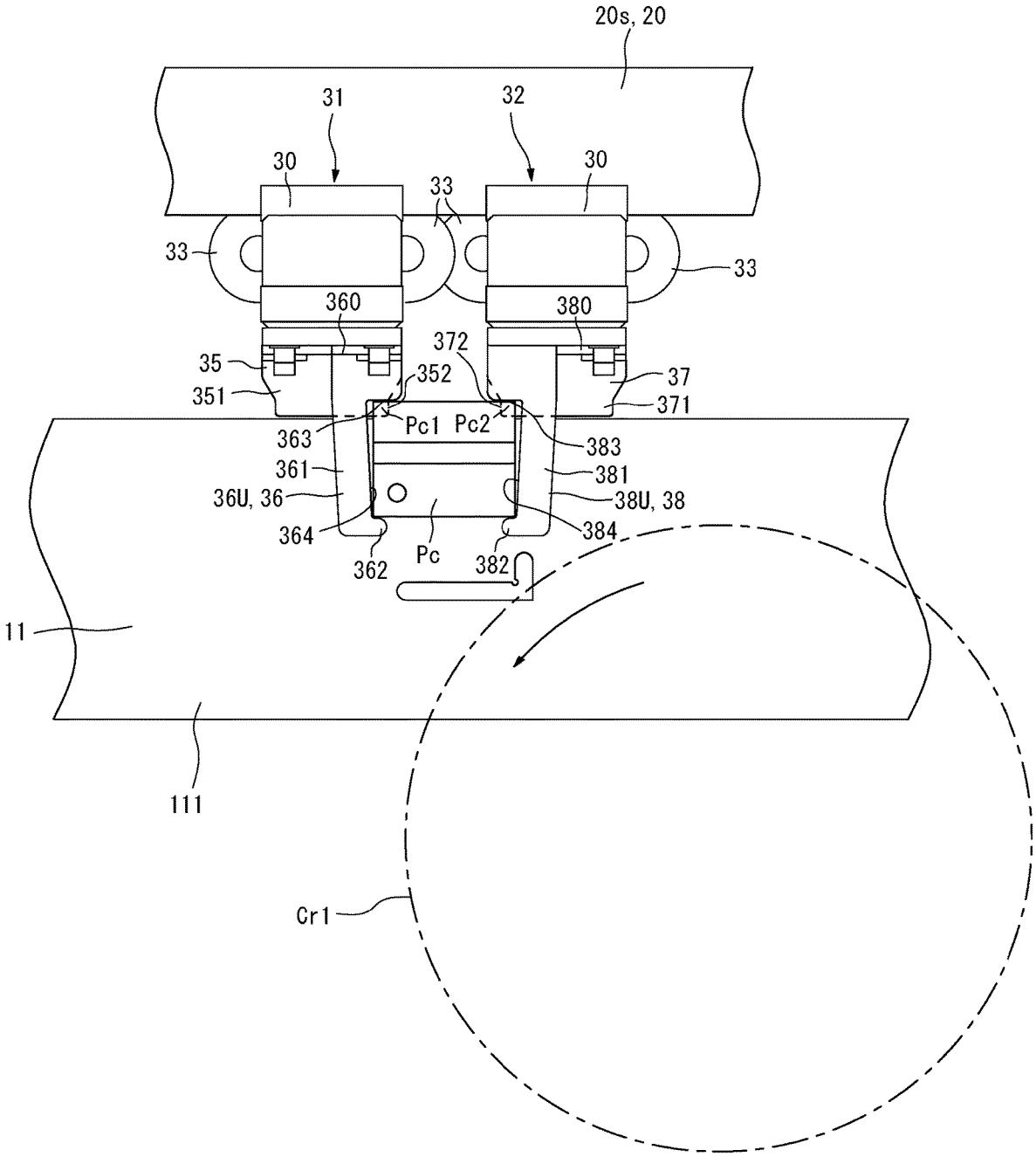
FIG. 9 is a plan view of a transported piece held by the first and second transport shuttles.

A description will now be given of the transfer of a transported piece Pc in the transfer device 200, from transport on the loading conveyor 11 to transport along the transport loop 2 while being held by the first and second transport shuttles 31 and 32. FIG. 7 is a plan view showing the operation of the pusher 13 before transfer. FIG. 8 is a plan view of a transported piece Pc transferred to between the first and second transport shuttles 31 and 32. FIG. 9 is a plan view of a transported piece Pc held by the first and second transport shuttles 31 and 32. FIGS. 8 and 9 show the loading conveyor 11 and the pusher 13 as well.

As shown in FIG. 1, a front part of the loading conveyor 11 in the transport direction Tr is located close to the first straight section 201 of the transport loop 2 to constitute the transfer conveying part 111, which extends parallel to the first straight section 201. A transported piece Pc placed and transported on the transfer conveying part 111 is pushed by the pusher 13 to move toward the transport rail 20.

Now, the pusher 13 will be described in detail. As shown in FIG. 7, the pusher 13 is L-shaped as seen in a plan view, and has a first pushing portion 131 and a second pushing portion 132. The first pushing portion 131 extends along the transport direction Tr of the transported piece Pc, that is, along the transfer conveying part 111. The second pushing portion 132 extends from rearward of the first pushing portion 131 in the transport direction Tr toward the transport rail 20.

The pusher 13 is driven by a pusher motor 133 (see FIG. 2) to make a circular motion. The pusher motor 133 is connected to the controller 600 and operates according to instructions from the controller 600. In the following description, the controller 600 controlling the pusher motor 133 is often described as the controller 600 controlling the pusher 13.

The pusher 13 moves along a circular orbit Cr1. Here, the angles of the first and second pushing portions 131 and 132 with respect to the transport direction Tr are fixed regardless of the position of the pusher 13 on the circular orbit Cr1.

As shown in FIG. 7, part of the circular orbit Cr1 lies over the transfer conveying part 111. The pusher 13 moves counter-clockwise along the circular orbit Cr1. Thus, when located over the transfer conveying part 111, the pusher 13 moves in the same direction as the transport direction Tr. While the pusher 13 is located over the transfer conveying part 111, the pusher 13 approaches the transport rail 20*s* and, once it comes closest to it, it then moves away from the transport rail 20*s*.

As the pusher 13 moves as described above, it pushes the transported piece Pc placed on the loading conveyor 11 and moving in the transport direction Tr. That is, while the pusher 13 is moving in the transport direction Tr so as to approach the transport rail 20*s*, the first pushing portion 131 pushes the face of the transported piece Pc at the side opposite from the transport rail 20 and the second pushing portion 132 pushes the rear face of the transported piece Pc in the transport direction Tr.

A configuration that permits a transported piece Pc moving on the loading conveyor 11 to be moved toward the transport rail 20*s* makes it possible to omit the second pushing portion 132 of the pusher 13. While in the embodiment the pusher 13 is taken as one example of the moving unit, any other mechanism that can move a transported piece Pc may be employed instead, such as a conveyer that has a pusher that can push the transported piece Pc and that extends in a direction intersecting the transfer conveying part 111.

The pusher 13 moves the transported piece Pc toward the transport rail 20*s* by pushing the transported piece Pc at its rear face in the transport direction Tr and at its face opposite from the transport rail 20*s*. To ensure that the second pushing portion 132 of the pusher 13 pushes the rear face of the transported piece Pc in the transport direction Tr, the controller 600 so controls that the velocity component that arises along the transport direction Tr when the pusher 13 pushes the transported piece Pc is higher than the movement speed of the transported piece Pc moving on the transfer conveying part 111.

As mentioned above, transported pieces Pc are transported one by one, with a predetermined interval between one another, each by a pair of nip rollers 12. The controller 600 controls the pair of nip rollers 12 and the pusher 13 synchronously. More specifically, it drives the pusher 13 with such a timing that it can make contact with the transported piece Pc fed out by the pair of nip rollers 12.

At that time the controller 600 controls the first and second transport shuttles 31 and 32 so that the transported piece Pc pushed by the pusher 13 will be placed between the first and second transport engaging portions 36 and 38.

For example, as shown in FIG. 7, the face, opposite from the transport rail 20*s*, of the transported piece Pc transported on the transfer conveying part 111 is brought into contact with the first pushing portion 131 of the pusher 13, and the rear face of the transported piece Pc in the transport direction Tr is brought into contact with the second pushing portion 132 of the pusher 13. The linear driver 243 of the transport linear motor mechanism 24 is driven synchronously by the controller 600.

The controller 600 makes the first and second transport shuttles 31 and 32 move at a speed synchronous with the speed of the pusher 13 in the transport direction Tr. When the pusher 13 moves the transported piece Pc, the first and second transport shuttles 31 and 32 move at no or substantially no speed relative to the transported piece Pc in the transport direction Tr. Meanwhile, the controller 600 moves the first and second transport shuttles 31 and 32 in the transport direction Tr while keeping the distance between the claws 362 and 382 longer than the length of the transported piece in the transport direction Tr.

As the pusher 13 moves along the circular orbit Cr1, the transported piece Pc moves in the direction orthogonal to the transport direction Tr relative to the first and second transport shuttles 31 and 32.

As the pusher 13 moves further, when it comes closest to the transport rail 20*s*, as shown in FIG. 8, a front part of the face of the transported piece Pc at the side close to the transport rail 20*s* makes contact with the presser 363. Thus the transported piece Pc is positioned in the direction orthogonal to the transport direction Tr relative to the first transport shuttle 31. At this time the contact face 364 makes contact with a part of the front face of the transported piece Pc in the transport direction Tr, and a part of the front end of the face of the transported piece Pc at the side opposite from the transport rail 20*s* engages with the claw 362.

Moreover, the transport rail 20*s*-side corner part Pc1 of the front end, in the transport direction Tr, of the bottom face of the transported piece Pc is supported on the top face of the rear corner part 352, in the transport direction Tr, of the support plate 351 of the first transport support portion 35. Thus the transported piece Pc is held at its front side in the transport direction Tr by the first transport shuttle 31.

As shown in FIG. 5, with the first transport shuttle 31 located in the first straight section 201, the top face of the corner part 352 of the support plate 351 of the first transport support portion 35 is arranged to be flush with the top surface of the loading conveyor 11. With this configuration, the corner part Pc1 of the transported piece Pc pushed by the pusher 13 can move smoothly from the top surface of the loading conveyor 11 to the top face of the rear corner part 352, in the transport direction Tr, of the outer end of the support plate 351.

Here, what is at least required is that the corner part Pc1 of the transported piece Pc can move smoothly from the top surface of the loading conveyor 11 to the top face of the rear corner part 352, in the transport direction Tr, of the outer end of the support plate 351. For example, the top face of the corner part 352 of the support plate 351 of the first transport support portion 35 may be lower than the top surface of the loading conveyor 11 to such a degree that the transported piece Pc can move without loosing orientation.

As shown in FIG. 8, when the front of the transported piece Pc in the transport direction Tr is held by the first transport shuttle 31, the second transport support portion 37 and the second transport engaging portion 38 of the second transport shuttle 32 are located rearward of the rear end of the transported piece Pc in the transport direction Tr. With the second transport shuttle 32 so located, the transported piece Pc can move smoothly to between the first and second transport engaging portions 36 and 38.

After that, the controller 600 accelerates the second transport shuttle 32. A rear part of the face of the transported piece Pc at the side close to the transport rail 20*s* makes contact with the presser 383. Thus the transported piece Pc is positioned in the direction orthogonal to the transport direction Tr relative to the second transport shuttle 32. At this time the contact face 384 makes contact with a part of the rear face of the transported piece Pc in the transport direction Tr, and a part of the rear end, in the transport direction Tr, of the face of the transported piece Pc at the side opposite from the transport rail 20*s* engages with the claw 382.

Moreover, the transport rail 20*s*-side corner part Pc2 of the rear end, in the transport direction Tr, of the bottom face of the transported piece Pc is supported on the top face of the corner part 372.

When the second transport shuttle 32 is located in the first straight section 201, the top face of the corner part 372 of the support plate 371 of the second transport support portion 37 is arranged to be flush with the top surface of the loading conveyor 11. With this configuration, the top face of the front corner part 372 of the support plate 371 in the transport direction Tr can move smoothly to the corner part Pc2 of the bottom face of the transported piece Pc. Here, what is at least required is that the corner part Pc2 of the transported piece Pc can move smoothly from the top surface of the loading conveyor 11 to the top face of the front corner part 372, in the transport direction Tr, of the outer end of the support plate 371. For example, the top face of the corner part 372 of the support plate 371 of the second transport support portion 37 may be lower than the top surface of the loading conveyor 11 to such a degree that the transported piece Pc can move without losing orientation.

In the manner described above, the transported piece Pc is held at its rear in the transport direction Tr by the second transport shuttle 32. Thus the transported piece Pc is held, with respect to the transport direction Tr, at its front by the first transport shuttle 31 and at its rear by the second transport shuttle 32.

As shown in FIG. 9, the first and second transport shuttles 31 and 32 holding the transported piece Pc move along the transport rail 20*s* in the first straight section 201 of the transport loop 2. On the other hand, the pusher 13 moves along the circular orbit Cr1. Thus, as the first and second transport shuttles 31 and 32 move, the pusher 13 moves away from the transport rail 20*s*, that is, away from the transported piece Pc.

The controller 600 makes the movement speed of the first and second transport shuttles 31 and 32 holding the transported piece Pc higher than the movement speed of the pusher 13 in the transport direction Tr. This prevents the transported piece Pc held by the first and second transport shuttles 31 and 32 from being pressed by the pusher 13 more than necessary. This helps prevent inconvenience such as deformation, breakage, and the like of the transported piece Pc.

The first pushing portion 131 of the pusher 13 is so shaped and arranged as not to interfere with any of the first transport upper and lower arms 36U and 36L of the first transport engaging portion 36 and the second transport upper and lower arms 38U and 38L of the second transport engaging portion 38. The second pushing portion 132 of the pusher 13 is so shaped and arranged as not to interfere with either of the second transport upper and lower arms 38U and 38L of the second transport engaging portion 38.

In the manner described above, in the transfer device 200 according to the embodiment, a transported piece Pc carried in by the loading conveyor 11 can be transferred to transport by the first and second transport shuttles 31 and 32 holding the transported piece at its front and rear in the transport direction Tr.

The transfer conveying part 111 is formed to extend up to midway along the first straight section 201 of the transport loop 2. Accordingly, when the first and second transport shuttles 31 and 32 move to frontward of an end part of the transfer conveying part 111 in the transport direction Tr, the bottom face of the transported piece Pc held by them moves away from the top surface of the loading conveyor 11 and is held on the corner part 352 of the first transport support portion 35 and the corner part 372 of the second transport support portion 37.

The transported piece Pc held by the first and second transport shuttles 31 and 32 is restrained from moving either frontward or rearward along the transport direction Tr or in the direction orthogonal to the transport direction Tr. Thus, a process with respect to the transported piece Pc, here a process of attaching a straw by the straw applicator 26, can be performed while the transported piece Pc is being transported. This helps shorten the time required from production to shipment of the transported piece Pc.

Moreover, since the first and second transport shuttles 31 and 32 transport the transported piece Pc while holding it in a movement-restrained state, this permits faster transport compared with transport on a conveyor or the like. Furthermore, owing to the claws 362 and 382 engaging with outer parts, it is possible to prevent tumbling and movement under a centrifugal force during transport along a curved transport rail 20*t*. This helps reduce the radius of curvature of a curved section compared with a configuration that achieves transport with a belt conveyor alone. It is thus possible to obtain more freedom in the layout of the transport and cartoning apparatus 100, and to reduce the layout compared with a configuration that achieves transport with a belt conveyor alone.

<Delivery Device 300>

Next, the delivery device 300 will be described. As shown in FIG. 1, in the transport and cartoning apparatus 100, the delivery device 300 is arranged in the stage succeeding the transfer device 200. The delivery device 300 shares part of the transport loop 2 (here, the second straight section 202) and the first and second transport shuttles 31 and 32 with the transfer device 200.

In the delivery device 300, a transported piece Pc is passed over (delivered) from the first and second transport shuttles 31 and 32, which move in the transport loop 2, to a first delivery shuttle 51 and a second delivery shuttle 52, which move in a delivery loop 4. The transported piece Pc is passed over to the first and second delivery shuttles 51 and 52 moves along the delivery loop 4 to be transported to the next processing section, specifically, here, the re-holding device 400.

As shown in FIG. 1, the delivery device 300 includes the transport loop 2, the first and second transport shuttles 31 and 32, the delivery loop 4, and the first and second delivery shuttles 51 and 52. The transport device 300 too is controlled by the controller 600. The delivery device 300 will now be described in detail with reference to the relevant diagrams. For its parts shared with the transfer device 200, namely the transport loop 2 and the first and second transport shuttles 31 and 32, no detailed description will be repeated.

Figure 10:
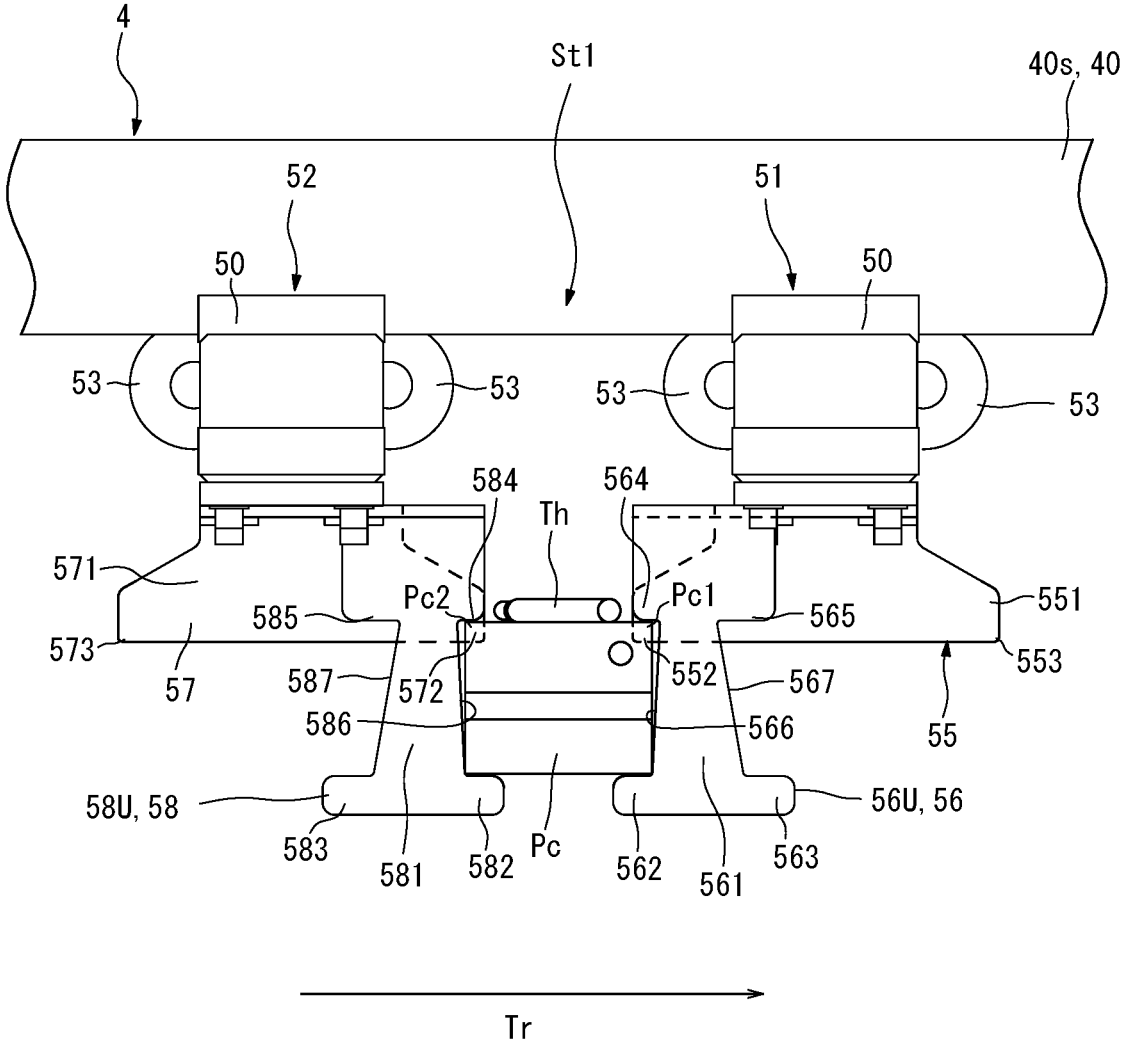
FIG. 10 is a plan view of a first and a second delivery shuttle moving along a straight delivery rail while holding a transported piece.
Figure 11:
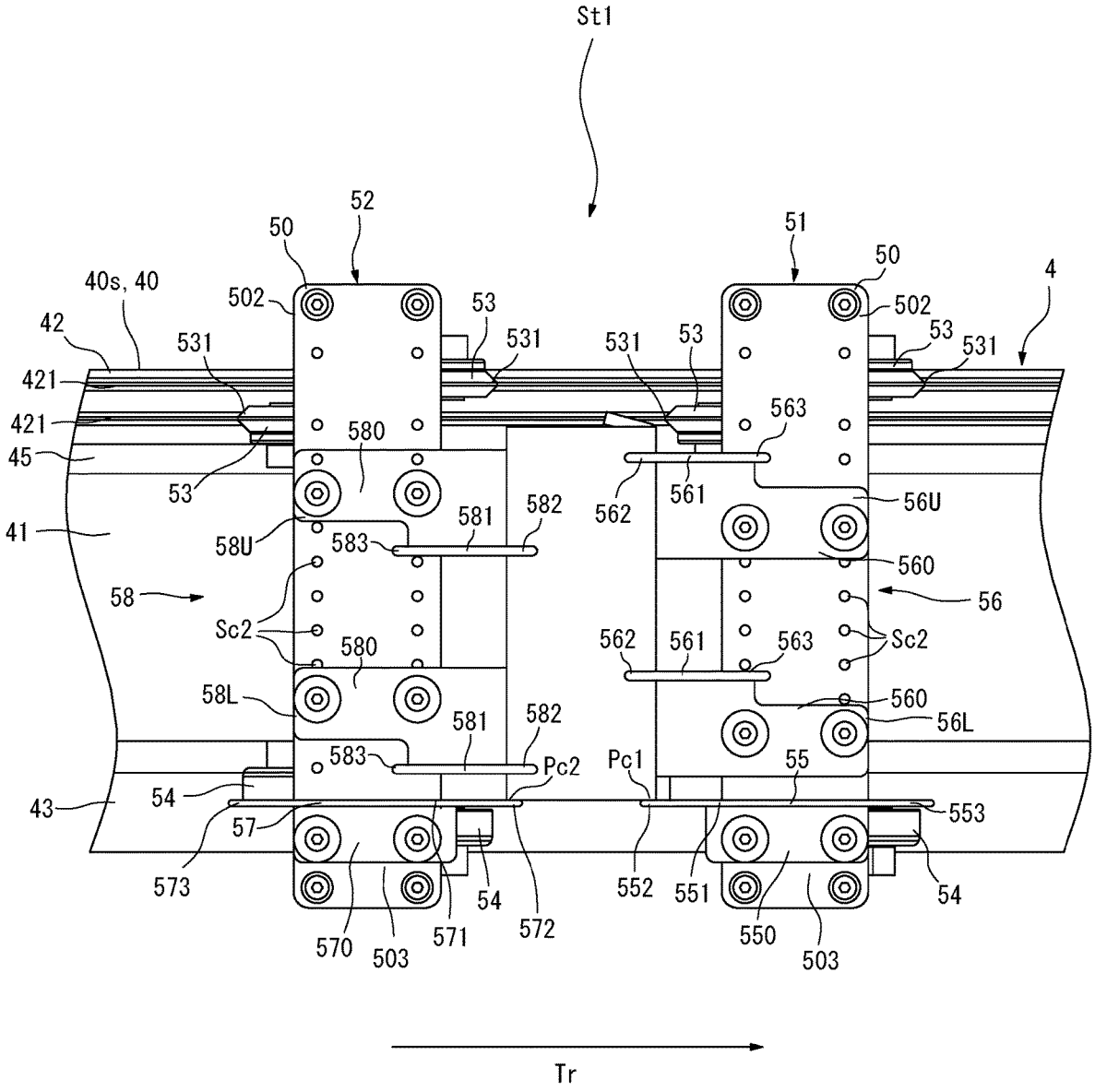
FIG. 11 is a diagram showing the first and second delivery shuttles shown in FIG. 10 as seen from outward.
Figure 12:
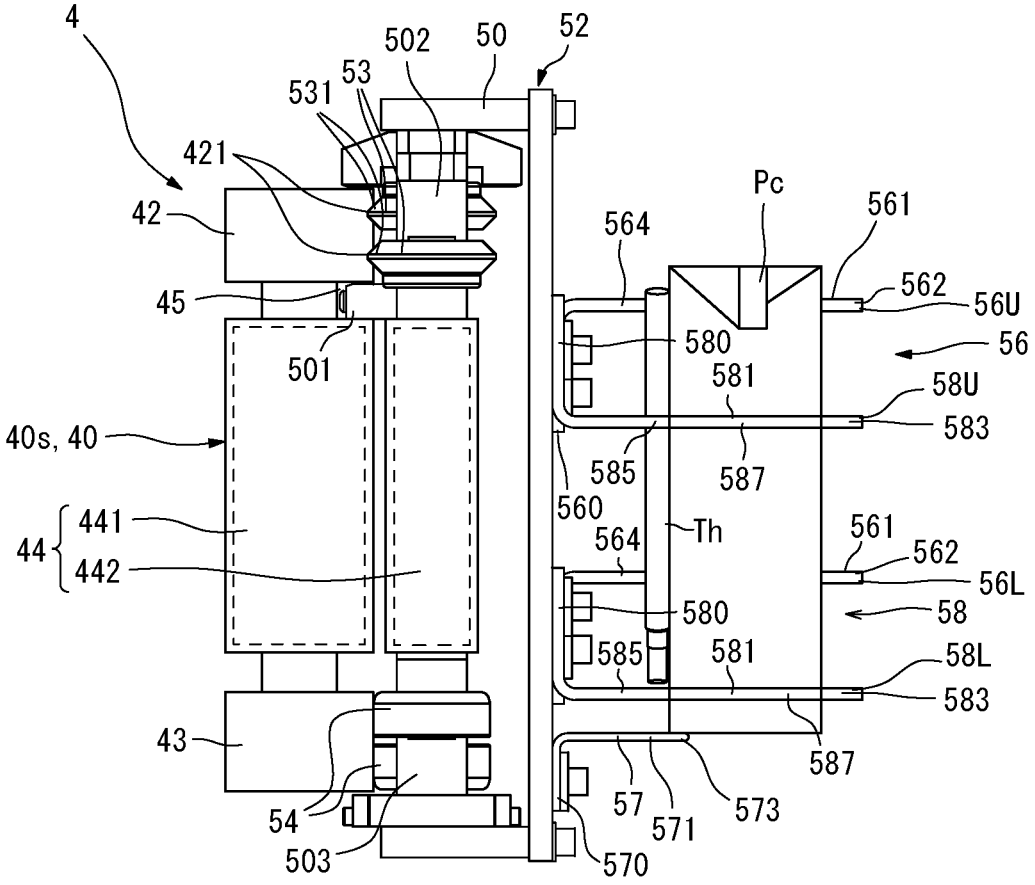
FIG. 12 is a diagram showing the first and second delivery shuttles as seen from rearward in the transport direction.
Figure 13:
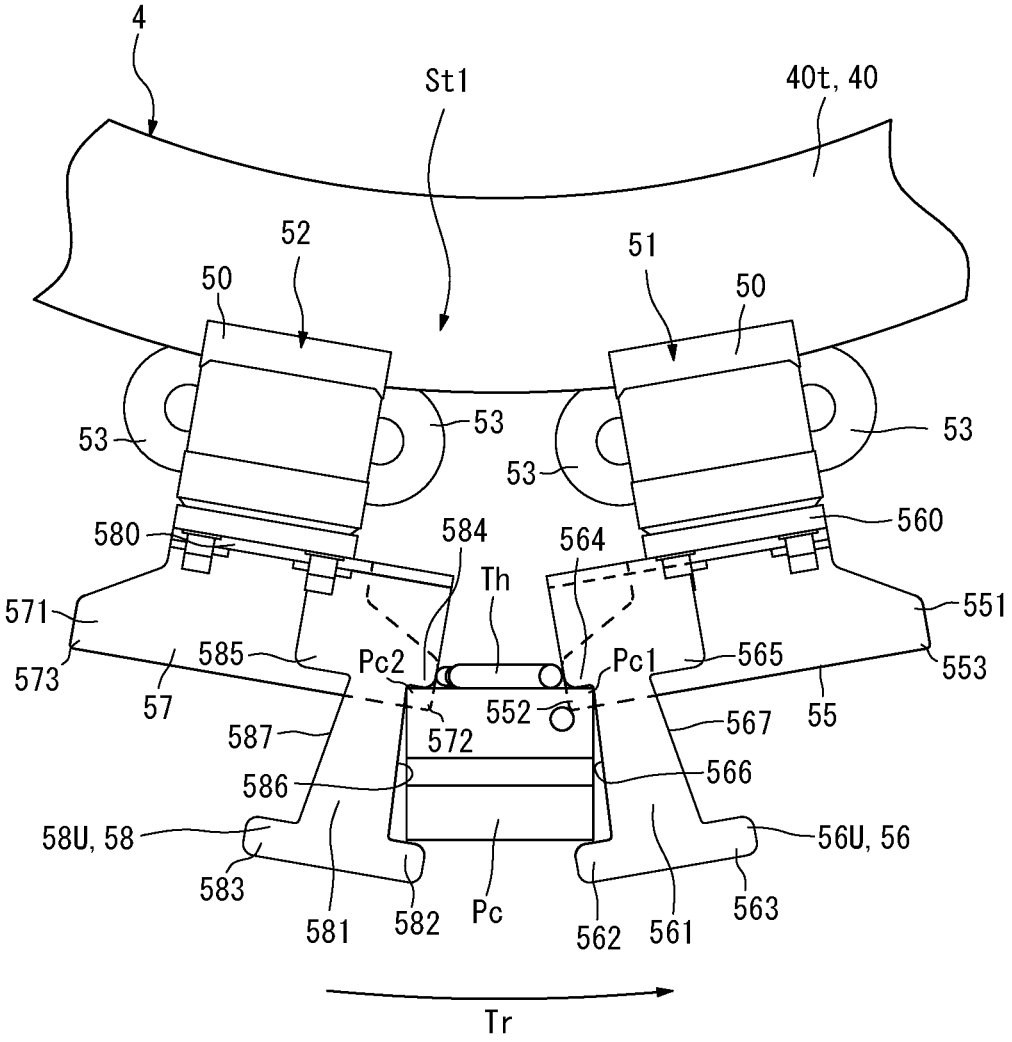
FIG. 13 is a plan view of the first and second delivery shuttles moving along a straight delivery rail while holding a transported piece.

FIG. 10 is a plan view of the first and second delivery shuttles 51 and 52 moving along a straight delivery rail 40*s* while holding the transported piece Pc. FIG. 11 is a diagram showing the first and second delivery shuttles 51 and 52 shown in FIG. 10 as seen from outward. FIG. 12 is a diagram showing the first and second delivery shuttles 51 and 52 as seen from rearward in the transport direction Tr. FIG. 13 is a plan view of the first and second delivery shuttles 51 and 52 moving along a straight delivery rail 40*s* while holding the transported piece Pc.

<Delivery Loop 4>

Figure 21:
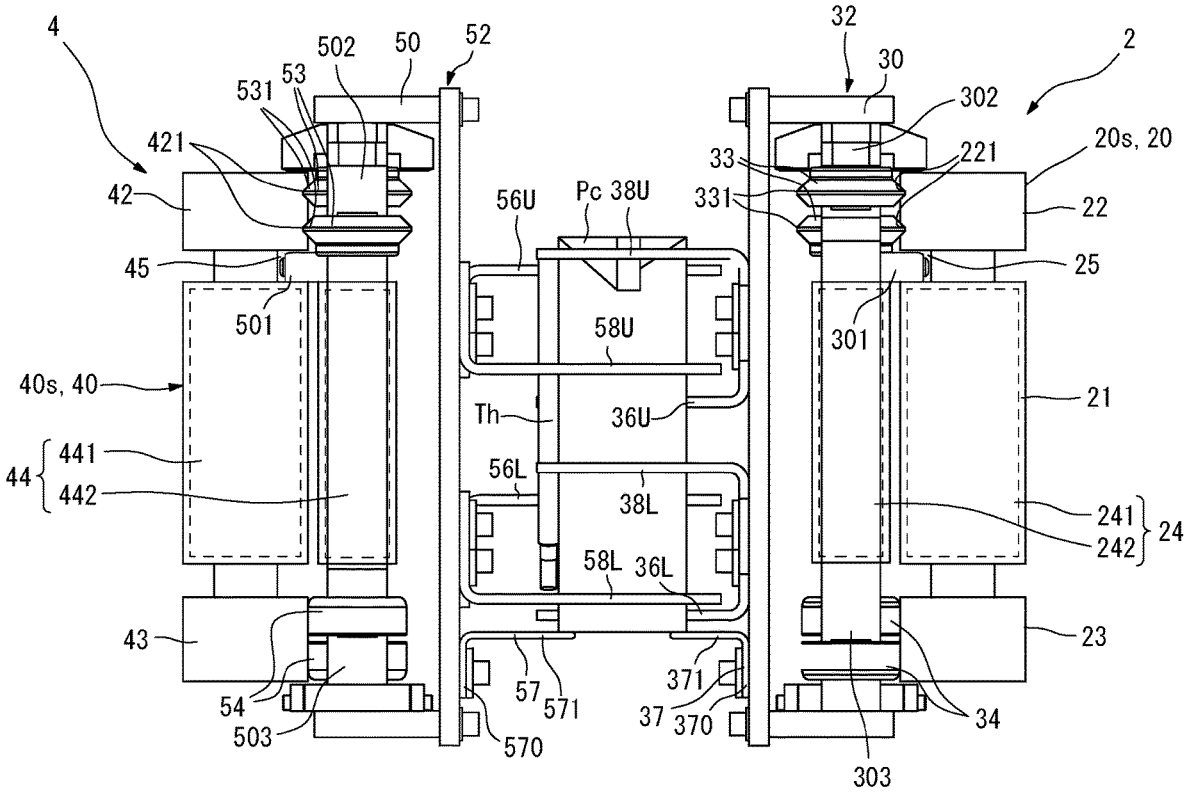
FIG. 21 is a diagram showing the first and second transport shuttles and the first and second delivery shuttles as seen from rearward in the transport direction.

The delivery loop 4 includes a delivery rail 40 and a delivery linear motor mechanism 44 (see FIGS. 12 and 21). The delivery loop 4 has its opposite ends coupled together to be formed in the shape of a loop. The delivery loop 4 includes a first straight section 401 and a second straight section 402 each formed with a straight delivery rail 40*s*, and a first curved section 403 and a second curved section 404 each formed with a curved delivery rail 40*t* (see FIG. 1). A straight delivery rail 40*s* and a curved delivery rail 40*t* have the same structure except whether they are curved or not. In the following description, a delivery rail is referred to simply as a delivery rails 40 unless distinction is necessary, in which case it is identified accordingly.

<Delivery Rail 40>

As shown in FIG. 12, the delivery rail 40 has a main rail 41, a grooved rail 42, and a flat rail 43. The delivery rail 40 has substantially the same structure as the transport rail 20; accordingly, while correspondence between the parts of the delivery rail 40 and the parts of the transport rail 20 will be clarified, no detailed description will be repeated. The main rail 41 of the delivery rail 40 corresponds to the main rail 21 of the transport rail 20. The grooved rail 42 of the delivery rail 40 corresponds to the grooved rail 22 of the transport rail 20. A groove 421 in the grooved rail 42 corresponds to the groove 221 in the grooved rail 22. A gap 45 in the delivery rail 40 corresponds to the gap 25 in the transport rail 20.

The delivery loop 4 is formed in the shape of a loop as a result of the first straight section 401, the first curved section 403, the second straight section 402, and the second curved section 404 coupled one to the next in the order named.

As shown in FIG. 1, the first and second delivery shuttles 51 and 52 move counter-clockwise along the delivery rail 40 as seen in a plan view. As shown in FIG. 1, in the delivery loop 4, a front part of the first straight section 401 in the transport direction Tr and a rear part of the second straight section 202 of the transport loop 2 in the transport direction Tr are located close to, and parallel to, each other.

Figure 24:
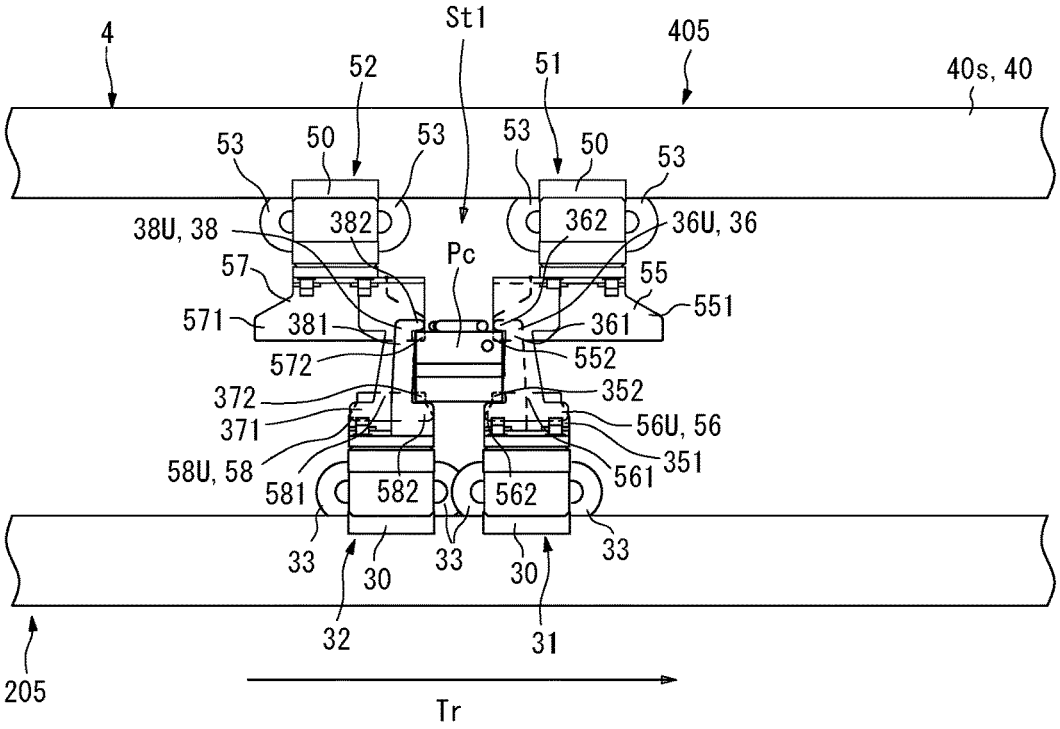
FIG. 24 is a plan view of the first and second delivery shuttles holding a transported piece held by the first and second transport shuttles.

As shown in FIG. 24, which will be referred to later, the outer face of the delivery rail 40*s* in the first straight section 401 of the delivery loop 4 and the outer face of the transport rail 20*s* in the second straight section 202 of the transport loop 2 are arranged to face each other. A part of the first straight section 201 of the transport loop 2 that faces the first straight section 401 of the delivery loop 4 is a delivery straight part 205.

A part of the first straight section 401 of the delivery loop 4 that faces the first straight section 201 of the transport loop 2 is a delivery straight part 405. As shown in FIG. 24, the delivery straight part 205 and the delivery straight part 405 are arranged at such a distance from each other that the transported piece Pc held by the first and second transport shuttles 31 and 32 can be held also by the first and second delivery shuttles 51 and 52.

A rear part of the first straight section 401 of the delivery loop 4 is a packing straight part 406 (see FIG. 1) where transported pieces are packed in a packing box Bx. A part of the first straight section 401 between the packing straight part 406 and the delivery straight part 405 is a standby part where the first and second delivery shuttles 51 and 52 stay on standby.

<Delivery Linear Motor Mechanism 44>

In the delivery loop 4, a plurality of first delivery shuttles 51 and the same number of second delivery shuttles 52 as the first delivery shuttles 51 are arranged alternately in the delivery direction Tr. The delivery linear motor mechanism 44 (see FIGS. 12 and 21) can drive the first and second delivery shuttles 51 and 52 independently.

The delivery linear motor mechanism 44 has a similar construction to the transport linear motor mechanism 24. Specifically, the delivery linear motor mechanism 44 has coils 441, magnets 442, and a linear driver 443 corresponding to the coils 241, the magnets 242, and the linear driver 243 in the transport linear motor mechanism 24. The linear driver 443 feeds the coils 441 with adequate currents according to instructions from the controller 600.

<First and Second Delivery Shuttles 51 and 52>

Next, the first and second delivery shuttles 51 and 52, which move along the delivery rail 40 in the delivery loop 4, will be described. The first and second delivery shuttles 51 and 52 are arranged on the outer face of the delivery rail 40, and are movable along the delivery rail 40.

In the delivery device 300, the first and second delivery shuttles 51 and 52 each have a main body 50, an upper roller 53, and a lower roller 54 that are structured similarly between them. So long as the first and second delivery shuttles 51 and 52 are movable along the transport rail 20, they may have differently structured main bodies, upper rollers, and lower rollers respectively.

First, the features common to the first and second delivery shuttles 51 and 52 will be described. The main body 50 corresponds to the main body 30 of the first and second transport shuttles 31 and 32, and has the same structure; accordingly, for the main body 50 no detailed description will be repeated. The main body 50 has a protrusion 501, an upper roller support 502, and a lower roller support 503 corresponding respectively to the protrusion 301, the upper roller support 302, and the lower roller support 303 of the main body 30.

In the main body 50, a magnet 442 of the delivery linear motor mechanism 44 is arranged. The magnet 442 is arranged inside the main body 50, and faces a coil 441 arranged in the main rail 41 in a direction intersecting the transport direction Tr.

In the main body 50 are also arranged two upper rollers 53, and two lower rollers 54, each pair at positions away from each other in the transport direction Tr and displaced in the up-down direction. In the embodiment, the two upper rollers 53 are arranged such that the front-side upper roller 53 (see FIG. 11) in the transport direction Tr takes the upper position, and the two lower rollers 54 are arranged such that the front-side lower roller 54 (see FIG. 11) in the transport direction Tr takes the lower position.

Next, the features unique to the first delivery shuttle 51 will be described. The first delivery shuttle 51 has a first delivery support portion 55 and a first delivery engaging portion 56 that are fitted to the main body 50. The first delivery support portion 55 and the first delivery engaging portion 56 extend outward from the main body 50. They are screw-fastened to a plurality of screw holes Sc2 (see FIG. 11) arranged in a vertical row in the outer face of the main body 50.

The first delivery support portion 55 is arranged below the first delivery engaging portion 56. The first delivery support portion 55 has a support mount 550 and a support plate 551. The support mount 550 is fixed by being screw-fastened to screw holes Sc2 in the main body 50. The support plate 551 is in the shape of a flat plate orthogonal to the support mount 550. Fixing the support mount 550 to the main body 50 leaves the support plate 551 protruding outward from the main body 50. The top face of the support plate 551 is a horizontal surface.

The support plate 551 has a first rear support portion 552 and a first front support portion 553. As seen in a plan view, the first rear support portion 552 extends from an arm body 561, which will be described later, of the first delivery engaging portion 56 rearward in the transport direction Tr. The length, from the arm body 561, of the first rear support portion 552 to a rear end part of it in the transport direction Tr is smaller than the length of the transported piece Pc in the transport direction Tr.

As seen in a plan view, the first front support portion 553 extends from the arm body 561 frontward in the transport direction Tr. The length, from the arm body 561, of the first front support portion 553 to a front end part of it in the transport direction Tr is larger than the length of the transported piece Pc in the transport direction Tr.

The first delivery engaging portion 56 has a first delivery upper arm 56U and a first delivery lower arm 56L. The first delivery upper and lower arms 56U and 56L have the same shape while being arranged at different positions in the up-down direction in the main body 50. Here, substantially the same parts of the first delivery upper and lower arms 56U and 56L will be identified by the same reference signs. The following description deals with the first delivery upper arm 56U as their representative.

As shown in FIGS. 10 to 12, the first delivery upper arm 56U has an arm mount 560, an arm body 561, a rear claw 562, a front claw 563, a rear stopper 564, a front stopper 565, a rear contact face 566, and a front contact face 567. The arm mount 560 is a plate-form member, and is fixed by being screw-fastened to screw holes Sc2 in the main body 50. The arm body 561 is in the shape of a flat plate orthogonal to the arm mount 560. As seen in a plan view, the arm body 561 is arranged displaced rearward from the main body 50 in the transport direction Tr.

The rear claw 562 extends from an outer end part of the arm body 561 rearward in the transport direction Tr. The front claw 563 extends from an outer end part of the arm body 561 frontward in the transport direction Tr. The length of the front claw 563 in the transport direction Tr is larger than the length of the rear claw 562 in the transport direction Tr.

The rear stopper 564 extends from an end part of the arm body 561 at the side close to the delivery rail 40 rearward in the transport direction Tr. The front stopper 565 extends from an end part of the arm body 561 at the side close to the delivery rail 40 frontward in the transport direction Tr. The length of the front stopper 565 in the transport direction Tr is larger than the length of the rear stopper 564 in the transport direction Tr.

The rear contact face 566 is the rear face, in the transport direction Tr, of a part of the arm body 561 between the rear claw 562 and the rear stopper 564. The rear contact face 566 extends rearward in the transport direction Tr as it extends outward. The front contact face 567 is a front face, in the transport direction Tr, of a part of the arm body 561 between the front claw 563 and the front stopper 565. The front contact face 567 extends frontward in the transport direction Tr as it extends outward. As seen in a plan view, the angle of the rear contact face 566 to the transport direction Tr is larger than the angle of the front contact face 567 to the transport direction Tr. That is, the rear contact face 566 extends at an angle closer to orthogonal to the transport direction Tr than the front contact face 567 does.

Next, the features unique to the second delivery shuttle 52 will be described. The second delivery shuttle 52 has a second delivery support portion 57 and a second delivery engaging portion 58 that are fitted to the main body 50. The second delivery support portion 57 and the second delivery engaging portion 58 extend outward from the main body 50. That is, they are screw-fastened to a plurality of screw holes Sc2 (see FIG. 11) arranged in a vertical row in the outer face of the main body 50.

The second delivery support portion 57 is arranged below the second delivery engaging portion 58. The second delivery support portion 57 has a support mount 570 and a support plate 571. The support mount 570 is fixed by being screw-fastened to screw holes Sc2 in the main body 50. The support plate 571 is in the shape of a flat plate orthogonal to the support mount 570. Fixing the support mount 570 to the main body 50 leaves the support plate 571 protruding outward from the main body 50. The top face of the support plate 571 is a horizontal surface.

The support plate 571 has a second front support portion 572 and a second rear support portion 573. As seen in a plan view, the second front support portion 572 extends from an arm body 581, which will be described later, of the second delivery engaging portion 58 frontward in the transport direction Tr. The length, from the arm body 581, of the second front support portion 572 to a front end part of it in the transport direction Tr is smaller than the length of the transported piece Pc in the transport direction Tr.

As seen in a plan view, the second rear support portion 573 extends from the arm body 581 rearward in the transport direction Tr. The length, from the arm body 581, of the second rear support portion 573 to a rear end part of it in the transport direction Tr is larger than the length of the transported piece Pc in the transport direction Tr.

The second delivery engaging portion 58 has a second delivery upper arm 58U and a second delivery lower arm 58L. The second delivery upper and lower arms 58U and 58L have the same shape while being arranged at different positions in the up-down direction in the main body 50. Here, substantially the same parts of the second delivery upper and lower arms 58U and 58L will be identified by the same reference signs. The following description deals with the first delivery upper arm 58U as their representative.

As shown in FIGS. 10 to 12, the second delivery upper arm 58U has an arm mount 580, an arm body 581, a front claw 582, a rear claw 583, a front stopper 584, a rear stopper 585, a front contact face 586, and a rear contact face 587. The arm mount 580 is a plate-form member, and is fixed by being screw-fastened to screw holes Sc2 in the main body 50. The arm body 581 is in the shape of a flat plate orthogonal to the arm mount 580. As seen in a plan view, the arm body 581 is arranged displaced frontward from the main body 50 in the transport direction Tr.

The front claw 582 extends from an outer end part of the arm body 581 frontward in the transport direction Tr. The rear claw 583 extends from an outer end part of the arm body 581 rearward in the transport direction Tr. The length of the rear claw 583 in the transport direction Tr is larger than the length of the front claw 582 in the transport direction Tr.

The front stopper 584 extends from an end part of the arm body 581 at the side close to the delivery rail 40 frontward in the transport direction Tr. The rear stopper 585 extends from an end part of the arm body 581 at the side close to the delivery rail 40 rearward in the transport direction Tr. The length of the rear stopper 585 in the transport direction Tr is larger than the length of the front stopper 584 in the transport direction Tr.

The front contact face 586 is the front face, in the transport direction Tr, of a part of the arm body 581 between the front claw 582 and the front stopper 584. The front contact face 586 extends frontward in the transport direction Tr as it extends outward. The rear contact face 587 is the rear face, in the transport direction Tr, of a part of the arm body 581 between the rear claw 583 and the rear stopper 585. The rear contact face 587 extends rearward in the transport direction Tr as it extends outward. As seen in a plan view, the angle of the front contact face 586 to the transport direction Tr is larger than the angle of the rear contact face 587 to the transport direction Tr. That is, the front contact face 586 extends at an angle closer to orthogonal to the transport direction Tr than the rear contact face 587 does.

<First Holding State St1>

Next, the holding of a transported piece Pc by the first and second delivery shuttles 51 and 52 will be described. First, a description will be given of the holding of a transported piece Pc by the first and second delivery shuttles 51 and 52 arranged on a straight delivery rail 40*s*. As shown in FIGS. 10 and 11, the first delivery shuttle 51 holds a front part of the transported piece Pc in the transport direction Tr and the second delivery shuttle 52 holds a rear part of the transported piece Pc in the transport direction Tr.

The controller 600 can change the positions of the first and second transport shuttles 31 and 32 relative to each other while keeping them fitted to the transport rail 40.

The rear claw 562 of the first delivery engaging portion 56 engages with a part of the front end of the face of the transported piece at the side opposite from the delivery rail 40. Likewise, the rear stopper 564 engages with a part of the front end of the face of the transported piece Pc at the side facing the transport rail 40. An outer end part of the rear contact face 566 makes contact with an outer end part of the front face of the transported piece Pc in the transport direction Tr. At the side of the rear contact face 566 close to the rear stopper 564, a gap is formed.

Similarly, the front claw 582 of the second delivery engaging portion 58 engages with a part of the rear end of the face of the transported piece Pc at the side opposite from the delivery rail 40. Likewise, the front stopper 584 engages with a part of the rear end of the face of the transported piece Pc at the side facing the delivery rail 40. An outer end part of the front contact face 586 makes contact with an outer end part of the rear face of the transported piece Pc in the transport direction Tr. At the side of the front contact face 586 close to the front stopper 584, a gap is formed.

With the first and second delivery shuttles 51 and 52 holding the transported piece Pc, a transport rail 40-side corner part Pc1 of the front end, in the transport direction Tr, of the bottom face of the transported piece Pc is supported on the first rear support portion 552 of the support plate 551. Moreover, a transport rail 40-side corner part Pc2 of the rear end, in the transport direction Tr, of the bottom face of the transported piece Pc is supported on the second front support portion 572 of the support plate 571.

As shown in FIG. 13, the first and second delivery shuttles 51 and 52 in a first holding state St1 holding the transported piece Pc can move along a curved delivery rail 40*t*. The controller 600 so controls as to make the distance between the first and second delivery shuttles 51 and 52 along the delivery rail 40*t* when they are on the curved delivery rail 40*t* shorter than that when they are on a straight delivery rail 40*s*.

Through such control, the distance between outer end parts of the arm bodies 561 and 581 in the transport direction Tr is shortened so that the rear and front claws 562 and 568 can engage respectively with a part of the front end and a part of the rear end of the face of the transported piece Pc at the side opposite from the delivery rail 40*t*. This makes it possible to firmly hold the transported piece Pc with the first and second delivery shuttles 51 and 52 moving along the curved delivery rail 40*t*.

Owing to the rear and front claws 562 and 568 engaging with parts of the face of the transported piece Pc at the side opposite from the delivery rail 40*t*, the centrifugal force resulting from movement along the curved delivery rail 40*t* can be counteracted by the claws 562 and 582. Thus, while the first and second delivery shuttles 51 and 52 are moving along the curved delivery rail 40*t*, the transported piece Pc can be prevented from flying or falling out.

The state where one transported piece Pc is held with the first delivery shuttle 51 arranged frontward in the transport direction Tr and the second delivery shuttle 52 arranged rearward in the transport direction Tr will be referred to as the first holding state St1. In other words, in the first holding state St1, the first and second delivery shuttles 51 and 52 hold one transported piece Pc.

Figure 14:
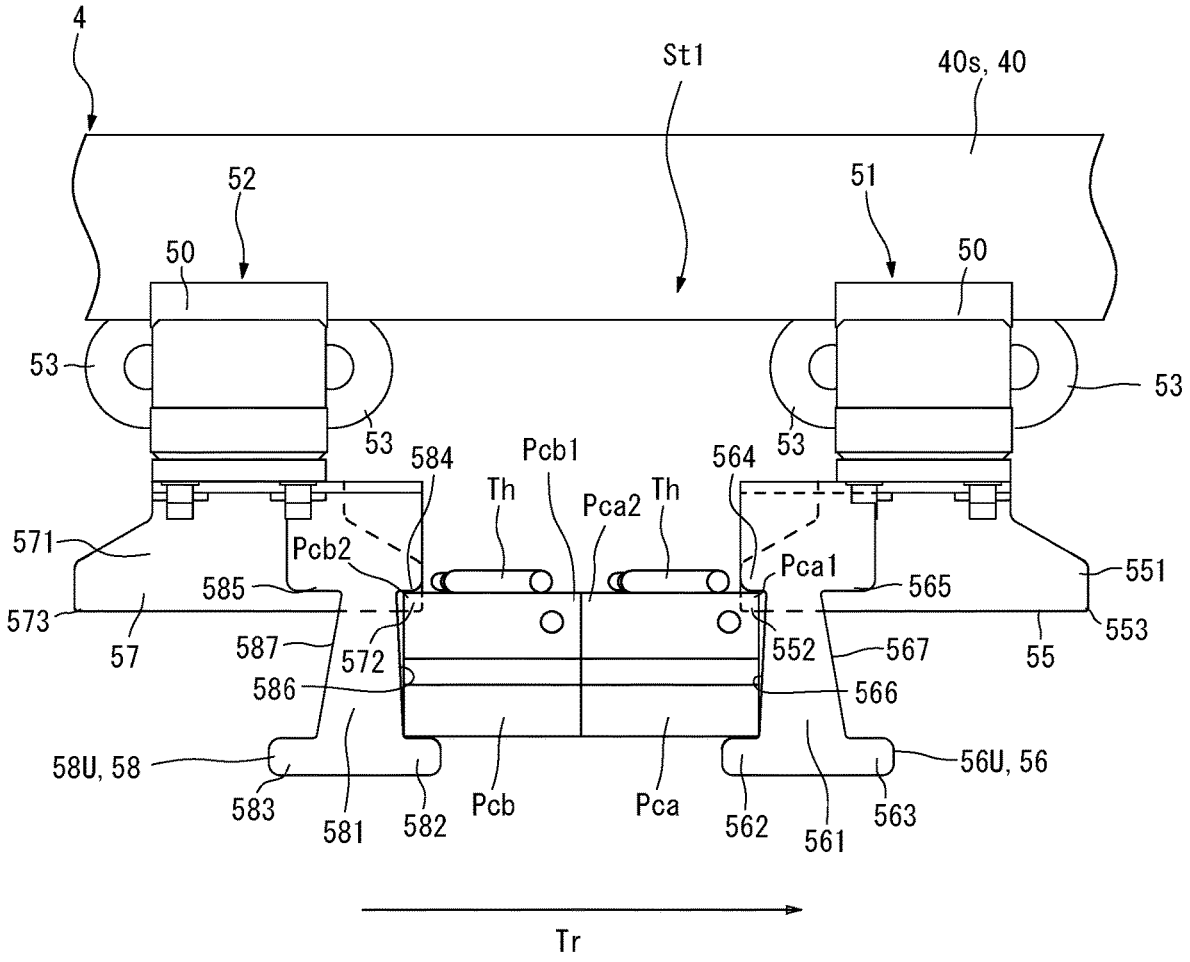
FIG. 14 is a plan view of two transported pieces arrayed in the transport direction being transported.

As shown in FIG. 10, one transported piece Pc is held with the first delivery shuttle 51 arranged frontward and the second delivery shuttle 52 arranged rearward in the transport direction Tr. FIG. 14 is a plan view showing a state where two transported pieces Pc in a row in the transport direction Tr are being transported.

As shown in FIG. 14, the first and second delivery shuttles 51 and 52 in the first holding state St1 can also hold two transported pieces Pc in a row in the transport direction Tr. The two transported pieces Pc will be distinguished by identifying, with respect to the transport direction Tr, the front-side one by Pca and the rear-side one by Pcb, though they are of the same configuration.

A corner part Pca1 of the front end, in the transport direction Tr, of the bottom face of the transported piece Pca at the side close to the delivery rail 40 is supported on the first rear support portion 552 of the first delivery shuttle 51. Likewise, a corner part Pcb2 of the rear end, in the transport direction Tr, of the bottom face of the transported piece Pcb at the side close to the delivery rail 40 is supported on the second front support portion 572 of the second transport shuttle 52. In this state, the transported piece Pca is acted on by a force that tends to cause a top part of it to fall rearward, and the transported piece Pcb is acted on by a force that tends to cause a top part of it to fall frontward; even so, owing to the transported pieces Pca and Pcb being arranged in contact with each other in the front-read direction, the forces acting on them cancel each other, resulting in stable holding.

As described above, in the first holding state St1, the first and second delivery shuttles 51 and 52 hold two transported pieces Pc in a row in the transport direction Tr.

<Second Holding State St2>

Figure 15:
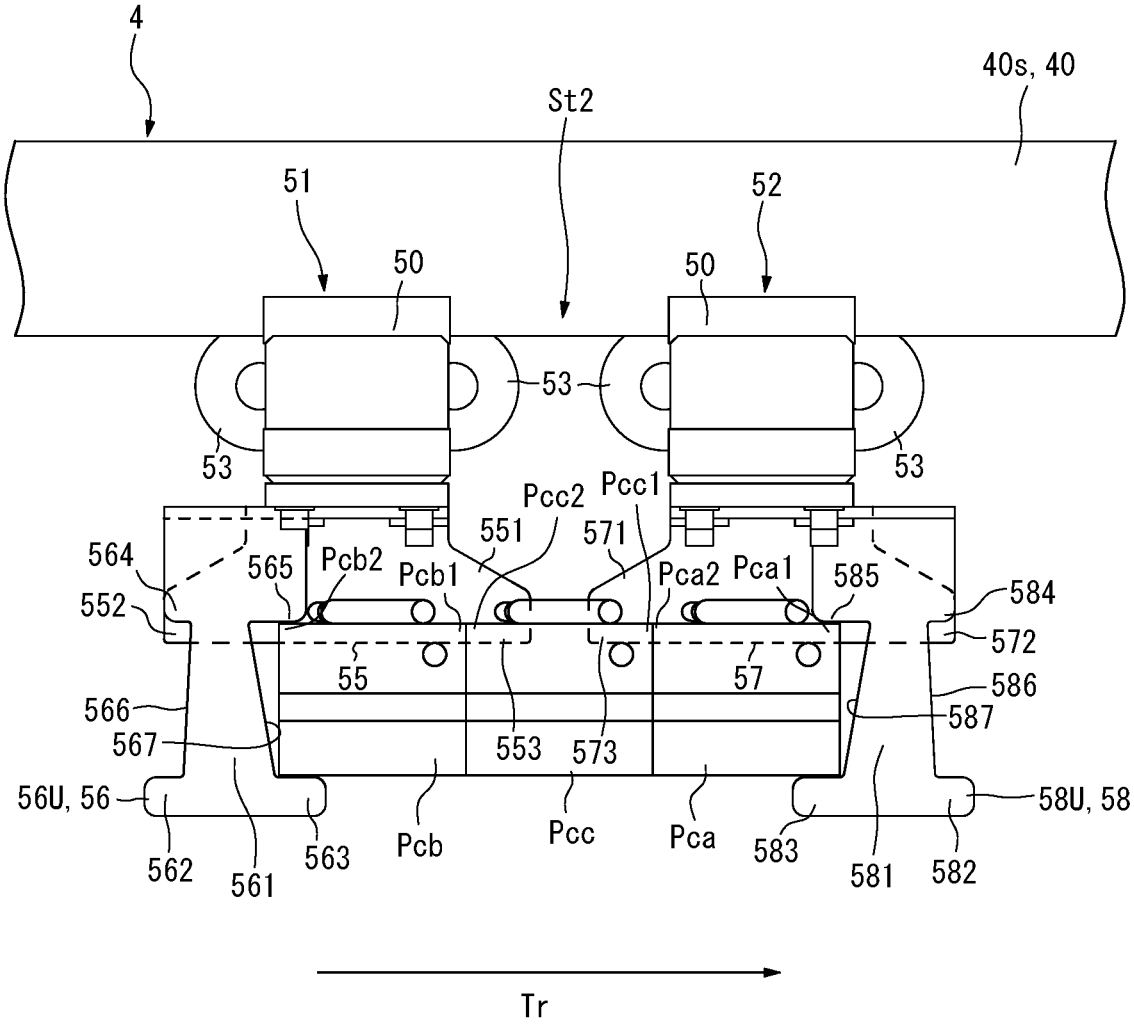
FIG. 15 is a plan view of the first and second delivery shuttles moving along a straight delivery rail while holding three transported pieces arrayed in the transport direction.
Figure 16:
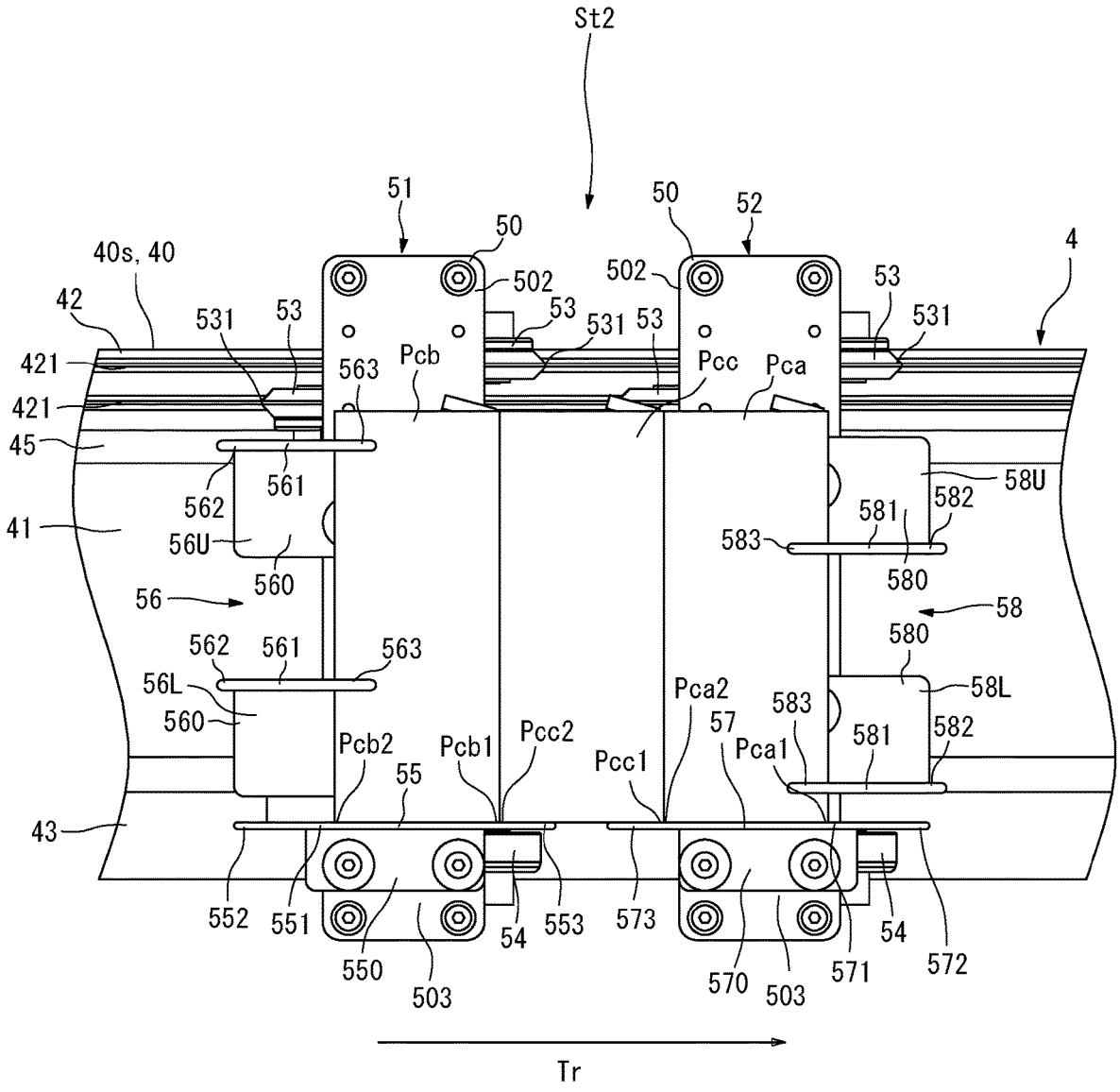
FIG. 16 is a diagram showing the first and second delivery shuttles shown in FIG. 15 as seen from outward.
Figure 17:
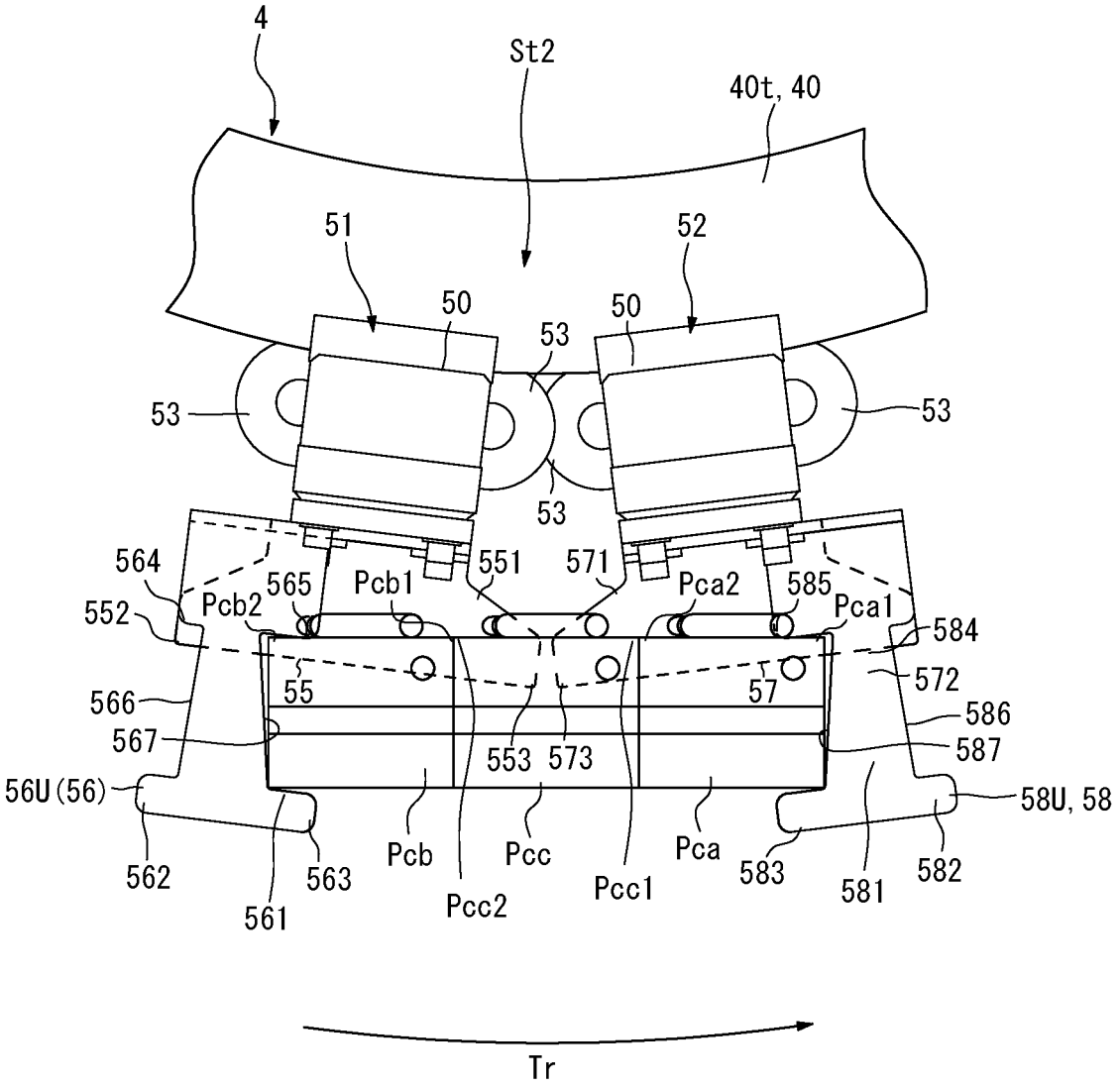
FIG. 17 is a plan view of the first and second delivery shuttles moving along a straight delivery rail while holding three transported pieces arrayed in the transport direction.

Next, the holding of three transported pieces Pc in a row in the transport direction Tr by the first and second delivery shuttles 51 and 52 will be described with reference to the relevant diagrams. FIG. 15 is a plan view of the first and second delivery shuttles 51 and 52 moving along a straight delivery rail 40*s* while holding three transported pieces Pca, Pcb, and Pcc in a row in the transport direction Tr. FIG. 16 is a diagram showing the first and second delivery shuttles 51 and 52 shown in FIG. 15 as seen from outward. FIG. 17 is a plan view of the first and second delivery shuttles 51 and 52 moving along a straight delivery rail 40*s* while holding three transported pieces Pca, Pcb, and Pcc in a row in the transport direction Tr.

In the following description, wherever necessary, of the transported pieces Pc in a row in the transport direction Tr, the frontmost one will be identified by Pca, the rearmost one by Pcb, and the middle one by Pcc.

First, a description will be given of the holding of three transported pieces Pca, Pcb, and Pcc by the first and second delivery shuttles 51 and 52 arranged on a straight delivery rail 40*s*. As shown in FIGS. 15 and 16, the first delivery shuttle 51 holds a rear part, in the transport direction Tr, of the rearmost transported piece Pcb in the transport direction Tr, and the second delivery shuttle 52 holds a front part, in the transport direction Tr, of the frontmost transported piece Pca in the transport direction Tr.

The front claw 563 of the first delivery engaging portion 56 engages with a part of the rear end of the face of the rearmost transported piece Pcb at the side opposite from the delivery rail 40. Likewise, the front stopper 565 engages with a part of the rear end of the face of the rearmost transported piece Pcb at the side facing the delivery rail 40. An outer end part of the front contact face 567 engages with an outer end part of the rear face, in the transport direction Tr, of the rearmost transported piece Pcb. At the side of the front contact face 567 close to the front stopper 565, a gap is formed.

Likewise, the rear claw 583 of the second delivery engaging portion 58 engages with a part of the front end of the face of the frontmost transported piece Pca in the transport direction Tr at the side opposite from the delivery rail 40. The rear stopper 585 engages with a part of the front end of the face of the frontmost transported piece Pca in the transport direction Tr at the side facing the delivery rail 40. An outer end part of the front contact face 586 makes contact with an outer end part of the front face, in the transport direction Tr, of the frontmost transported piece Pca in the transport direction Tr. At the side of the rear contact face 587 close to the rear stopper 585, a gap is formed.

With the first and second delivery shuttles 51 and 52 holding a transported piece Pc, opposite corner parts Pcb 1 and Pcb2 of the bottom face of the rearmost transported piece Pcb in the transport direction Tr at the side facing the delivery rail 40 and a rear corner part Pcc2, in the transport direction Tr, of the bottom face of the middle transported piece Pcc at the side facing the delivery rail 40 are supported on the first front support portion 553 of the support plate 551. Moreover, opposite corner parts Pca1 and Pca2 of the bottom face of the frontmost transported piece Pca in the transport direction Tr at the side facing the delivery rail 40 and a rear corner part Pcc1, in the transport direction Tr, of the bottom face of the middle transported piece Pcc at the side facing 40 are supported on the second rear support portion 573.

The state where, as shown in FIGS. 15 and 16, three transported pieces Pca, Pcb, and Pcc are held by the first delivery shuttle 51 from frontward in the transport direction Tr and by the second delivery shuttle 52 from rearward in the transport direction Tr will be referred to as the second holding state St2. In the second holding state St2, the first and second delivery shuttles 51 and 52 can hold three transported pieces arranged in a row in the transport direction Tr.

As shown in FIGS. 15 and 16, in the second holding state St2, the first and second delivery shuttles 51 and 52 hold three transported pieces Pca, Pcb, and Pcc in a row in the transport direction Tr.

A front part, in the transport direction Tr, of the frontmost transported piece Pca in the transport direction Tr is engaged with the second delivery engaging portion 58 of the second delivery shuttle 52. The bottom face of the transported piece Pca is supported on the second delivery support portion 57 of the second delivery shuttle 52.

A rear part, in the transport direction Tr, of the rearmost transported piece Pcb in the transport direction Tr is engaged with the first delivery engaging portion 56 of the first delivery shuttle 51. The bottom face of the transported piece Pcb is supported on the first delivery support portion 55 of the first delivery shuttle 51.

The bottom face of the middle transported piece Pcc in the transport direction Tr is supported by the first delivery support portion 55 of the first delivery shuttle 51 and the second delivery support portion 57 of the second delivery shuttle 52. The front face, in the transport direction Tr, of the transported piece Pcc is held by friction with the rear face of the transported piece Pca, and the rear face of the transported piece Pcc is held by friction with the front face of the transported piece Pcb.

In this way, the first and second delivery shuttles 51 and 52 in the second holding state St2 can hold three transported pieces Pca, Pcb, and Pcc.

As shown in FIG. 17, the first and second delivery shuttles 51 and 52 in the second holding state St2 holding three transported pieces Pca, Pcb, and Pcc can move along a curved delivery rail 40*t*. The controller 600 so controls as to make the distance between the first and second delivery shuttles 51 and 52 along the delivery rail 40*t* when they are on the curved delivery rail 40*t* shorter than that when they are on a straight delivery rail 40*s*.

Through such control, the distance between outer end parts of the arm bodies 561 and 581 in the transport direction Tr can be shortened. Thus, the front claw 563 can engage with a part of the rear end, in the transport direction Tr, of the face of the transported piece Pcb at the side opposite from the delivery rail 40*t*, and the rear claw 583 can engage with a part of the front end of the face of the transported piece Pca at the side opposite from the delivery rail 40*t*.

And through such control, the first and second delivery shuttles 51 and 52 in the second holding state St2 holding three transported pieces Pca, Pcb, and Pcc can move along the curved delivery part 40*t*. The force that acts on the middle transported piece Pcc in the transport direction Tr in a direction intersecting the transport direction Tr stems from the frictional forces with the transported pieces Pca and Pcb. Accordingly, the controller 600 sets the transport speed of the first and second delivery shuttles 51 and 52 in the second holding state St2 holding the three transported pieces Pca, Pcb, and Pcc such that the centrifugal force that acts on the middle transported piece Pcc does not exceed the just-mentioned frictional forces.

<Holding Four Transported Pieces>

Figure 18:
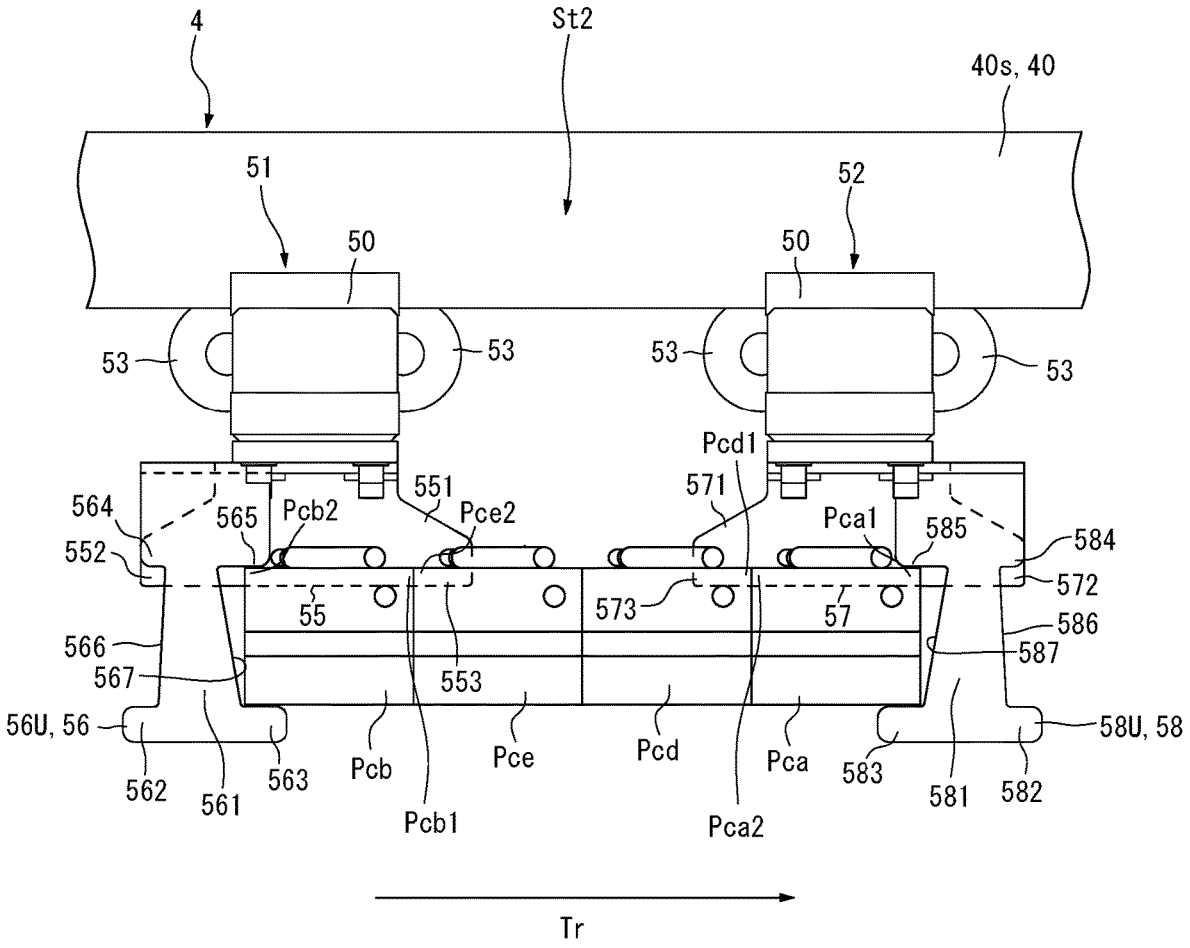
FIG. 18 is a plan view of the first and second delivery shuttles moving along a straight delivery rail while holding four transported pieces arrayed in the transport direction.
Figure 19:
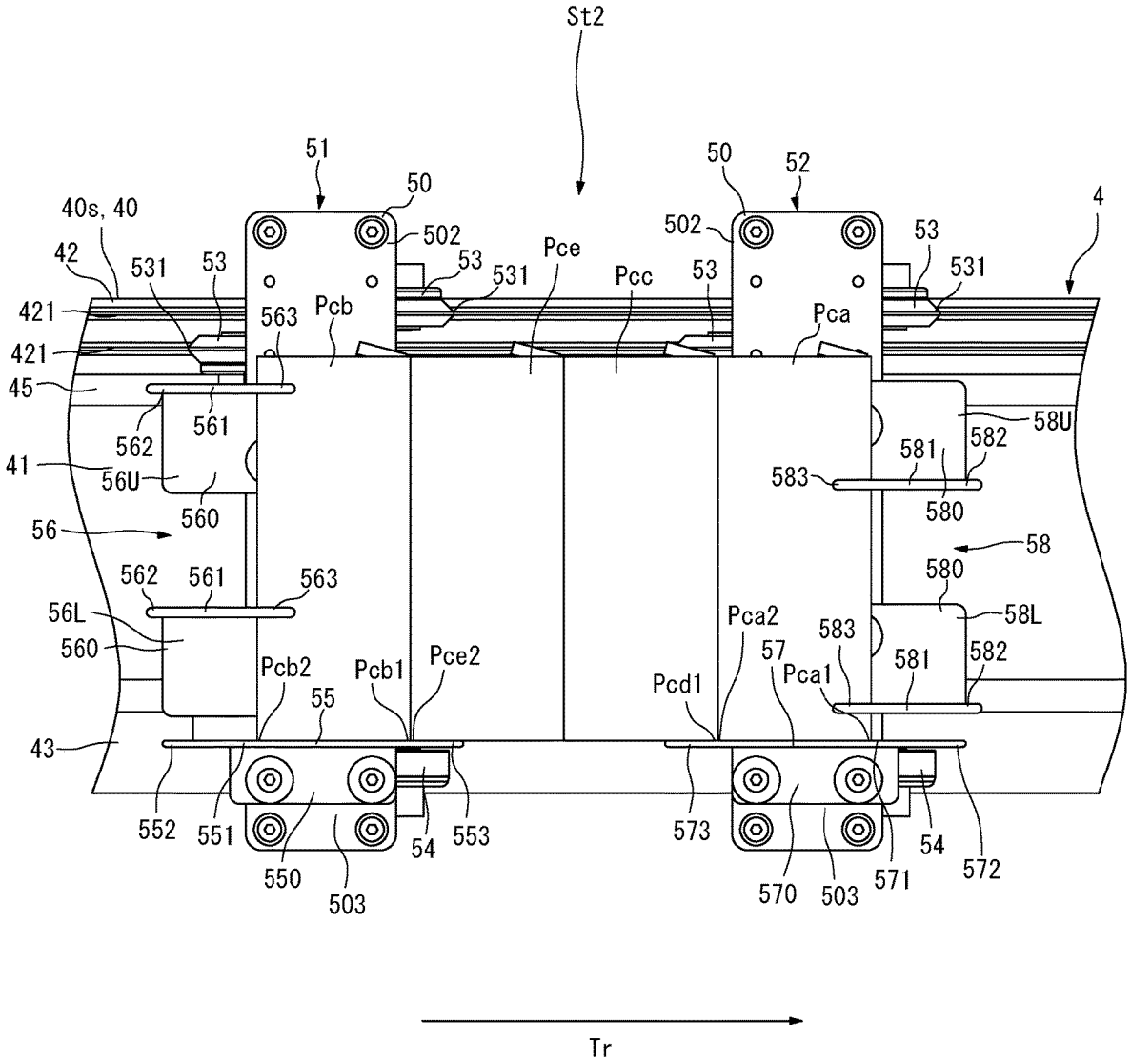
FIG. 19 is a diagram showing the first and second delivery shuttles shown in FIG. 18 as seen from outward.
Figure 20:
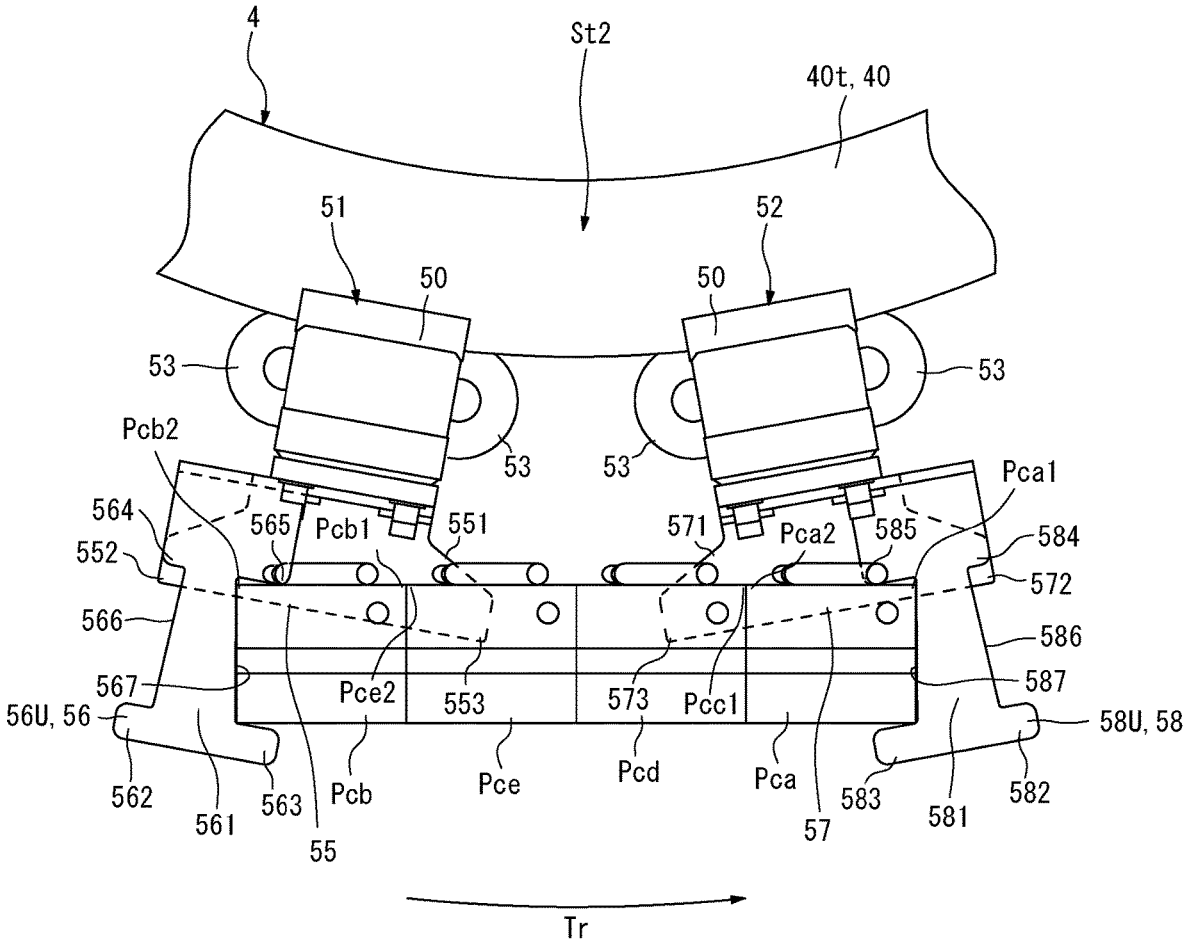
FIG. 20 is a plan view of the first and second delivery shuttles moving along a curved delivery rail while holding four transported pieces arrayed in the transport direction.

Next, the holding of four transported pieces Pc in a row in the transport direction Tr by the first and second delivery shuttles 51 and 52 will be described with reference to the relevant diagrams. FIG. 18 is a plan view of the first and second delivery shuttles 51 and 52 moving along a straight delivery rail 40*s* while holding four transported pieces Pca, Pcb, Pcc, and Pcd. FIG. 19 is a diagram showing the first and second delivery shuttles 51 and 52 shown in FIG. 18 as seen from outward. FIG. 20 is a plan view of the first and second delivery shuttles 51 and 52 moving along a curved delivery rail 40*t* while holding four transported pieces Pca, Pcb, Pcc, and Pcd.

In the following description, wherever necessary, of the transported pieces Pc in a row in the transport direction Tr, the frontmost one will be identified by Pca, the rearmost one by Pcb, the one rearward of the transported piece Pca by Pcd, and the one frontward of the transported piece Pcb by Pce.

As shown in FIGS. 18 and 19, the first delivery shuttle 51 holds a rear part, in the transport direction Tr, of the rearmost transported piece Pcb in the transport direction Tr, and the second delivery shuttle 52 holds a front part, in the transport direction Tr, of the frontmost transported piece Pca in the transport direction Tr. How the first delivery shuttle 51 holds the transported piece Pcb and the second delivery shuttle 52 holds the transported piece Pca are the same as when they hold three transported pieces, and therefore no detailed description will be repeated.

With the first and second delivery shuttles 51 and 52 holding the transported piece Pc, opposite corner parts Pcb1 and Pcb2 of the bottom face of the transported piece Pcb at the side facing the delivery rail 40 and a rear corner part Pce2, in the transport direction Tr, of the bottom face of the transported piece Pce at the side facing delivery rail 40 are supported on the first front support portion 553 of the support plate 551. Moreover, opposite corner parts Pca1 and Pca2 of the bottom face of the transported piece Pca at the side facing the delivery rail 40 and a front corner part Pcd1, in the transport direction Tr, of the bottom face of the transported piece Pcd at the side facing the delivery rail 40 are supported on the second rear support portion 573 of the support plate 571.

A front part of the bottom face of the transported piece Pcd is supported on the second rear support portion 573, and a rear part of the bottom face of the transported piece Pce is supported on the first front support portion 553. Thus, the transported piece Pcd is acted on by a force that tends to cause a top part of it to lean rearward in the transport direction Tr. Moreover, the transported piece Pce is acted on by a force that tends to cause a top part of it to lean frontward in the transport direction Tr. The transported pieces Pcd and Pce, by counteracting the forces acting on them respectively, cancel those forces. Thus, the transported pieces Pcd and Pce support each other in the transport direction Tr. Moreover, owing to the transported pieces Pcd and Pce forming a row, they are restrained from outward movement by the frictional force between transported pieces Pca and Pcd and the frictional force between transported pieces Pcb and Pce.

Accordingly, the controller 600 sets the transport speed of the first and second delivery shuttles 51 and 52 in the second holding state St2 holding the four transported pieces Pca, Pcb, Pcc, and Pcd such that the centrifugal forces acting on the transported pieces Pcd and Pce do not exceed the just-mentioned frictional forces.

In this way, the first and second delivery shuttles 51 and 52 in the second holding state St2 can hold the four transported pieces Pca, Pcb, Pcc, and Pcd.

As shown in FIG. 20, the first and second delivery shuttles 51 and 52 in the second holding state St2 holding the four transported pieces Pca, Pcb, Pcc, and Pcd can move along a curved delivery rail 40*t*. The controller 600 control them in a similar manner to when they hold three transported pieces.

The first and second delivery shuttles 51 and 52 in the second holding state St2 holding four transported pieces Pca, Pcb, Pcc, and Pcd can move along the curved delivery rail 40*t*.

<Passing-Over of a Transported Piece Pc>

In the transport and cartoning apparatus 100, a plurality of processes are performed before transported pieces Pc carried in are packed in a packing box Bx. Due to the layout of processing devices and differences in their processing times, for example, arranging all the processing devices along a single transport path employing a belt conveyor, a linear motor mechanism, and the like may lead to restrictions on installation space and a prolonged operation time. To circumvent that, in the transport and cartoning apparatus 100, the delivery device 300 is used to pass over a transported piece Pc when switching transport paths, thereby to achieve efficient use of installation space and efficient performance of processes. A description will now be given of the passing-over of a transported piece Pc between transport paths in the delivery device 300. The transport paths involved here are one along the transport loop 2 and another along the delivery loop 4.

Figure 22:
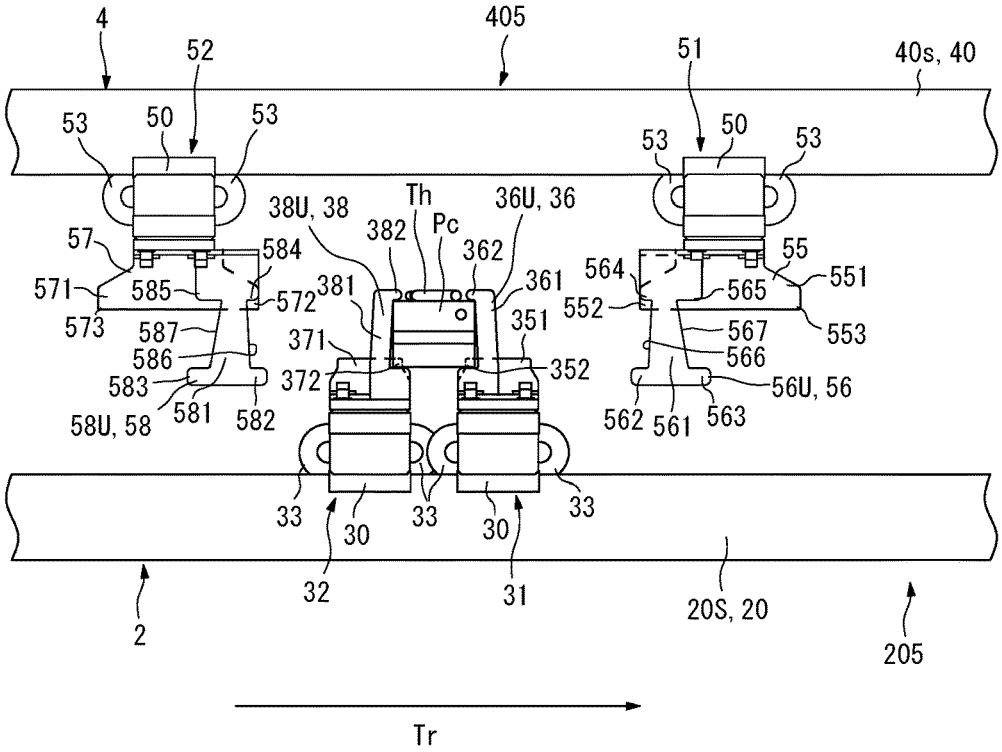
FIG. 22 is a plan view of the first and second transport shuttles moving while holding a transported piece.

FIG. 21 is a diagram showing the first transport shuttle 31, the second transport shuttle 32, the first delivery shuttle 51, and the second delivery shuttle 52 as seen from rearward in the transport direction Tr. FIG. 22 is a plan view of the first and second transport shuttles 31 and 32 moving while holding a transported piece Pc.

Figure 23:
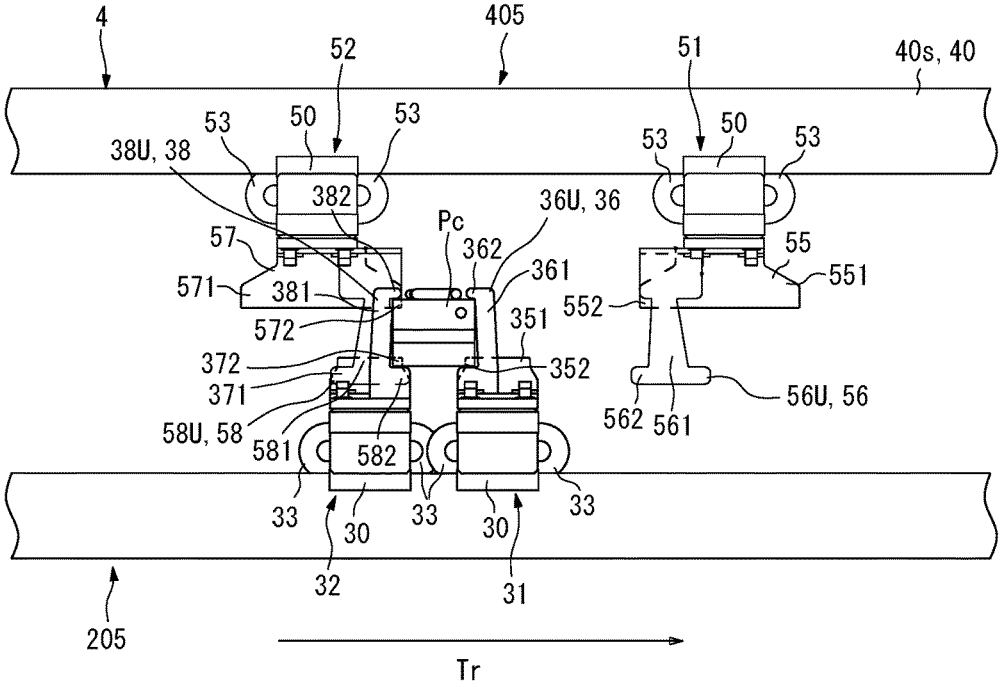
FIG. 23 is a plan view of the second delivery shuttle holding a rear part of a transported piece in the transport direction.

FIG. 23 is a plan view of the second delivery shuttle 52 holding a rear part of the transported piece Pc in the transport direction Tr. FIG. 24 is a plan view of the first and second delivery shuttles 51 and 52 holding the transported piece Pc held by the first and second transport shuttles 31 and 32.

Figure 25:
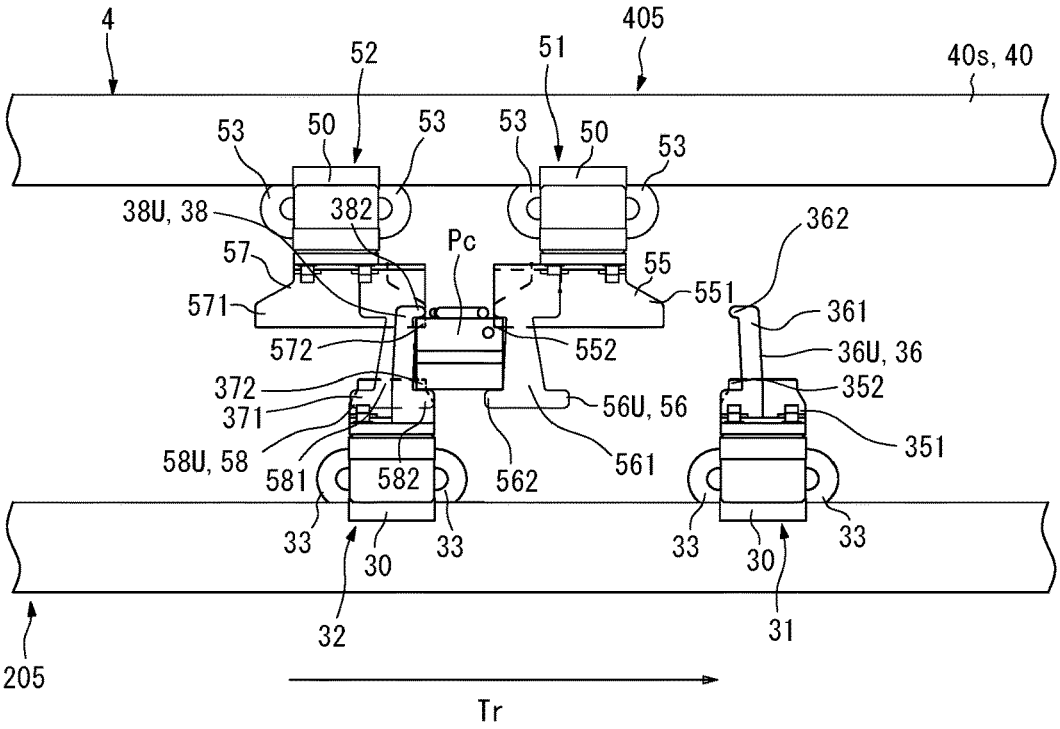
FIG. 25 is a plan view of the first and second delivery shuttles holding a transported piece.
Figure 26:
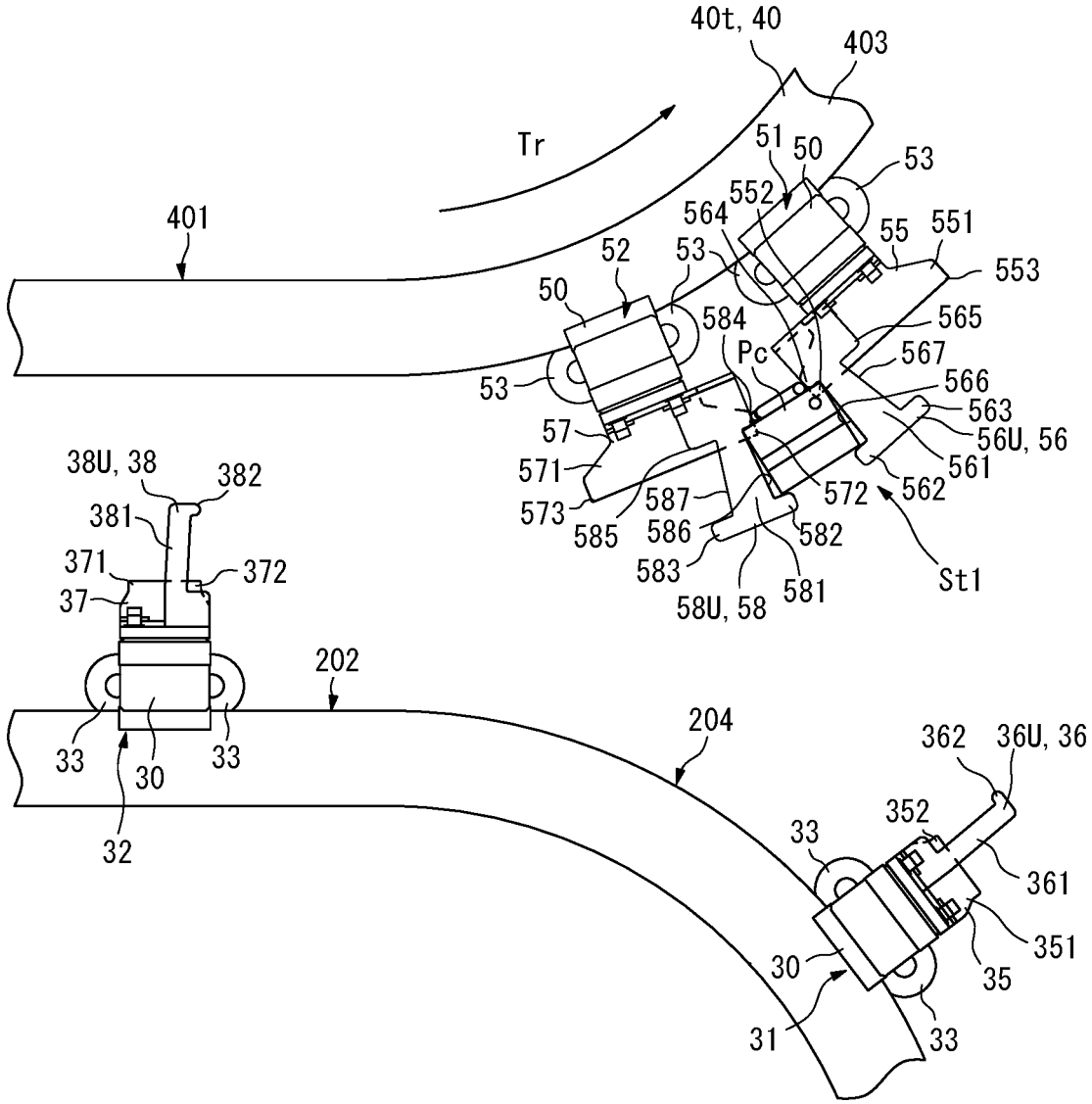
FIG. 26 is a plan view of the first and second delivery shuttles moving along a first curved section while holding a transported piece.

FIG. 25 is a plan view of the first and second delivery shuttles 51 and 52 holding the transported piece Pc. FIG. 26 is a plan view of the first and second delivery shuttles 51 and 52 moving along the first curved section 403 while holding the transported piece Pc.

As shown in FIG. 21, the delivery straight part 205 and the delivery straight part 405 are arranged parallel to each other, with their respective outer faces facing each other. The first transport engaging portion 36 of the first transport shuttle 31 and the second transport engaging portion 38 of the second transport shuttle 32, which are located on the delivery straight part 205, partly overlap with the first delivery engaging portion 56 of the first delivery shuttle 51 and the second delivery engaging portion 58 of the second delivery shuttle 52, which are located on the delivery straight part 405.

As shown in FIG. 21, with respect to the up-down direction, the first transport upper and lower arms 36U and 36L are arranged below the first delivery upper and lower arms 56U and 56L respectively. Likewise, with respect to the up-down direction, the second transport upper and lower arms 38U and 38L are arranged above the second delivery upper and lower arms 58U and 58L respectively.

In this way the arms of the different engaging portions are arranged displaced in the up-down direction. Thus, when a transported piece Pc held by the first and second transport shuttles 31 and 32 are held by the first and second delivery shuttles 51 and 52, the first transport engaging portion 36 and the first delivery engaging portion 56 are prevented from making contact with and interfering with each other, and the second transport engaging portion 38 and the second delivery engaging portion 58 are prevented from making contact with and interfering with each other.

The top face of the first transport support portion 35 of the first transport shuttle 31, the top face of the second transport support portion 37 of the second transport shuttle 32, the top face of the first delivery support portion 55 of the first delivery shuttle 51, and the top face of the second delivery support portion 57 of the second delivery shuttle 52 are flush with each other. Thus, by bringing the first and second delivery shuttles 51 and 52 close to the transported piece Pc held by the first and second transport shuttles 31 and 32, it is possible to smoothly support the bottom face of the transported piece Pc with the first and second delivery support portions 55 and 57.

In the embodiment, also the first transport engaging portion 36 and the second delivery engaging portion 58, and the second transport engaging portion 38 and the first delivery engaging portion 56, are arranged displaced in the up-down direction. Thus, the first and second transport shuttles 31 and 32 do not interfere with the first and second delivery shuttles 51 and 52 respectively. Hence, when no passing-over of a transported piece Pc is performed as during a test run at the start of operation or during maintenance, it is possible to control, on one hand, the first and second transport shuttles 31 and 32 and, on the other hand, independently of them, the first and second delivery shuttles 51 and 52.

The passing-over of a transported piece Pc takes place while the first and second transport shuttles 31 and 32 are moving on the delivery straight part 205. In FIG. 22, the transport direction Tr of transported pieces Pc is from left to right.

As shown in FIG. 1, in the transport loop 2, a boundary part between the first curved section 203 and the second straight portion 202 faces a middle part of the first straight portion 401 of the delivery loop unit 4. Accordingly, before the first and second transport shuttles 31 and 32 holding the transported piece Pc moves to the second straight portion 202, the controller 600 moves the first delivery shuttle 51 to a position opposite the delivery straight part 205.

As shown in FIG. 22, the controller 600 controls such that, when the first and second transport shuttles 31 and 32 holding the transported piece Pc enter the delivery straight part 205, the first and second delivery shuttles 51 and 52 are arranged frontward and rearward, respectively, of the transported piece Pc in the transport direction Tr. In the embodiment, the controller 600 controls such that, while the first and second transport shuttles 31 and 32 move at a constant speed, the first and second delivery shuttles 51 and 52 move in the transport direction Tr so as to approach the transported piece Pc. The controller 600 may control in any other manner than as described above; it may control such that, with respect to the transported piece Pc held by the first and second transport shuttles 31 and 32, the first delivery shuttle 51 is arranged rearward of it and the second delivery shuttle 52 frontward of it.

As shown in FIG. 23, the controller 600 makes the second delivery shuttle 52 approach the transported piece Pc so that the second delivery shuttle 52 holds a rear part of the transported piece Pc in the transport direction Tr. At this time, the second delivery shuttle 52 may accelerate the second delivery shuttle 52 or decelerate the first and second transport shuttles 31 and 32, or do both.

After that, as shown in FIG. 24, the controller 600 makes the first delivery shuttle 51 approach the transported piece Pc so that the first delivery shuttle 51 holds a front part of the transported piece Pc in the transport direction Tr. At this time, the controller 600 may decelerate the first delivery shuttle 51, or accelerate the first and second transport shuttles 31 and 32 and the second delivery shuttle 52, or do both.

As shown in FIG. 25, the transported piece Pc is held by the first and second transport shuttles 31 and 32 and is also held by the first and second delivery shuttles 51 and 52 in the first holding state St1. At this time, the controller 600 may accelerate the first transport shuttle 31, or decelerate the first and second delivery shuttles 51 and 52 and the second transport shuttle 32, or do both.

After that, as shown in FIG. 26, the first and second delivery shuttles 51 and 52 in the first holding state St1 move to the first curved section 403. Now, a rear part of the transported piece Pc in the transport direction Tr moves away from the second transport shuttle 32. At this time, the controller 600 may decelerate the second transport shuttle 32 to forcibly move it away from the rear part of the transported piece Pc in the transport direction Tr, or may accelerate the first and second delivery shuttles 51 and 52, or do both.

In the manner described above, in the delivery device 300, the transported piece Pc held by the first and second transport shuttles 31 and 32 moving in the transport loop 2 can be passed over to be held by the first and second delivery shuttles 51 and 52 moving in the delivery loop unit 4.

In some cases, a transported piece Pc held by the first and second transport shuttles 31 and 32 is not passed over to the first and second delivery shuttles 51 and 52. An example of such cases is when, as shown in FIG. 1, a transported piece Pc held by the first and second transport shuttles 31 and 32 is passed over to a connection conveyor Cc arranged frontward, in the transport direction Tr, of the delivery straight part 205 of the transport loop 2. The connection conveyor Cc connects to, for example, an unillustrated shrink-packaging device. The connection conveyor Cc transports a plurality of transported pieces Pc, here three of them, put together in a close row to the shrink-packaging device.

In the unillustrated shrink-packaging device, a shrink-packaging process is performed to wrap the transported pieces Pc put in a row as a whole in, for example, transparent resin film. In the transport and cartoning apparatus 100, the shrink-packaging process is performed as necessary. While an example where the connection conveyor Cc connects to an unillustrated shrink-packaging process has been described, this is not meant as any limitation; it may instead connect to a processing device that perform any other process such as a printing process or an inspection process.

As described above, with the delivery device 300, it is possible to pass transported pieces Pc over from one device to another to make them move along different loops. This makes it possible to turn the transport direction a plurality of times. This allows more freedom in the layout of the transport and cartoning apparatus 100. It is thus furthermore possible to reduce the installation area of the transport and cartoning apparatus 100 and thereby reduce the costs of the transport and cartoning apparatus 100.

<Re-Holding Device 400>

As shown in FIG. 1, in the transport and cartoning apparatus 100, the re-holding device 400 is arranged in the stage succeeding the delivery device 300. The re-holding device 400 shares part of the delivery loop unit 4 (here, the second straight portion 402) and the first and second delivery shuttles 51 and 52 with the delivery device 300.

In the re-holding device 400, the first and second delivery shuttles 51 and 52 moving in the delivery loop unit 4 holds together a predetermined number (assumed to be four in the following description) of transported pieces Pc that have been transported one by one. That is, the re-holding device 400 performs a re-holding process to bundle together such a number of transported pieces Pc having been transported one by one that is convenient for packing in a packing box Bx.

Figure 29:
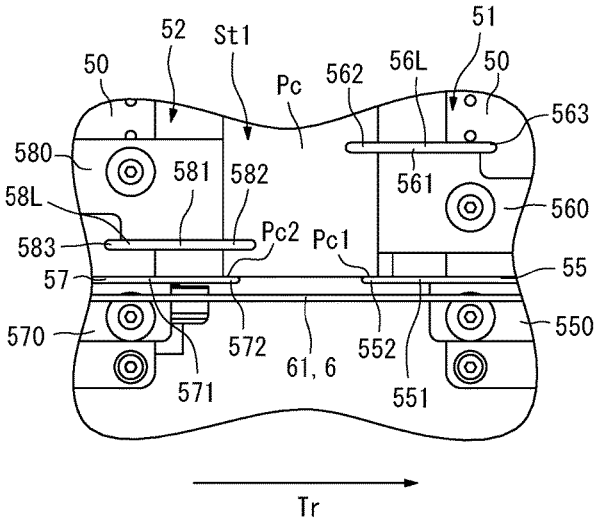
FIG. 29 is an enlarged front view of the first and second delivery shuttles in a first near region.
Figure 30:
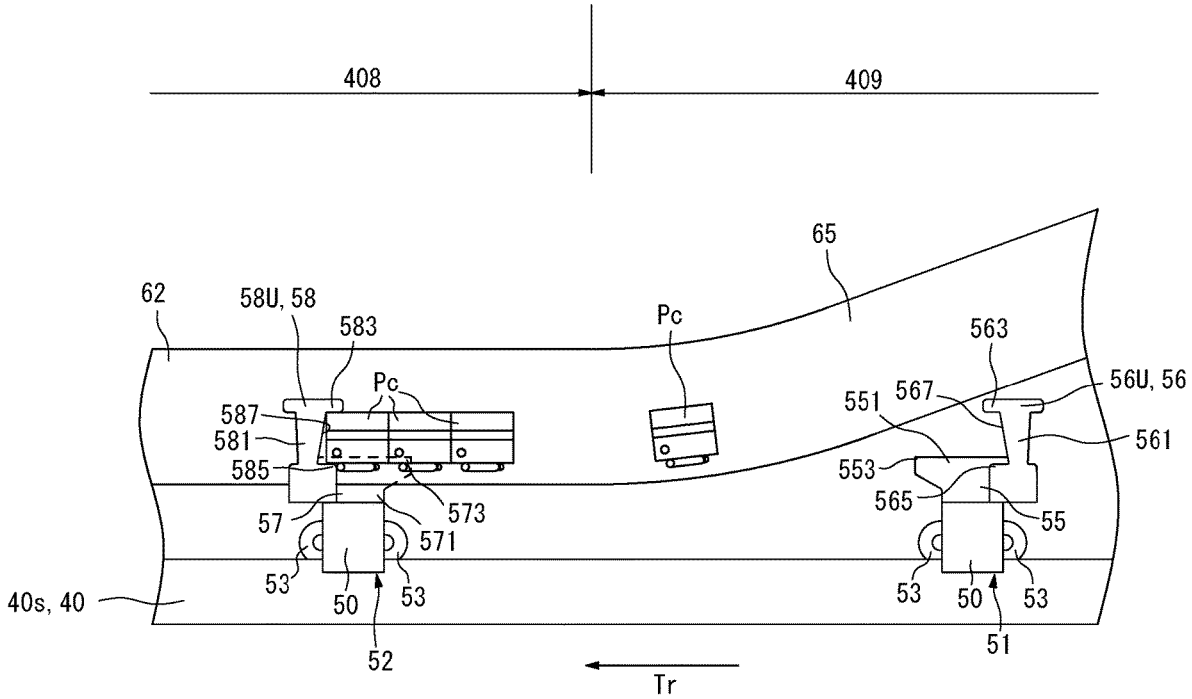
FIG. 30 is a plan view of transported pieces being accumulated.
Figure 31:
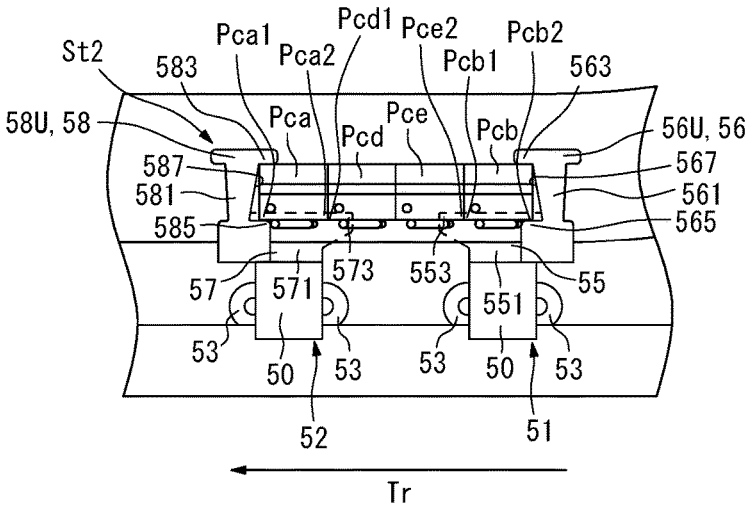
FIG. 31 is a plan view of four transported pieces on the re-holding conveyor held in a second holding state.
Figure 32:
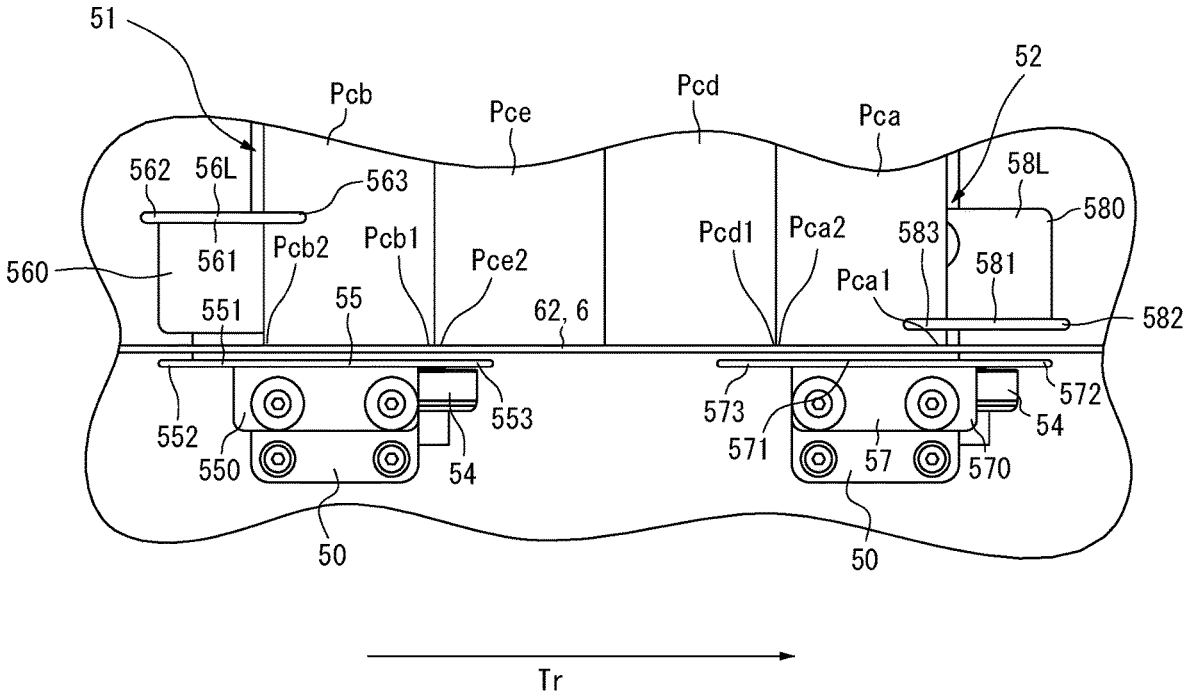
FIG. 32 is a front view of four transported pieces held.

FIG. 27 is a plan view of a principal part of the re-holding device 400. FIG. 28 is an enlarged plan view of the first and second delivery shuttles 51 and 52 passing transported pieces Pc over to a re-holding conveyor 6. FIG. 29 is an enlarged front view of the first and second delivery shuttles 51 and 52 in a first near region 407. FIG. 30 is a plan view showing transported pieces Pc being accumulated. FIG. 31 is a plan view of four transported pieces on the re-holding conveyor 6 held in the second holding state. FIG. 32 is a front view of four transported pieces held.

As shown in FIGS. 1 and 27, the re-holding device 400 includes the delivery loop unit 4, the first delivery shuttle 51, the second delivery shuttle 52, and the re-holding conveyor 6. The re-holding device 400 too is controlled by the controller 600. The re-holding device 400 will now be described in detail with reference to the relevant drawings. For those parts shared with the delivery device 300, namely the delivery loop unit 4 and the first and second delivery shuttles 51 and 52, no detailed description will be repeated.

The re-holding conveyor 6 in the re-holding device 400 is arranged along the second straight portion 402 of the delivery loop unit 4. The transport direction Tr of transported piece Pc by the re-holding conveyor 6 is the same as the transport direction Tr of transported pieces Pc in the second straight portion 402 of the delivery loop unit 4. That is, the transport direction Tr in the re-holding device 400 is from right to left in FIG. 27.

The re-holding conveyor 6 is a top chain conveyor, and has a first near portion 61, a second near portion 62, and a far portion 63. In the re-holding conveyor 6, the first near portion 61, the far portion 63, and the second near portion 62 are arranged in this order in the transport direction Tr. As shown in FIG. 2, the re-holding conveyor 6 has a conveyor motor 60. The conveyor motor 60 is connected to the controller 600. The conveyor motor 60 controls the re-holding conveyor 6 according to instructions from the controller 600. Controlling the re-holding conveyor 6 involves, but is not limited to, for example, starting it, stopping it, and controlling its transport speed.

As shown in FIG. 27, the first near portion 61 is straight, and is arranged parallel to the second straight portion 402 of the delivery loop unit 4. As shown in FIGS. 27 and 28, the first near portion 61 is so close to the straight delivery rail 40*s* as to be able to receive a transported piece Pc held by the first and second delivery shuttles 51 and 52 moving in the second straight portion 402. The first near portion 61 and the delivery rail 40*s* in the second straight portion 402 facing the first near portion 61 constitute the first near region 407.

Frontward of the first delivery shuttle 51 in the transport direction Tr, a curved section 64 is arranged that is curved in a direction away from the delivery rail 40*s*. The far portion 63 is arranged frontward of the curved section 64 in the transport direction Tr. The far portion 63 is straight, and is arranged parallel to the second straight portion 402 of the delivery loop unit 4. As shown in FIG. 27, the far portion 63 is, for example, straight, and is arranged, for example, substantially parallel to and so distant from the second straight portion 402 of the delivery loop unit 4 that a transported piece Pc moving on the far portion 63 does not make contact with the first and second delivery shuttles 51 and 52 moving in the second straight portion 402. The far portion 63 and the delivery rail 40*s* of the second straight portion 402 facing the far portion 63 constitute a far region 409.

Frontward of the far portion 63 in the transport direction Tr, a curved section 65 is arranged that is curved in a direction toward the straight delivery rail 40*s*. The second near portion 62 is arranged frontward of the curved section 65 in the transport direction Tr. The second near portion 62 is straight, and is arranged parallel to the second straight portion 402 of the delivery loop unit 4. As shown in FIGS. 27 and 30, the second near portion 62 is so close to the straight delivery rail 40*s* that the first and second delivery shuttles 51 and 52 moving in the second straight portion 402 can hold the transported piece Pc. The first near portion 61 and the delivery rail 40*s* in the second straight portion 402 facing the first near portion 61 constitute a second near region 408.

Next, a description will be given of the re-holding of transported pieces in the re-holding device 400. In the delivery device 300, the first and second delivery shuttles 51 and 52 receive one transported piece Pc from the first and second transport shuttles 31 and 32.

As shown in FIGS. 27 and 28, the controller 600 makes the first and second delivery shuttles 51 and 52 in the first holding state SO holding the one transported piece Pc enter the first near region 407. At this time, the transported piece Pc held by the first and second delivery shuttles 51 and 52 is located above the delivery conveyor 6. More specifically, in the first near region 407, the delivery conveyor 6 is located under the first delivery support portion 55 of the first delivery shuttle 51 and the second delivery support portion 57 of the second delivery shuttle 52 together holding the transported piece Pc (see FIG. 29).

In the first near region 407, the controller 600 so controls as to move the first delivery shuttle 51 away from the transported piece Pc frontward in the transport direction Tr and the second delivery shuttle 52 away from the transported piece Pc rearward in the transport direction Tr. As a result, the transported piece Pc held by the first and second delivery shuttles 51 and 52 falls onto the delivery conveyor 6 (see FIG. 28).

For example, the controller 600 controls the first and second delivery shuttles 51 and 52 such that, when the transported piece Pc falls, the first delivery support portion 55, the first delivery engaging portion 56, the second delivery support portion 57, and the second delivery engaging portion 58 make contact with the side faces of the transported piece Pc to keep it aligned. In this way, the controller 600 can control the first and second delivery shuttles 51 and 52 so that the transported piece Pc will not lose orientation with respect to the delivery conveyor 6. If the transported piece Pc is unlikely to loose orientation, it may simply be dropped.

In a similar manner to what has just been described, the controller 600 controls one pair after another of first and second delivery shuttles 51 and 52 that reaches the first near region 407 while holding a transported piece Pc. Thus all the transported pieces Pc transported are placed one after another on the delivery conveyor 6.

As shown in FIG. 27, the transported pieces Pc placed one after another on the delivery conveyor 6 in the first near region 407 are then transported by the delivery conveyor 6. The controller 600 moves the first and second delivery shuttles 51 and 52 having released the transported piece Pc in the transport direction Tr synchronously with the transport of the transported piece Pc. Thus, the first and second delivery shuttles 51 and 52 can move in the delivery loop unit 4 without interfering with the transported piece Pc transported on the delivery conveyor 6.

When the transported piece Pc reaches the curved section 64 and moves to a position where it does not interfere with the first and second delivery shuttles 51 and 52, the controller 600 accelerates the first and second delivery shuttles 51 and 52 and moves them to the far region 409. The controller 600 keeps the first and second delivery shuttles 51 and 52 on standby in the far region 409. During this standby, the controller 600 may keep the first and second delivery shuttles 51 and 52 at rest, or move them slowly, in the far region 409.

The controller 600 stops, of any second delivery shuttles 52 staying on standby in the far region 409, the second delivery shuttle 52 located most frontward in the transport direction Tr in the second near region 408 (see FIG. 30). As shown in FIGS. 30, 32, etc., in the second near region 408, the first delivery support portion 55 of the first delivery shuttle 51 and the second delivery support portion 57 of the second delivery shuttle 52 are arranged below the top surface of the delivery conveyor 6.

With the second delivery shuttle 52 at rest in the second near region 408, the second delivery engaging portion 58 of the second delivery shuttle 52 receives the transported piece Pc transported by the delivery conveyor 6 to be brought into the second holding state St2. Transported pieces Pc are transported one after another by the delivery conveyor 6. The transported pieces Pc are accumulated one after another in the transport direction Tr by the second delivery engaging portion 58 (see FIG. 30).

After the fourth transported piece Pc to be accumulated by the second delivery engaging portion 58 has passed through the curved section 65, the controller 600 makes, of any first delivery shuttles 51 staying on standby in the far region 409, the first delivery shuttle 51 located most frontward in the transport direction Tr move in the transport direction Tr. The controller 600 makes the first delivery engaging portion 56 of the first delivery shuttle 51 engage with a rear part, in the transport direction Tr, of the rearmost transported piece Pcb in the transport direction Tr among the four transported pieces adjacent to each other in the transport direction Tr. As a result, as shown in FIG. 31, a front end part and a rear end part of the four transported pieces Pca, Pcb, Pcd, and Pce are engaged with the second delivery engaging portion 58 and the first delivery engaging portion 56.

As shown in FIG. 32, in the second near region 408, the first delivery support portion 55 of the first delivery shuttle 51 and the second delivery support portion 57 of the second delivery shuttle 52 are located below the delivery conveyor 6. Thus, while in the second near region 408, the first and second delivery engaging portions 56 and 58 are in the second holding state, and the four transported pieces Pca, Pcb, Pcd, and Pce are supported by the delivery conveyor 6 from below. The controller 600 moves the first and second delivery shuttles 51 and 52 from the second straight section 402 to the second curved section 404.

The first and second delivery shuttles 51 and 52 move along the curved delivery rail 40*t*. The curved delivery rail 40*t* is arranged to be increasingly far from the delivery conveyor 6. Thus, the four transported pieces Pca, Pcb, Pcd, and Pce are pulled by the second delivery engaging portion 58 and the first delivery engaging portion 56 and are displaced from the delivery conveyor 6.

As a result, of the four transported pieces Pca, Pcb, Pcd, and Pce, the bottom faces of the transported pieces Pca and Pcd are supported by the second delivery support portion 57, and the bottom faces of the transported pieces Pcb and Pce are supported by the first delivery support portion 55. Thus, the first and second delivery shuttles 51 and 52 holds the four transported pieces Pca, Pcb, Pcd, and Pce in the second holding state St2.

The first and second delivery shuttles 51 and 52 holding the four transported pieces Pca, Pcb, Pcd, and Pce moves from the second curved section 404 to the packing straight part 406, which is located rearward of the first straight section 401 in the transport direction Tr. The packing straight part 406 is part of the cartoning device 500, which is a process following the re-holding device 400.

Note that, while in the first near region 407 a pair of the first and second delivery shuttles 51 and 52 holds one transported piece Pc, in the second near region 408 a pair of the first and second delivery shuttles 51 and 52 holds a plurality of (in the example described above, four) transported pieces Pc. This leaves some (in the example described below, three) pairs of the first and second delivery shuttles 51 and 52 holding no transported piece Pc. These need to be moved off downward from the second near region 408 so as not to stagnate in the far region 409.

As described above, in the re-holding device 400, of transported pieces Pc that are transported one by one, four can be re-held together with a single pair of first and second delivery shuttles 51 and 52. It is also possible to re-hold three of them by similar operation. Moreover, by keeping the first delivery shuttle 51 at rest in the second near region 408, it is possible to hold and transport two transported pieces in the first holding state St1.

A downstream part of the connection conveyor Cc in the transport direction Tr may be connected to an upstream part of the delivery conveyor 6. In that case, the delivery conveyor 6 transports a shrink-packaged bundle of a plurality of transported pieces, and in the delivery device 300, the transported pieces Pc are not passed over from the first and second transport shuttles 31 and 32 to the first and second delivery shuttles 51 and 52. Accordingly, the controller 600 does not perform, in the first near region 407, passing-over of the transported pieces Pc from the first and second delivery shuttles 51 and 52 to the delivery conveyor 6. The first and second delivery shuttles 51 and 52 then hold the shrink-packaged bundle of the plurality of transported pieces in the second near region 408 and transports it to the packing straight part 406.

With the re-holding device 400, it is possible to bundle, while transporting, such a number of transported pieces Pc that are suitable for packing in a packing box Bx, and pack them in a bundled state on the cartoning device 500. This allow easy and reliable cartoning of transported pieces Pc.

While the above description mentions, as the first holding state St1, a state where one or two transported pieces Pc are held and, as the second holding state St2, a state where three or fourth transported pieces Pc are held, no limitation is meant with regard to the number of transported pieces Pc held. By appropriately designing the shape of the first rear support portion 552 of the support plate 551, the shape of the second front support portion 572 of the support plate 571, the shape of the first front support portion 553 of the support plate 551, and the shape of the second rear support portion 573 of the support plate 571, it is possible to freely set the numbers of transported pieces Pc that can be held in the first and second holding states St1 and St2. This makes it possible to hold in the second holding state St2 a larger number of pieces than in the first holding state St1 regardless of the number of transported pieces Pc, and thereby to achieve flexible grouping.

<Cartoning Device 500>

Figure 33:
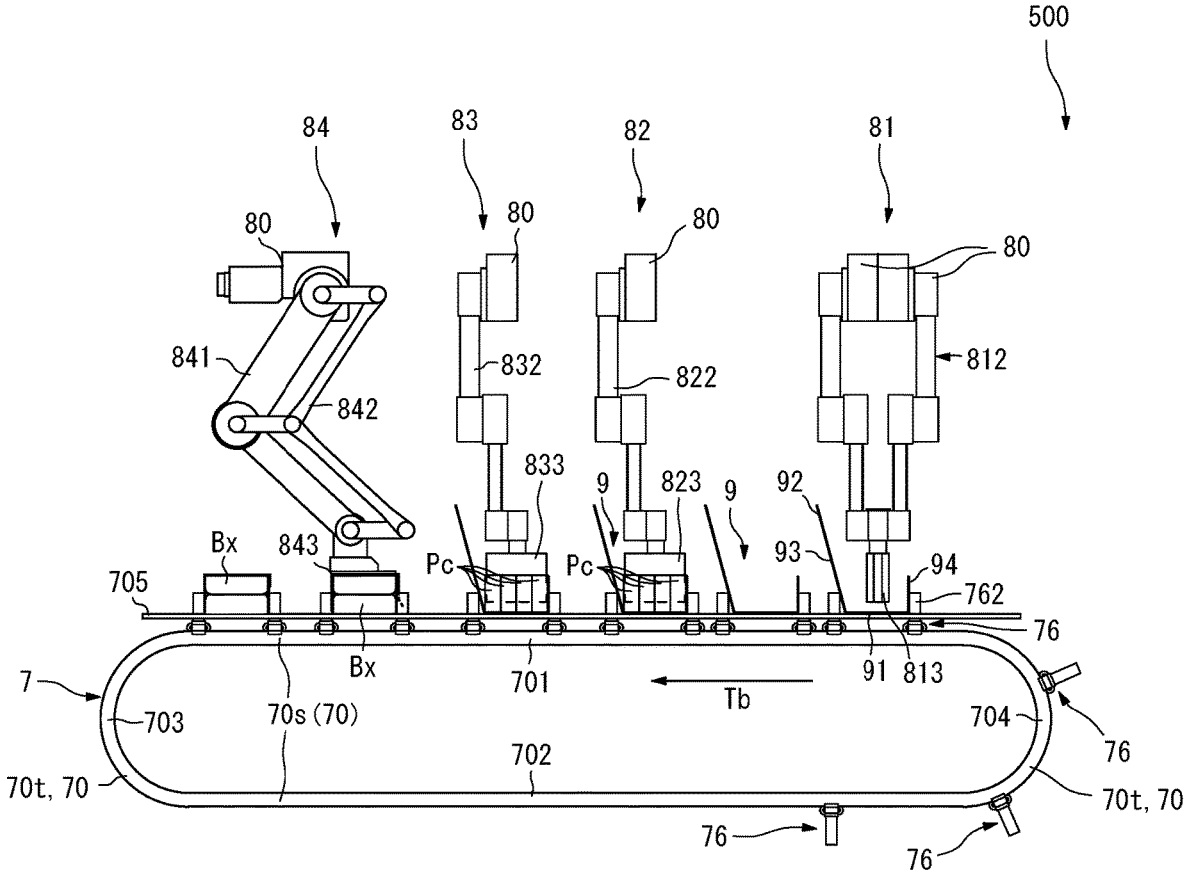
FIG. 33 is a front view of a cartoning device.

FIG. 33 is a front view of the cartoning device 500. In the transport and cartoning apparatus 100, at the terminal end in the transport direction Tr of articles (also referred to as transported pieces, without limitation to "pieces that are being transported") Pc is arranged the cartoning device 500 for packing transported pieces Pc in a packing box Bx. The cartoning device 500 packs transported pieces Pc in a packing box Bx formed by folding a sheet 9 such as a sheet of cardboard and carries it outside.

As shown in FIGS. 1 and 33, the cartoning device 500 packs one set after another of four transported pieces Pc bundled together, each set as a single piece, into the folded sheet 9. The cartoning device 500 includes part of the delivery loop 4 (here, the packing straight part 406), a box transport loop 7, a sheet feeder 81, a first cartoner 82, a second cartoner 83, and a sealer 84.

<Box Transport Loop 7>

As shown in FIG. 33, the box transport loop 7 includes a box transport rail 70, a box transport linear motor mechanism 74 (see FIG. 35 etc. referred to later, and a box transport shuttle 76. The box transport loop 7 has its opposite ends coupled together to be formed in the shape of a loop. The box transport loop 7 includes a first straight portion 701 and a second straight portion 702 each formed with a straight box transport rail 70*s*, and a first curved section 703 and a second curved section 704 each formed with a curved box transport rail 70*t*. A straight box transport rail 70*s* and a curved box transport rail 70*t* have the same structure except whether they are curved or not. In the following description, a box transport rail is referred to simply as a box transport rail 70 unless distinction is necessary, in which case it is identified accordingly.

<Box Transport Rail 70>

The box transport rail 70 has a main rail 71, a grooved rail 72, and a flat rail 73 (see FIG. 35 referred to later). The box transport rail 70 has substantially the same structure as the transport rail 20; accordingly, while correspondence between the parts of the delivery rail 40 and the parts of the transport rail 20 will be clarified, no detailed description will be repeated. The main rail 71 of the box delivery rail 70 corresponds to the main rail 21 of the transport rail 20. The grooved rail 72 of the box transport rail 70 corresponds to the grooved rail 22 of the transport rail 20.

A groove 721 in the grooved rail 72 corresponds to the groove 221 in the grooved rail 22. The grooved rail 72 of the box transport rail 70 corresponds to the grooved rail 22 of the transport rail 20. The flat rail 73 corresponds to the flat rail 23. A gap 75 in the box transport rail 70 corresponds to the gap 25 in the transport rail 20. In the box transport rail 70, the grooved rail 72 and the flat rail 73 are arranged adjacent to each other with the main rail 71 in between in a direction intersecting the box transport direction of the main rail 71.

The box transport loop 7 has the first straight section 701, the first curved section 703, the second straight section 702, and the second curved section 704 coupled together in this order to be formed in the shape of a loop. As shown in FIG. 33, the first and second straight sections 701 and 702 are arranged parallel to each other, above each other. The first and second curved sections 703 and 704 connect together the first and second straight sections 701 and 702, which are arranged above each other, into the shape of a loop.

The first straight section 701 of the box transport loop 7 is arranged above the second straight section 702. As seen in a plan view, the first straight section 701 is arranged outward of the packing straight part 406 rearward of the first straight section 401 of the delivery loop 4 in the transport direction Tr.

The box transport loop 7 includes guide rails 705 arranged along the first straight section 701. The guide rails 705 are arranged parallel to the box transport rail 70*s* included in the first straight section 701, and are arranged pairwise with the box transport rail 70*s* disposed in between. In the box transport loop 7, on the top faces of the guide rails 705, a sheet 9 is arranged to be supported while moving.

<Box Transport Linear Motor Mechanism 74>

In the box transport loop 7, a plurality of box transport shuttles 76 are arranged. The box transport linear motor mechanism 74 can drive the box transport shuttles 76 independently.

The box transport linear motor mechanism 74 has a similar configuration to the transport linear motor mechanism 24. The box transport linear motor mechanism 74 includes coils 741 arranged in the box transport rail 70, magnets 742 arranged in the box transport shuttles 76 (see FIGS. 35 to 37), and a linear driver 743 (see FIG. 2). The linear driver 743 supplies the coils with adequate currents according to instructions from the controller 600. With the coils supplied with currents, they along with the magnets constitute a linear motor, and the box transport shuttles 76 move along the box transport rail 70.

<Box Transport Shuttle 76>

The box transport shuttles 76 are arranged on the outer surface of the box transport rail 70, and are movable along the box transport rail 70. The box transport shuttle 76 includes a main main body 761, sheet holding arms 762, two grooved rollers 763, and two flat rollers 764. In the main main body 761, a magnet 742 of the box transport linear motor mechanism 74 is arranged. The magnet 742 is housed inside the main main body 761, and faces a coil 741 arranged in the box transport rail 70 in a direction intersecting with the transport direction.

The two grooved rollers 763 are arranged away from each other in the transport direction and displaced in a direction intersecting the box transport direction Tb. The grooved rollers 763 rotate while remaining fitted in the groove 721 in the grooved rail 72. The two flat rollers 764 are arranged away from each other in the transport direction and displaced in a direction intersecting the box transport direction Tb. The flat rollers 764 rotate while remaining in contact with the flat rail 73. In the box transport shuttle 76, the grooved rollers 763, and also the flat rollers 764, are arranged at opposite ends in a direction intersecting the transport direction.

The sheet holding arms 762 protrude from the main main body 761, outward of the box transport loop 7. The sheet holding arms 762 are rod-like, and make contact with the sheet 9.

<Sheet 9>

Now, the sheet 9 that forms the packing box Bx will be described with reference to the relevant diagrams. As shown in FIGS. 1 and 33, the sheet 9 has a bottom section 91, a top section 92, a front section 93, and a rear section 94. The bottom section 91 is in the shape of a rectangular plate of which the longer-edge direction runs in a direction orthogonal to the box transport direction Tb. To the front and rear edges of the bottom section 91, the front section 93 and the rear section 94 are respectively coupled. To opposite side edges of the bottom section 91 intersecting the box transport direction Tb, lid sections 911 are coupled. The length of the shorter edges of the bottom section 91 is equal or substantially equal to the length of four transported pieces Pc put together in a row.

The front section 93 and the rear section 94 have the same size and shape. The front section 93 and the rear section 94 are in a rectangular shape of which the longer-edge direction is orthogonal to the box transport direction Tb. To opposite edges of the front section 93 and the rear section 94 in the direction orthogonal to the box transport direction Tb, lid sections 931 and 941 are coupled. The length of the shorter edges of the front section 93 and the rear section 94 is equal or substantially equal to the height of a transported piece Pc.

The top section 92 couples to the edge of the front section 93 opposite from its edge coupled to the bottom section 91. The top section 92 has the same size and shape as the bottom section 91. To opposite edges of the top section 92 in a direction intersecting the transport direction, a lid section 921 is coupled. To the edge of the top section 92 opposite from its edge coupled to the front section 93, a fastening section 922 is coupled. When the packing box Bx is constructed from the sheet 9, the fastening section 922 is fastened to the rear section 94.

The constructed packing box Bx is sealed with the lid sections 911, 921, 931, and 941 folded onto and then bonded to the bottom section 91, the top section 92, the front section 93, and the rear section 94 respectively.

<Sheet Feeder 81, First Cartoner 82, Second Cartoner 83, and Sealer 84>

In the sheet feeder 81, the first cartoner 82, the second cartoner 83, and the sealer 84, similarly configured multi-joint arm robots 80 are respectively arranged. Now, a multi-joint arm robot 80 will be described with reference to relevant diagrams.

Figure 34:
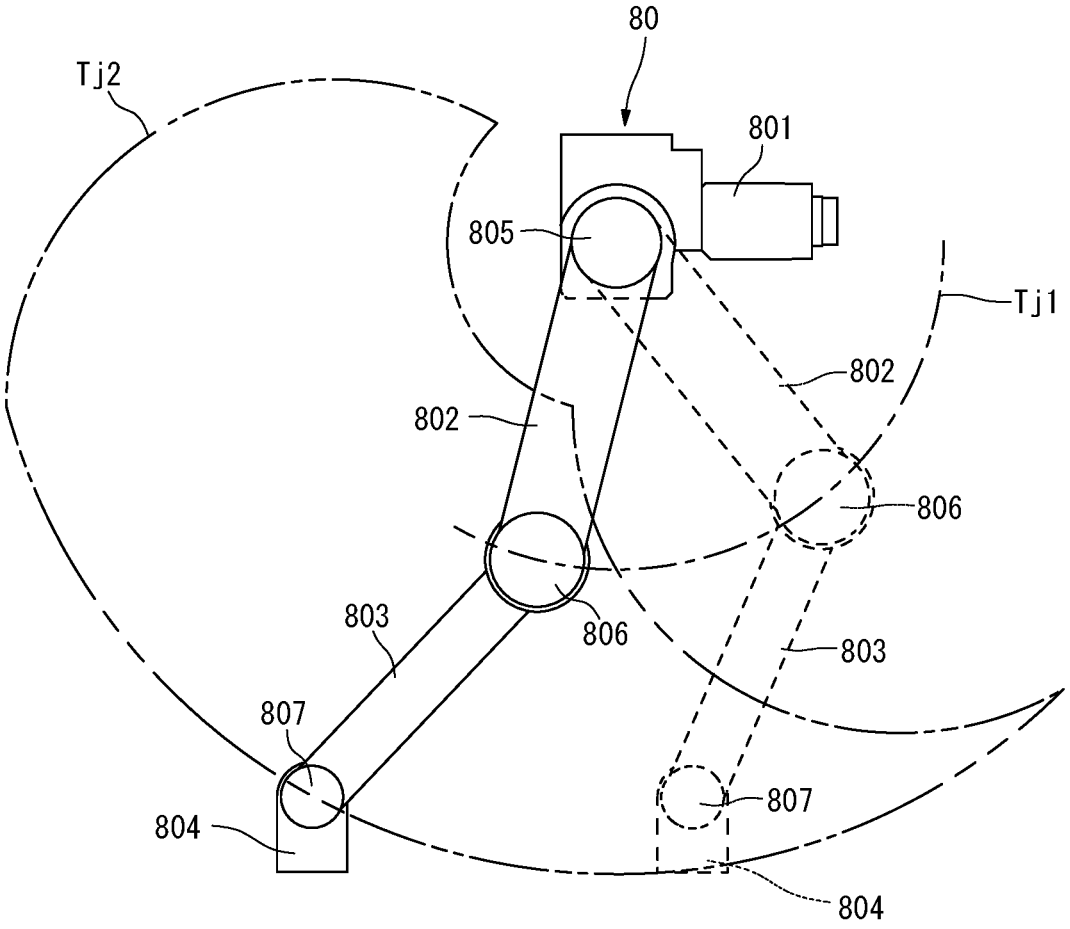
FIG. 34 is a front view of a multi-joint arm robot.

FIG. 34 is a front view of the multi-joint arm robot 80. As shown in FIG. 34, the multi-joint arm robot 80 has a main body 801, an upper arm 802, a lower arm 803, a manipulator 804, a first joint 805, a second joint 806, and a third joint 807.

The main body 801 is arranged at the top end of the multi-joint arm robot 80. The main body 801 is fastened to an unillustrated frame of the cartoning device 500. The first joint 805 is arranged in the main body 801. The upper arm 802 is rotatably fitted to the main body 801 via the first joint 805. The first joint 805 has an unillustrated actuator including a motor or the like. By the action of the actuator, the upper arm 802 rotates about the center axis of the first joint 805. The distal end of the upper arm 802 can reciprocate along a curved trajectory Tj1 as shown in FIG. 34.

The lower arm 803 is rotatably fitted to the distal end of the upper arm 802 via the second joint 806. The second joint 806 has an actuator including a motor or the like. By the action of the actuator, the lower arm 803 rotates about the center axis of the second joint 806. Controlling the first and second joints 805 and 806 in a coordinated manner permits the distal end of the lower arm 803 to move within the range enclosed by a curved trajectory Tj2 as shown in FIG. 34.

The manipulator 804 is configured to be fit for the operation to be performed at the corresponding one of the sheet feeder 81, the first cartoner 82, the second cartoner 83, and the sealer 84. The manipulator 804 may be furnished with a tool fit for the corresponding operation. The manipulator 804 is rotatably fitted to the distal end of the lower arm 803 via the third joint 807. Controlling the first, second, and third joints 805, 806, and 807 in a coordinated manner permits the manipulator 804 to move while keeping a predetermined posture regardless of the positions of the upper and lower arms 802 and 803. The configuration of the manipulator 804 at each of the sheet feeder 81, the first cartoner 82, the second cartoner 83, and the sealer 84 will be described later.

As shown in FIGS. 1 and 33, the sheet feeder 81, the first cartoner 82, the second cartoner 83, and the sealer 84 are arranged close to the first straight portion 701 of the box transport loop 7. The sheet feeder 81, the first cartoner 82, the second cartoner 83, and the sealer 84 are arranged in this order in the box transport direction Tb.

<Sheet Feeder 81>

Figure 35:
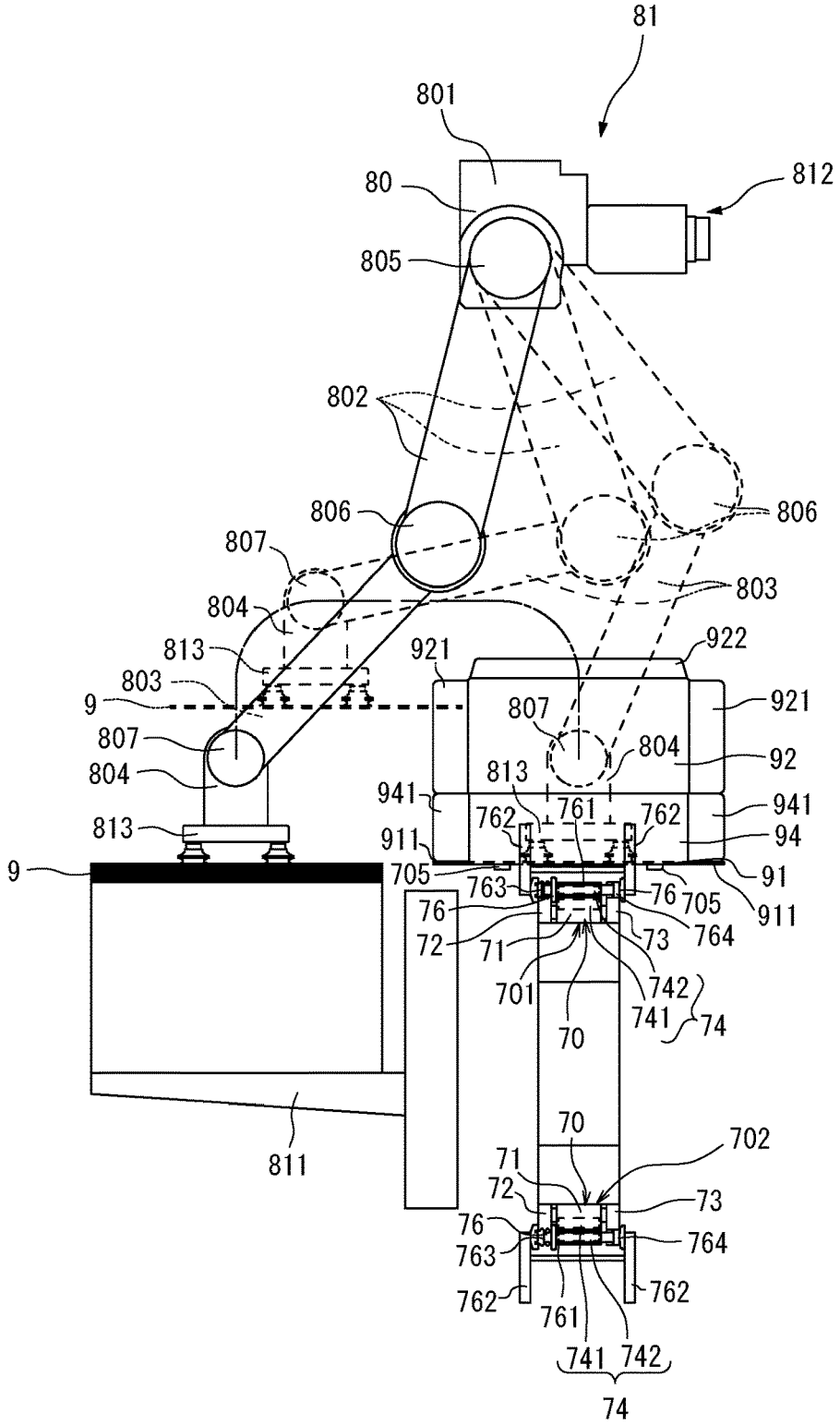
FIG. 35 is a schematic diagram showing a sheet feeder as seen from rearward in the box transport direction.

FIG. 35 is a schematic diagram of the sheet feeder 81 as seen from rearward of it in the box transport direction Tb. The sheet feeder 81 includes a sheet placement stage 811 and a sheet dispensing device 812. The sheet placement stage 811 is arranged close to the box transport loop 7. On top of the sheet placement stage 811, a plurality of sheets 9 are staked in the up-down direction. The sheet placement stage 811 is movable in the up-down direction, and is urged upward such that the topmost one of the plurality of sheets 9 stacked on it is arranged at a fixed position.

The sheet dispensing device 812 includes a multi-joint arm robot 80, and is configured such that the manipulator 804 of the multi-joint arm robot 80 is fitted with a suction unit 813. The suction unit 813 has a space inside it, and by sucking the air from the inside space absorbs a sheet 9. The actuators in the first, second, and third joints 805, 806, and 807 respectively are connected to the controller 600, and operate according to instructions from the controller 600.

The sheet feeder 81 is controlled by the controller 600. The sheet dispensing device 812 brings the suction unit 813 into contact with the sheets 9 stacked on the sheet placement stage 811 and lifts a sheet 9. The upper and lower arms 802 and 803 are then operated to move the sheet 9 onto the guide rails 705.

When the sheet dispensing device 812 places the sheet 9 on the guide rails 705, the controller 600 controls such that box transport shuttles 76 are arranged frontward and rearward of the bottom section 91 in the transport direction. At this time, the front and rear sections 93 and 94 make contact with the box transport shuttles 76 arranged frontward and rearward of them. Thus, the front and rear sections 93 and 94 are folded by the box transport shuttles 76. In particular, the rear section 94 is supported by the sheet holding arms 762 of the box transport shuttles 76 to rise vertically upright from the bottom sheet portion 91. That is, the sheet 9 has its rear section 94 positioned in the transport direction by the box transport shuttle 76 arranged rearward.

The controller 600 moves the box transport shuttles 76 in the box transport direction Tb. Thus, the folded sheet 9 is, while being supported by the box transport shuttles 76, fed to the first cartoner 82.

<First and Second Cartoners 82 and 83>

Next, the first and second cartoners 82 and 83 will be described. The first and second cartoners 82 and 83 differ only in that they are arranged at different places, and have substantially the same configuration. Accordingly, the following description deals with the first cartoner 82 as their representative and, for the second cartoner 83, how it corresponds to the first cartoner 82 will be described.

Figure 36:
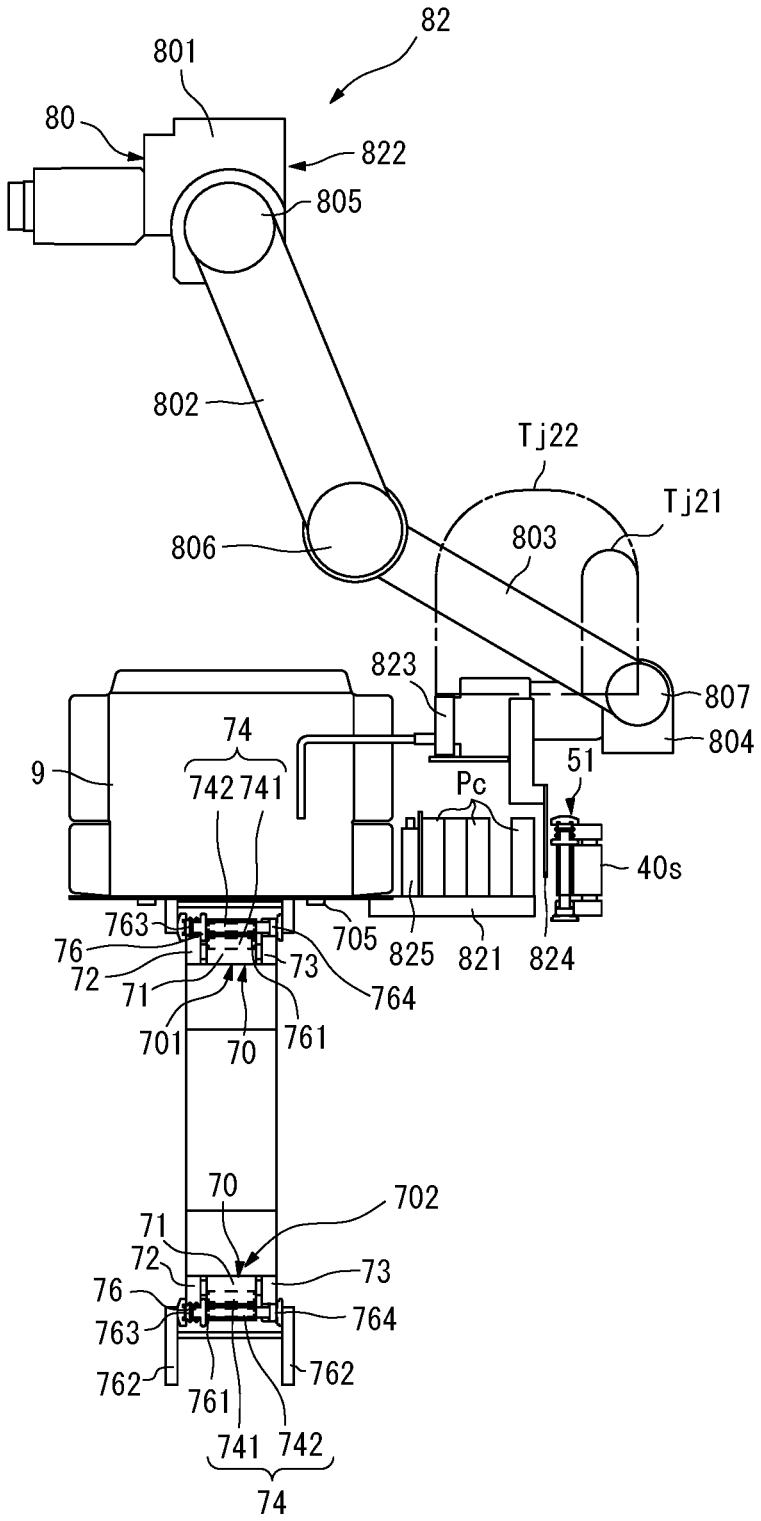
FIG. 36 is a schematic diagram showing a pushing device before its operation of pushing articles.
Figure 37:
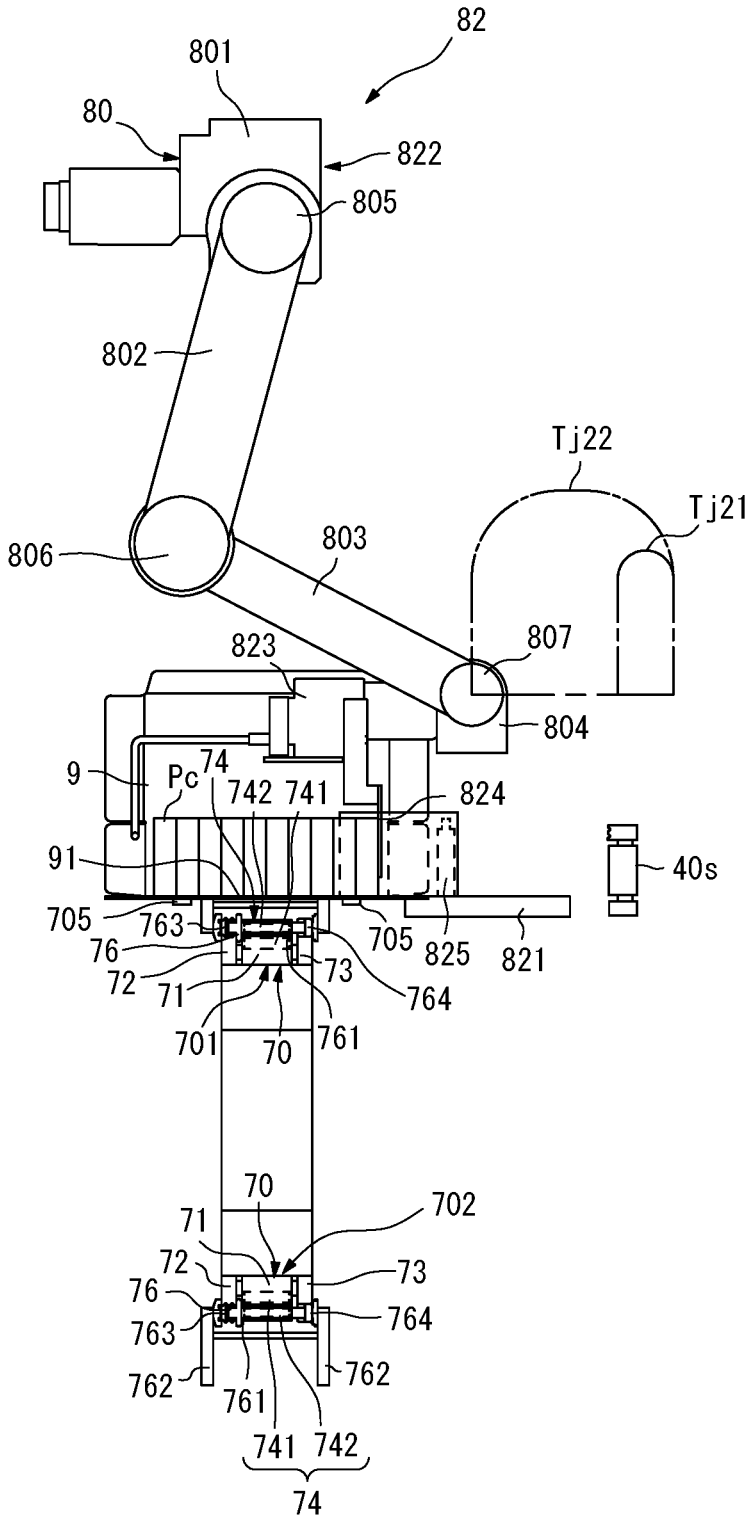
FIG. 37 is a schematic diagram showing articles pushed into a folded sheet by the pushing device.

FIG. 36 is a schematic diagram showing a pushing device 822 for pushing an article Pc before its operation. FIG. 37 is a schematic diagram showing an article Pc pushed into a folded sheet 9 by the pushing device 822.

As shown in FIGS. 33, 36, and 37, the first cartoner 82 has a placement stage 821 and a pushing device 822. The placement stage 821 is arranged outward of the packing straight part 406 of the delivery loop 4. In the up-down direction, the placement stage 821 is arranged below the packing straight part 406. The placement stage 821 is arranged below four articles Pc in a row in the transport direction that are held by the first and second delivery shuttles 51 and 52.

The controller 600 operates the first and second delivery shuttles 51 and 52 to move the four articles Pc in a row in the transport direction to a position where they overlap the placement stage 821 in the up-down direction and stop them there. The controller 600 then moves the first and second delivery shuttles 51 and 52 to rearward and frontward of the four articles Pc in the transport direction. Thus, the four articles Pc in a row are placed on the placement stage 821.

The placement stage 821 extends in a direction approaching the box transport loop 7, and part of the placement stage 821 overlaps the sheet 9. The articles Pc placed on the placement stage 821 are pushed by the pushing device 822 to move onto the placement stage 821.

The pushing device 822 includes a multi-joint arm robot 80, and is configured such that the manipulator 804 of the multi-joint arm robot 80 is fitted with a pushing plate 823. The pushing plate 823 is in the shape of a flat plate extending in the transport direction and in the up-down direction. The pushing plate 823 extends downward from the manipulator 804. The actuators in the first, second and third joints 805, 806, and 807 are connected to the controller 600, and operate according to instructions from the controller 600.

As shown in FIG. 36, the pushing device 822 is operated so as to move the manipulator 804 along a trajectory Tj21 or Tj22. Moving it along the trajectory Tj21 permits the pushing plate 823 to move the four articles Pc placed on the placement stage 821 toward the sheet 9. Meanwhile, the articles Pc are moved to outward of an outer end part of the first delivery engaging portion 56 of the first delivery shuttle 51. This permits the first delivery shuttle 51 to move. Moreover, by moving the pushing device 822 along the trajectory Tj21, it is possible to push the articles Pc already placed on the placement stage 821 to accumulate them on the placement stage 821.

The placement stage 821 may be furnished with a gate 824. The gate 824 remains closed until the sheet 9 moves to the first cartoner 82, and opens when the sheet 9 has moved to the first cartoner 82. It is thus possible to prevent the articles Pc pushed frontward from falling.

The pushing device 822 can move also along the trajectory Tj22. Its movement along the trajectory Tj21 permits the articles Pc placed on the placement stage 821 and/or the articles Pc placed on the placement stage 821 to be pushed onto the bottom section 91 of the sheet 9 that has been folded and transported by the box transport shuttle 76, that is, packed into it (see FIG. 37). In the first cartoner 82, a number of articles Pc to be packed (e.g., 10 bundles each comprising four pieces) are packed in the bottom section 91 of the sheet 9.

The second cartoner 83 includes a placement stage 831, which corresponds to the placement stage 821, and a pushing device 832, which corresponds to the pushing device 822. The pushing device 832 includes a pushing plate 833, which corresponds to the pushing plate 823, and a gate 834, which corresponds to the gate 824. Also in the second cartoner 83, articles Pc that have been transported in a similar manner as in the first cartoner 82 are packed in the bottom face portion 91 of the sheet 9.

After the number of pieces to be packed in the first and second cartoners 82 and 83 (e.g., 10 bundles each comprising four pieces) have been packed in the bottom section 91 of the sheet 9, the controller 600 moves the box transport shuttle 76 in the box transport direction Tb. Thus, the sheet 9 having the articles Pc packed in it is fed to the sealer 84.

<Sealer 84>

Figure 38:
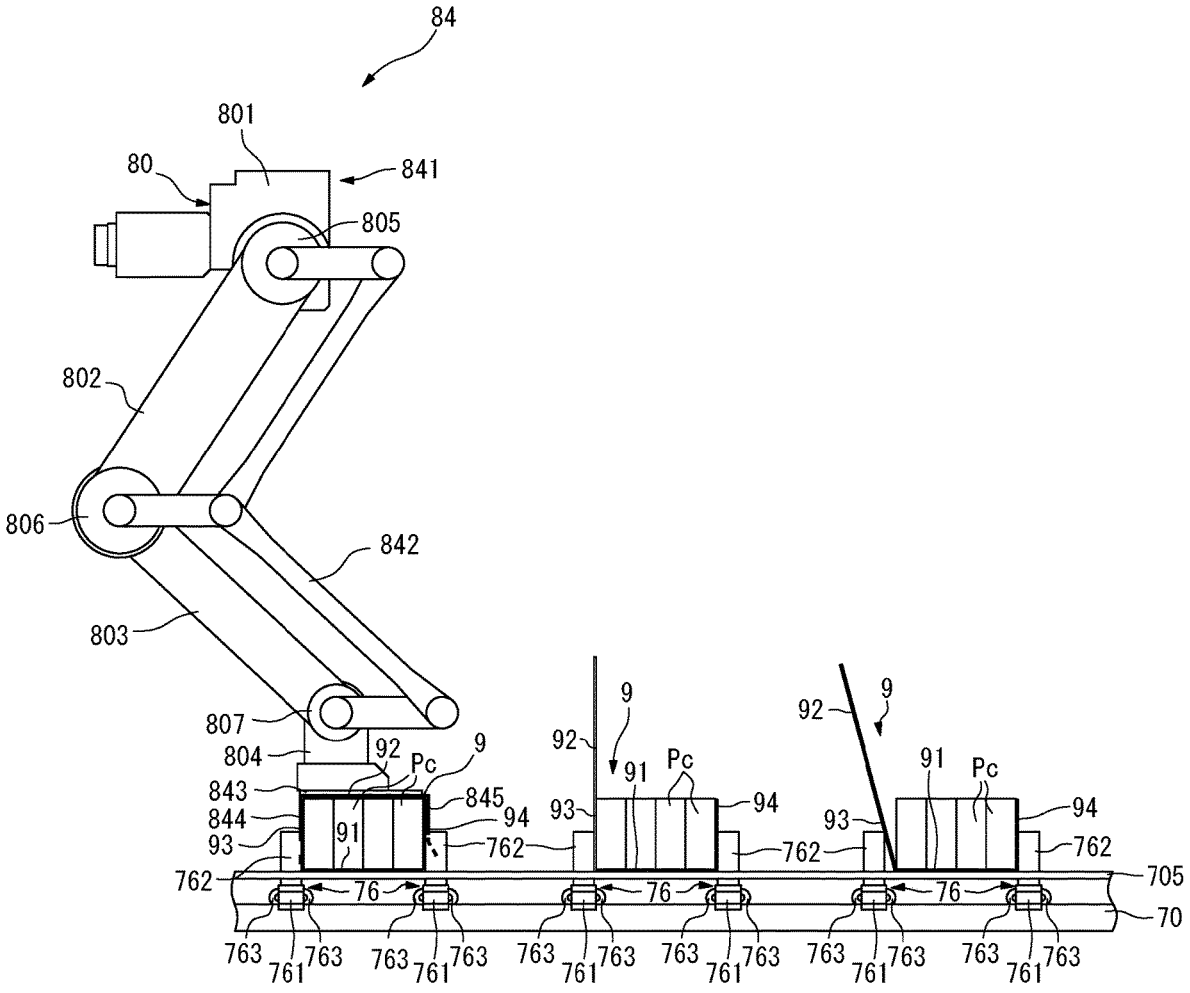
FIG. 38 is a schematic diagram showing a sealing device.
Figure 39:
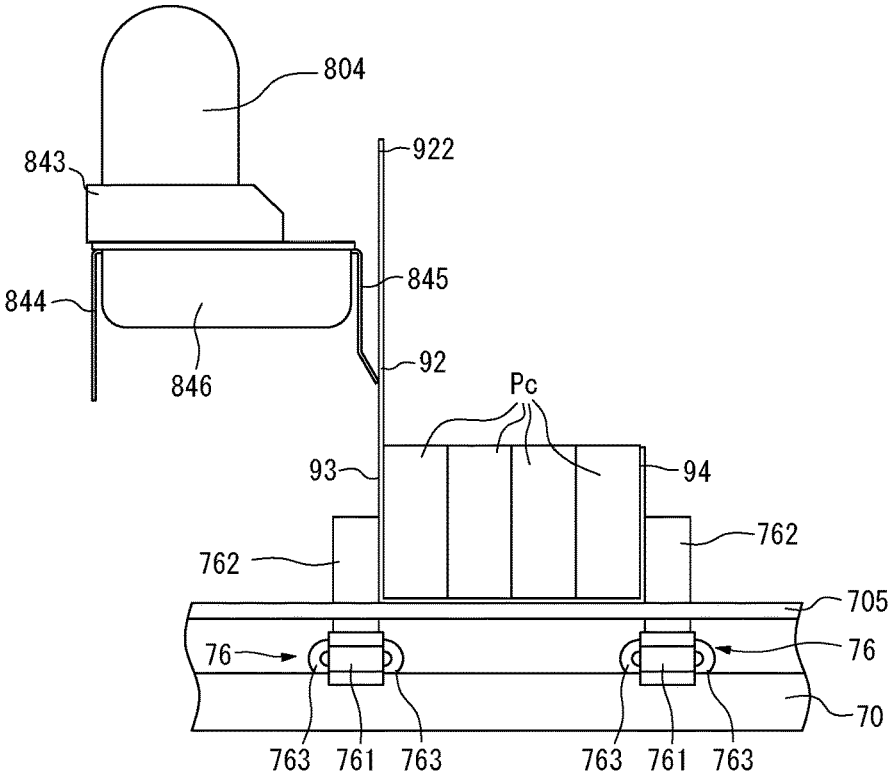
FIG. 39 is a diagram showing a folding tool of the sealing device in contact with a top sheet portion.
Figure 40:
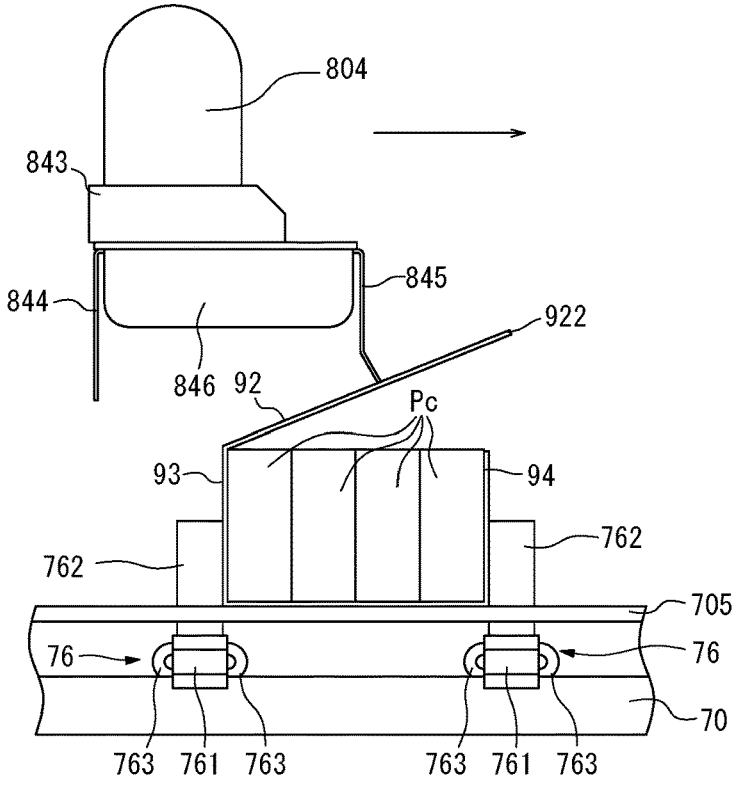
FIG. 40 is a diagram showing the top sheet portion folded by the sealing device.
Figure 41:
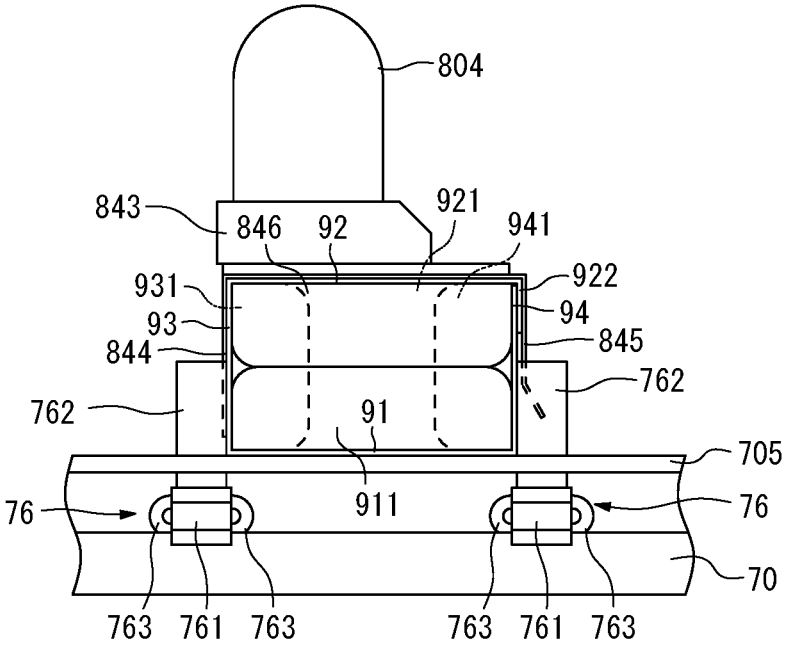
FIG. 41 is a diagram showing the sealing device and a packing box immediately after completion of sealing.

The sealer 84 will be described. FIG. 38 is a schematic diagram showing a sealing device 841. FIG. 39 is a diagram showing a folding tool 843 of the sealing device 841 in contact with the top section 92. FIG. 40 is a diagram showing the top section 92 folded by the sealing device 841. FIG. 41 is a diagram showing the sealing device 841 and a packing box Bx immediately after completion of sealing.

As shown in FIG. 38, the sealer 84 includes the sealing device 841 and a link unit 842. The sealing device 841 includes a multi-joint arm robot 80, and is configured such that the manipulator 804 of the multi-joint arm robot 80 is fitted with a folding tool 843. The sealing device 841 is connected to the controller 600, and operates according to instructions from the controller 600.

The folding tool 843 has a front drooping portion 844, a rear drooping portion 845, and a pair of side drooping portions 846. The front drooping portion 844 is arranged frontward of the folding tool 843 in the transport direction. The rear drooping portion 845 is arranged rearward of the folding tool 843 in the transport direction. A lower end part of the rear drooping portion 845 is so inclined as to extend rearward in the transport direction as it extends downward. The pair of side drooping portions 846 are arranged so as to form a pair in a direction intersecting the transport direction.

The controller 600, when moving a sheet 9 having articles Pc packed in it to the sealer 84, makes a box transport shuttle 76 frontward of the sheet 9 in the box transport direction Tb approach the bottom section 91 of the sheet 9. Thus, the front section 93 is pressed to become orthogonal to the bottom section 91 (see FIG. 39).

The controller 600 controls the sealing device 841 to make the folding tool 843 approach the sheet 9, and brings the rear drooping portion 845 into contact with the top section 92. After that, the controller 600 moves the folding tool 843 rearward relative to the sheet 9 and thereby folds the top section 92 such that it covers over the articles Pc packed in the top section 92 (see FIG. 40). At this time, the controller 600 may control the sealing device 841 alone or the box transport shuttle 76 and the sealing device 841 in a coordinated manner.

After the top section 92 is folded up to a predetermined angle, the controller 600 operates the sealing device 841 to press the folding tool 843 against a top part of the articles Pc. At this time, the lid portion 921 coupled to the top section 92 is pressed by the side drooping portion 846. Moreover, the fastening section 922 makes contact with the rear drooping portion 845 and is folded. In the sealer 84, the lid section 911 coupled to bottom section 91, the lid section 931 coupled wo the front section 93, and the lid section 941 coupled to the rear section 94 are folded at the same time that, or before, the lid section 921 and the fastening section 922 are folded.

When the top section 92 becomes parallel or substantially parallel to the bottom section 91 in the up-down direction, the lid sections 911, 921, 931, and 941 are fastened (see FIG. 41). Also the fastening section 922 is fastened to the rear section 94. The fasting here can be achieved with adhesive, with tape, or by hot sealing, or the like, without limitation to those means. For the fastening of the lid sections 911, 921, 931, and 941, the sealing device 841 may be equipped with a fastening function, or a fastening device may be provided separately.

In the manner described above, the number of articles Pc to be packed are packed in the sealed packing box Bx. The packing box Bx having the articles Pc packed in it is transported by a carry-out conveyor Oc arranged parallel to the box transport loop 7, so that the packing box Bx is carried out of the transport and cartoning apparatus 100 by the carry-out conveyor Oc.

The embodiments of the present invention described above are in no way meant to limit the scope of the present invention. Any embodiments of the present invention allow for any modifications without departure from the spirit of the invention.

REFERENCE SIGNS LIST

100 transport and cartoning apparatus
200 transfer device
300 delivery device
400 re-holding device
500 cartoning device
600 controller
601 processing circuit
602 storage circuit
1 article loader
11 loading conveyor
111 transfer conveying part
112 conveyer motor
12 nip roller
121 roller motor
122 first pressing portion
13 pusher
131 first pushing portion
132 second pushing portion
133 pusher motor
2 transport loop
201 first straight section
202 second straight section
203 first curved section
204 second curved section
205 delivery straight part
20 transport rail
21 main rail
22 grooved rail
221 groove
222 second pressing portion
23 flat rail
24 transport linear motor mechanism
241 coil
242 magnet
243 linear driver
25 gap
26 straw applicator
27 defective article rejector
271 rejection conveyor
30 main body
301 protrusion
302 upper roller support
303 lower roller support
31 first transport shuttle
32 second transport shuttle
33 upper roller
331 roller ridge
34 lower roller
35 first transport support portion
350 support mount
351 support plate
352 corner part
36 first transport engaging portion
36L first transport lower arm
36U first transport upper arm
360 arm mount
361 arm body
362 claw
363 presser
364 contact face
37 second transport support portion
370 support mount
371 support plate
372 corner part
38 second transport engaging portion
38L second transport lower arm
38U second transport upper arm
380 arm mount
381 arm body
382 claw
383 presser
384 contact face
4 delivery loop
401 first straight section
402 second straight section
403 first curved section

404 second curved section
405 delivery straight part
406 packing straight part
407 first near region
408 second near region
409 far region
40 delivery rail
41 main rail
42 grooved rail
421 groove
43 flat rail
44 delivery linear motor mechanism
441 coil
442 magnet
443 linear driver
45 gap
50 main body
501 protrusion
502 upper roller support
503 lower roller support
51 first delivery shuttle
52 second delivery shuttle
53 upper roller
54 lower roller
55 first delivery support portion
550 support mount
551 support plate
552 first rear support portion
553 first front support portion
56 first delivery engaging portion
56L first delivery lower arm
56U first delivery upper arm
560 arm mount
561 arm body
562 rear claw
563 front claw
564 rear stopper
565 front stopper
566 rear contact face
567 front contact face
57 second delivery support portion
570 support mount
571 support plate
572 second front support portion
573 second rear support portion
58 second delivery engaging portion
58L second delivery lower arm
58U second delivery upper arm
580 arm mount
581 arm body
582 front claw
583 rear claw
584 front stopper
585 rear stopper
586 front contact face
587 rear contact face
6 re-holding conveyor
60 conveyor motor
61 first near portion
62 second near portion
63 far portion
64 curved section
65 curved section
7 box transport loop
701 first straight portion
702 second straight portion
703 first curved section
704 second curved section
705 guide rail
70 box transport rail
71 main rail
72 grooved rail
721 groove
73 flat rail
74 box transport linear motor mechanism
741 linear driver
742 magnet
75 gap
76 box transport shuttle
761 main body
762 sheet holding arm
763 grooved roller
764 flat roller
80 multi-joint arm robot
801 main body
802 upper arm
803 lower arm
804 manipulator
805 first joint
806 second joint
807 third joint
81 sheet feeder
811 sheet placement stage
812 sheet dispensing device
813 suction unit
82 first cartoner
821 placement stage
822 pushing device
823 pushing plate
83 second packing unit
831 placement stage
832 pushing device
833 pushing plate
84 sealer
841 sealing device
842 link unit
843 folding tool
844 front drooping portion
845 rear drooping portion
846 side drooping portion
9 sheet
91 bottom sheet portion
911 lid portion
92 top sheet portion
921 lid portion
922 fastening portion
93 front sheet portion
931 lid portion
94 rear sheet portion
941 lid portion
Bx packing box
Cc connection conveyor
Pc transported piece (article)

The invention claimed is:

1. A cartoning device for packing articles in a packing box formed by folding a sheet, the cartoning device then transporting the packing box in a box transport direction, the cartoning device comprising:

a box transport rail extending along the box transport direction;

a plurality of box transport shuttles movably arranged on the box transport rail so as to be movable in the box transport direction;

a box transport linear motor mechanism configured to control the plurality of box transport shuttles independently of each other;

a sheet feeder configured to absorb by suction the sheet from a sheet placement stage, then bring front and rear parts of the sheet in a transport direction thereof into contact with the box transport shuttles located frontward and rearward in the box transport direction to fold the sheet, and then feed the sheet onto the box transport rail;

a pushing unit configured to push, in a direction intersecting the box transport direction, the articles into the folded sheet having moved rearward of the sheet feeder in the box transport direction by the box transport shuttles; and a sealer configured to seal the sheet by pressing, from above and from frontward and rearward in the transport direction and from a direction intersecting the box transport direction, the sheet having a to-be-packed number of articles pushed thereinto and having been moved rearward of the pushing unit in the transport direction by the box transport shuttles, wherein when located in the sheet feeder, the box transport shuttles receive the sheet with the box transport shuttles apart from each other across an interval greater than a bottom sheet portion of the sheet, and during movement from the pushing unit to the sealer, the box transport shuttle arranged frontward in the box transport direction is brought close to the bottom sheet portion so as to reduce an angle of a part frontward of the bottom sheet portion in the box transport direction relative to the bottom sheet portion.

2. The cartoning device according to claim 1, wherein the box transport shuttles include a sheet holding arm extending vertically upward.

3. The cartoning device according to claim 1, wherein the box transport rail includes:

straight box transport rails arranged one above another; and curved box transport rails coupling the straight box transport rails together into a shape of a loop, and wherein the sheet feeder, the pushing unit, and the sealer are arranged along the upper straight box transport rail.

4. The cartoning device according to claim 3, further comprising a guide rail arranged along the upper straight box transport rail and supporting the sheet from below.

5. The cartoning device according to claim 1, wherein the pushing unit comprises a plurality of pushing units.

6. The cartoning device according to claim 1, wherein the box transport shuttles transport the packing box, which is formed by sealing with the sealer the sheet having the articles packed therein, to a carry-out unit provided rearward of the sealer in the box transport direction while holding the packing box from frontward and rearward thereof.

* * * * *